US010975559B2

(12) United States Patent
Shakkour et al.

(10) Patent No.: US 10,975,559 B2
(45) Date of Patent: Apr. 13, 2021

(54) ELECTRONIC FLUSH VALVE SYSTEM FOR TANKLESS WATER FIXTURES

(71) Applicant: MAC Faucets, LLC, Paramount, CA (US)

(72) Inventors: Fadi Shakkour, Encino, CA (US); Manuel Medina, South Gate, CA (US); Roaa Nabeel Nacy, Anaheim, CA (US)

( * ) Notice: Subject to any disclaimer, the term of this patent is extended or adjusted under 35 U.S.C. 154(b) by 126 days.

(21) Appl. No.: 16/256,145

(22) Filed: Jan. 24, 2019

(65) Prior Publication Data

US 2019/0234058 A1 Aug. 1, 2019

Related U.S. Application Data

(60) Provisional application No. 62/624,689, filed on Jan. 31, 2018.

(51) Int. Cl.

| | |
|---|---|
| ***E03D 3/04*** | (2006.01) |
| ***E03D 13/00*** | (2006.01) |
| ***E03D 5/10*** | (2006.01) |
| ***E03D 5/02*** | (2006.01) |

(52) U.S. Cl.

CPC ..... *E03D 13/007* (2013.01); *E03D 3/04* (2013.01); *E03D 5/02* (2013.01); *E03D 5/10* (2013.01); *E03D 5/105* (2013.01); *E03D 13/005* (2013.01); *E03D 13/00* (2013.01)

(58) Field of Classification Search

CPC ..... E03D 3/04
USPC ..... 4/249
See application file for complete search history.

(56) References Cited

U.S. PATENT DOCUMENTS

| | | | |
|---|---|---|---|
| 2,689,706 | A | 8/1950 | Carlson |
| 4,261,545 | A | 4/1981 | Allen |
| 4,793,588 | A | 12/1988 | Laverty, Jr. |
| 5,244,179 | A | 9/1993 | Wilson |
| 6,216,730 | B1 | 4/2001 | Hall |
| 6,346,921 | B1 | 2/2002 | Jahrling |
| 6,382,586 | B1 | 5/2002 | Wilson et al. |
| 2004/0232370 | A1 | 11/2004 | Parsons et al. |

OTHER PUBLICATIONS

Owner's manual model AUV-3 and ATV-3 from MAC Faucets LLC; Publication date: Mar. 15, 2014.
Industry Standard Electronic Retrofit Flush Valve From MAC Faucets LLC; Publication date: Mar. 15, 2014.

*Primary Examiner* — Christine J Skubinna
(74) *Attorney, Agent, or Firm* — Patent Law Agency, LLC; Peter Ganjian

(57) ABSTRACT

The present invention discloses an electronic flush valve system for tankless water fixtures, comprising a valve housing and a replaceable flush valve module removably secured within the valve housing. The flush valve module is comprised of an independent, self-contained flush valve configured as a replaceable flush valve cartridge.

13 Claims, 86 Drawing Sheets

ELECTRONIC FLUSH VALVE SYSTEM FOR TANKLESS WATER FIXTURES

CROSS-REFERENCE TO RELATED APPLICATIONS

This Application claims the benefit of priority of U.S. Utility Provisional Patent Application 62/624,689, filed 31 Jan. 2018, the entire disclosure of which is expressly incorporated by reference in its entirety herein.

All documents mentioned in this specification are herein incorporated by reference to the same extent as if each individual document was specifically and individually indicated to be incorporated by reference.

It should be noted that throughout the disclosure, where a definition or use of a term in any incorporated documents) is inconsistent or contrary to the definition of that term provided herein, the definition of that term provided herein applies and the definition of that term in the incorporated document(s) does not apply.

BACKGROUND OF THE INVENTION

Field of the Invention

One or more embodiments of the present invention relate to flush valves and, more particularly, to a replaceable flush valve in a form of a cartridge.

It should be noted that all of the embodiments of the flush valve system of the present invention are used with tankless (or non-tank) type fixtures (e.g., tankless toilets, tankless urinals, etc.)

Description of Related Art

Conventional flush valves (non-tank based, electronic or mechanical manually operated) are well known and have been in use for a number of years. Conventional flush valves are complex to manufacture, extremely difficult to assemble (in particular at the installation site), and very costly and labor intensive to maintain.

Conventional flush valves are generally comprised of a flush valve body that is integrally designed to house a multiplicity of parts that intimately and cooperatively operate with the flush valve body to provide a fully functioning flush valve. For example, a conventional flush valve body is precision machined in view of the various components that constitute the flush valve and housed within the flush valve body. As a more specific example, a conventional flush valve body includes orifices and other openings to direct water in, around, and out of flush valve components to provide a fully functioning flush valve.

With respect to maintenance or repair of a conventional flush valve after its manufacture and assembly, any of the one or more of the multiplicity of its parts (including flush valve body itself) may fail due to a variety of reasons, including normal wear and tear, corrosion, etc. In general, due to the shear number and complexity of the flush valve components, it is a difficult, labor-intensive task to diagnose the cause of failure of a flush valve.

Additionally, replacement of faulty parts and components has the added complexity in that parts vary from manufacturer to manufacturer and from model to model, therefor parts are seldom stocked by local plumbing wholesalers and distributors let alone the service contractor. This leads to long downtime while parts are ordered.

When a conventional flush valve fails, it may be entirely replaced (including the flush valve body), requiring extensive plumbing and sometimes, construction work. Alternatively, costly exorbitant amount of labor and time is used to diagnose and identify which of the multiplicity of its components have failed so that the failed components may be replaced.

Accordingly, in light of the current, state of the art and the drawbacks to existing flush valves, a need exists for a flush valve that would not require a complex precision machining of a flush valve body to provide orifices or openings required for proper operation. Further, a need exists for a flush valve that would be easy to assemble/disassemble and easy to maintain, with no need or requirement for diagnoses to determine specific component failure, component replacement, plumbing/construction skills, or specialized plumbing tools.

BRIEF SUMMARY OF THE INVENTION

A non-limiting, exemplary aspect of an embodiment of the present invention provides an electronic flush valve system for tankless water fixtures, comprising:

a valve housing; and a replaceable flush valve module.

Another non-limiting, exemplary aspect of an embodiment of the present invention provides an electronic flush, valve system for tankless water fixtures, comprising:

a valve housing; and a replaceable flush valve cartridge removably secured within the valve housing;

wherein: upstream water flowing into the valve housing is prevented as the flush valve cartridge is removed, and is enabled when the flush valve cartridge is secured within the valve housing.

Yet another non-limiting, exemplary aspect of an embodiment of the present invention provides an electronic flush valve system for tankless water fixtures, comprising:

a valve housing; and a replaceable flush valve module removably secured within the valve housing;

the flush valve module is comprised of an independent, self-contained flush valve configured as a replaceable flush valve cartridge;

an inlet member associated with the valve housing that has a gate that controls flow of upstream water into the flush valve cartridge;

an enclosure mechanism that moves from an open to closed position to engage with the gate to close-shut the gate to shut-off upstream water flow into the flush valve cartridge, and moves from the closed position to the open position to disengage from the gate to enable gate to open to allow upstream water flow into the flush valve cartridge;

the enclosure mechanism is moved from the open to the closed position as the flush valve cartridge is removed, and is moved from the closed to the open position as the flush valve cartridge is secured within the valve housing.

Still another non-limiting, exemplary aspect of an embodiment of the present invention provides an electronic flush valve system for tankless water fixtures, comprising:

a valve housing; and a replaceable flush valve module removably secured within the valve housing;

the flush valve module is comprised of an independent, self-contained flush valve configured as a replaceable flush valve cartridge;

wherein: the flush valve cartridge includes one of an electro-mechanical switch and a mechanical plunger.

Still, a further non-limiting, exemplary aspect of an embodiment of the present invention provides an electronic flush valve system for tankless water fixtures, comprising:

a valve housing; and a replaceable flush valve module removably secured within the valve housing;

flush valve module includes:

an upper seal element and a lower seal element;

wherein: water is drained from flush, valve system as the flush valve module is removed, with the upper seal element preventing spilling, of water from a top of the flush system.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention. Stated otherwise, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

In the description given below and or the corresponding set of drawing figures, when it is necessary to distinguish the various members, elements, sections/portions, components, parts, or any other aspects (functional or otherwise) or features or concepts or operations of a device(s) or method(s) from each other, the description and or the corresponding drawing figures may follow reference numbers with a small alphabet character such as (for example)

"ends 278*a*, 278*b*, etc." If the description is common to all of the various members, elements, sections/portions, components, parts, or any other aspects (functional or otherwise) or features or concepts or operations of a device(s) or method(s) such as (for example) to all ends 278*a*, 278*b*, etc., then they may simply be referred to with reference number only and with no alphabet character such as (for example) "end 278."

One or more embodiments of the present invention define a static state as an operational state where forces of water within the flush valve system are in equilibrium.

One or more embodiments of the present invention define a dynamic state as an operational state where forces of water within the flush valve system are not in equilibrium.

One or more embodiments of the present invention provide a flush valve that does not require complex precision machining of a flush valve body to provide orifices or openings required for proper operation. Further, one or more embodiments of the present invention provide a flush valve that may easy be assembled/disassembled and is easy to maintain, with no, need or requirement for diagnoses to determine specific component failure, component replacement, plumbing/construction skills, or specialized plumbing tools.

Flush Valve System—Electronic

Figure 1A:
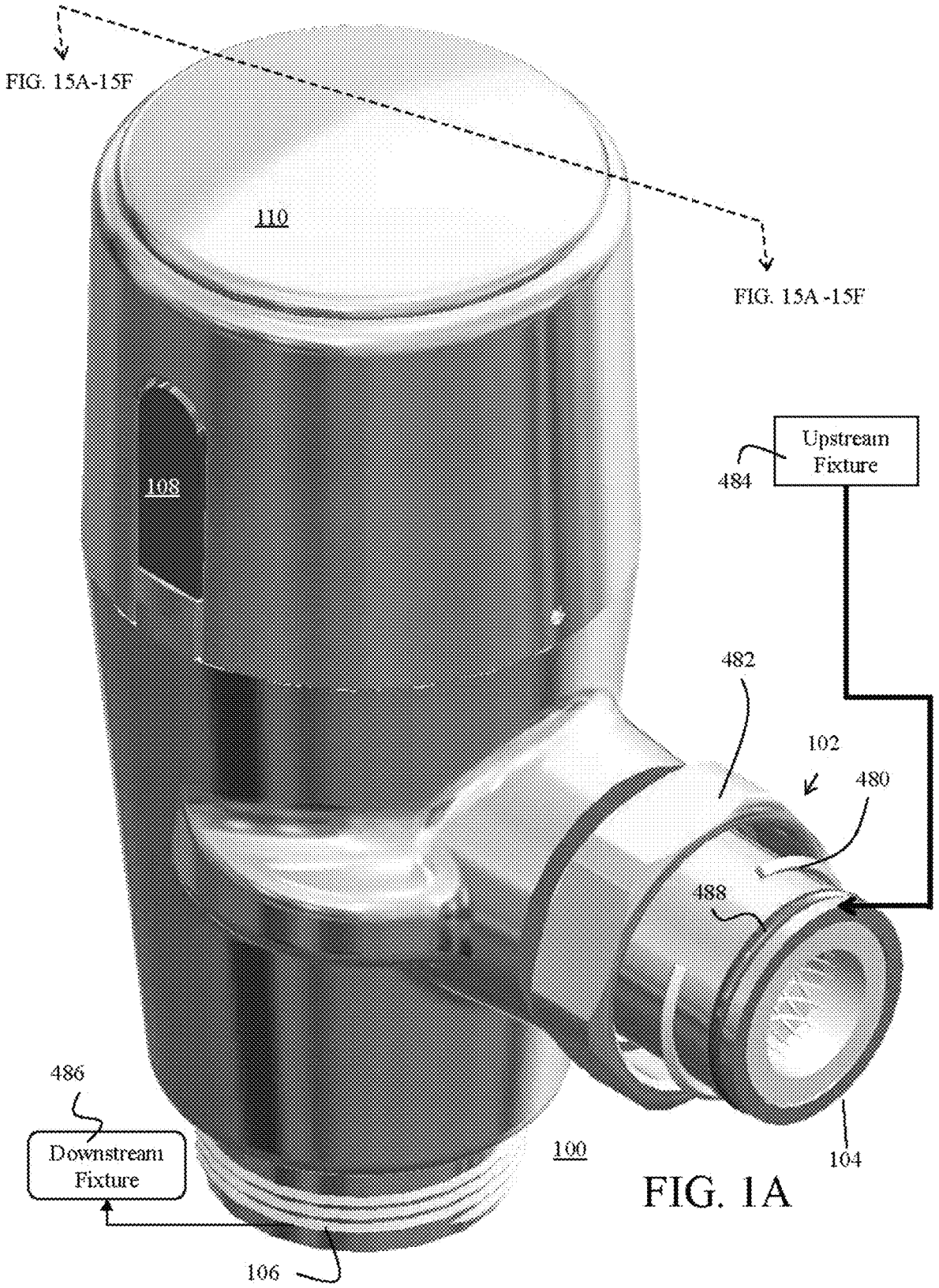
FIGS. 1A to 1C are non-limiting, exemplary illustrations of a fully assembled flush valve assembly in accordance with one or more embodiments of the present invention.
Figure 1B:
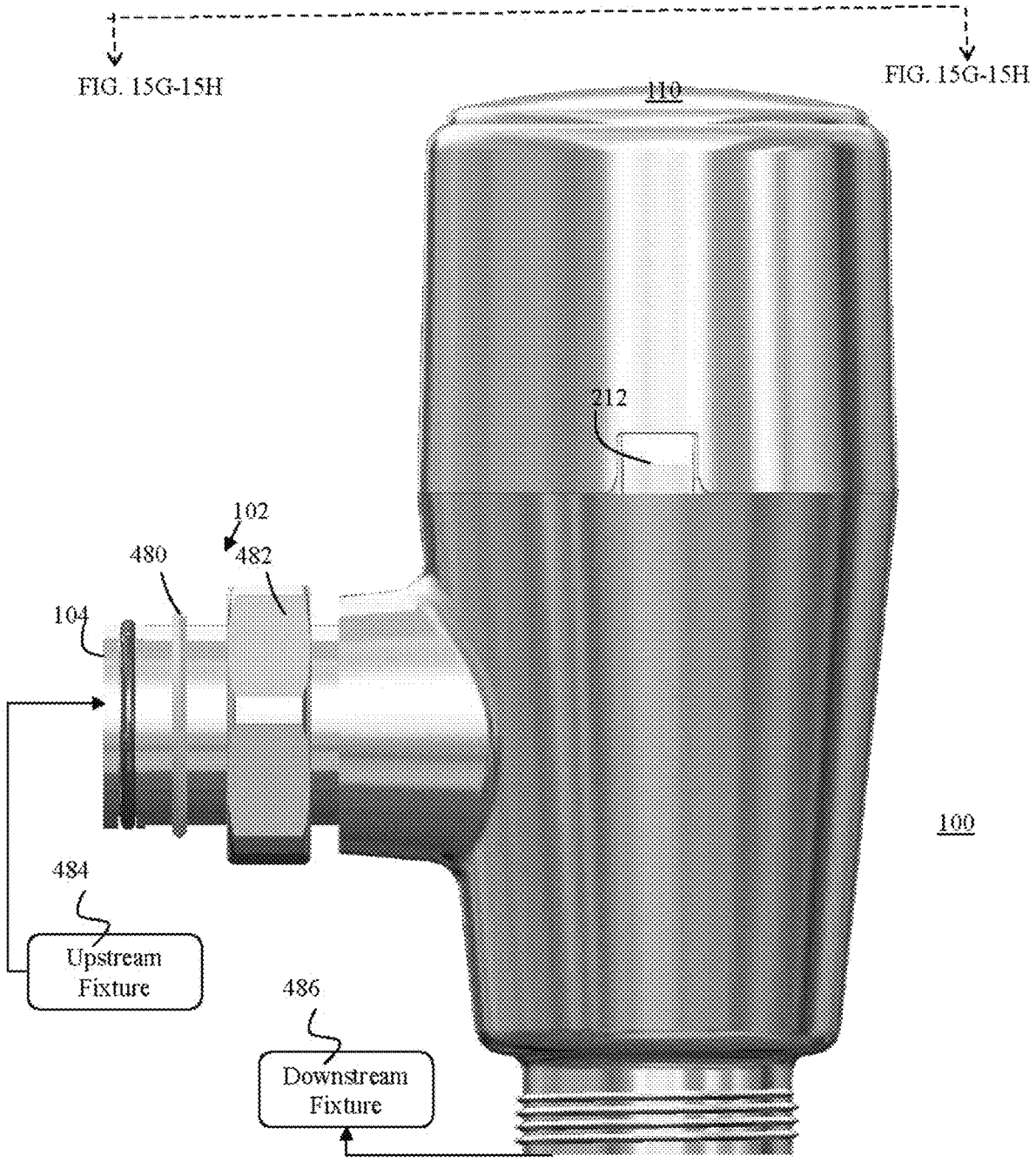
Figure 1C:
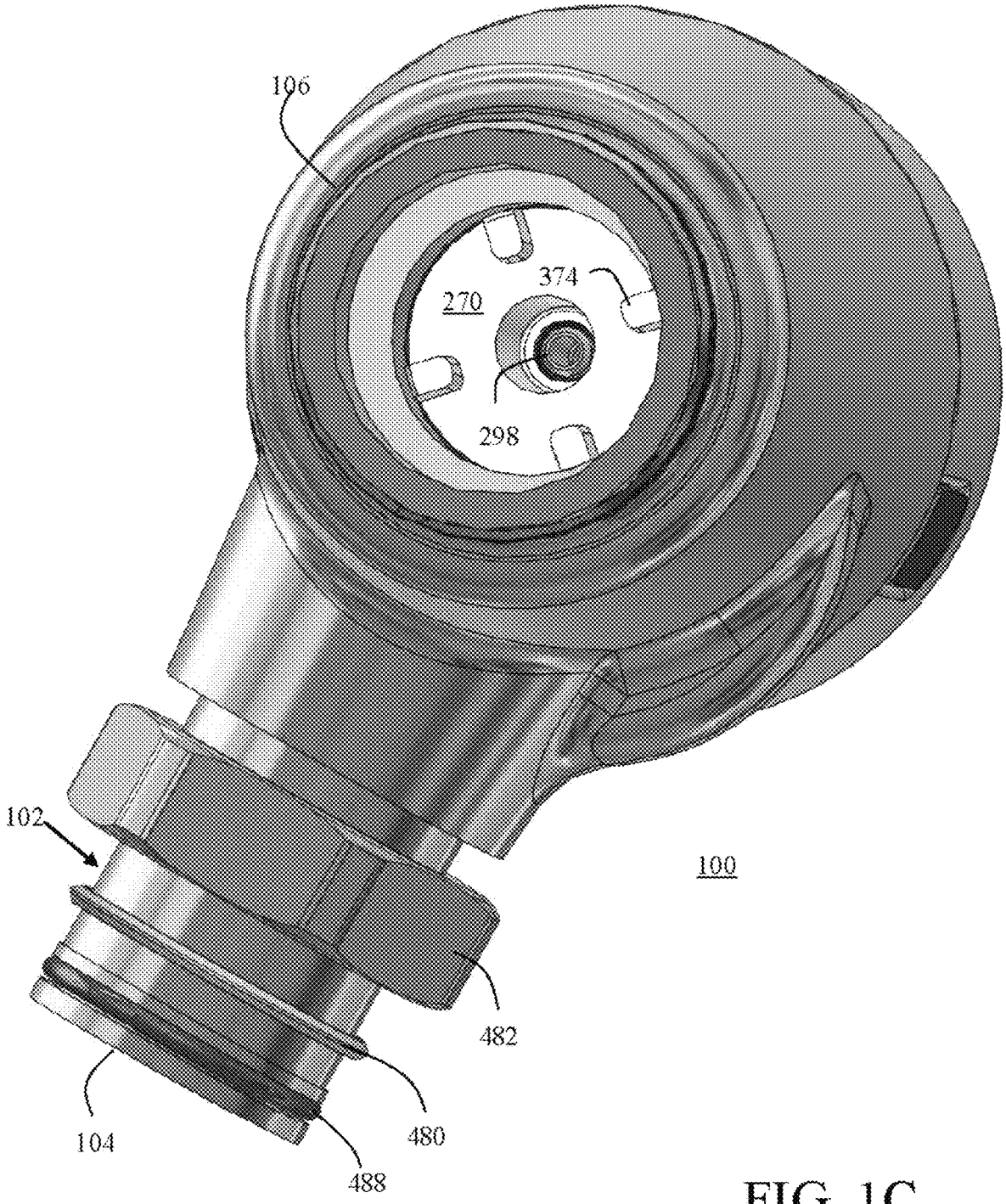

FIGS. 1A to 1C are non-limiting, exemplary illustrations of a fully assembled flush valve assembly in accordance with one or more embodiments of the present invention. As illustrated, the present invention provides a flush valve assembly 100 that is fully compatible with the existing water flow-control systems, in that it includes a novel inlet pipe 102, the illustrated free (or ingress) end 104 of which connects to a standard upstream fixture 484 such as a stop valve (well known—not shown).

Further included are well-known conventional inner threaded nut 482 and lock-ring 480 that as is well known, enable the mating of a piping of an upstream fixture 484 at desired position along an external surface of inlet pipe 102, with an O-ring 488 further preventing potential leakage of water.

Flush valve assembly 100 further includes an outlet 106 through which water is discharged into a well-known downstream fixture 486 such as a toilet or a urinal.

Flush valve assembly 100 may automatically operate by a conventional sensor (generally an Infrared (IR) sensor) 108 and also manually by pressing a primary actuator (or the so-called main flush valve button or manual button) 110. Accordingly, from an end-user perspective, the use of flush valve assembly 100 to commence a flush action by an end-user is similar to most existing, electronic conventional, flush valves.

FIGS. 2A to 2H are non-limiting, exemplary illustrations of the flush valve assembly illustrated in FIGS. 1A to 1C, progressively illustrating a non-limiting, exemplary method of removal and replacement of a flush valve cartridge from a valve housing in accordance with one or more embodiments of the present invention. As illustrated in FIGS. 1A to 2H, flush valve assembly 100 is comprised of a replaceable flush valve module comprised of an independent, self-contained, removable flush valve cartridge 112. In other words, flush valve cartridge 112 includes all of the required electronics, switches, batteries, piston, orifices, etc., including a main valve seat, as a single, self-contained modular unit.

As further illustrated, flush valve assembly 100 further includes a valve housing 114, with the removable flush valve cartridge 112 detachably housed and securely enclosed within valve housing 114. Valve housing 114 is comprised of a rigid casing, having a cover 116 and a main body 118, with the cover 116 capping over a receiver opening 120 of main body 118.

From an end-user perspective, the maintenance of flush valve assembly 100 (for any reason) is very simple and easy with no need or requirement for diagnoses to determine specific component failure, component replacement, plumbing skills, or specialized plumbing tools. As illustrated in FIGS. 2A to 2H, in this non-limiting, exemplary instance, end-users may use an Allen wrench to unscrew lateral fasteners 122 to unfasten cover 116 and lift away from main body 118, and simply rotate and lift away the used flush valve cartridge 112 out of main body 118 to replace it with a new flush valve cartridge 112.

Figure 2A:
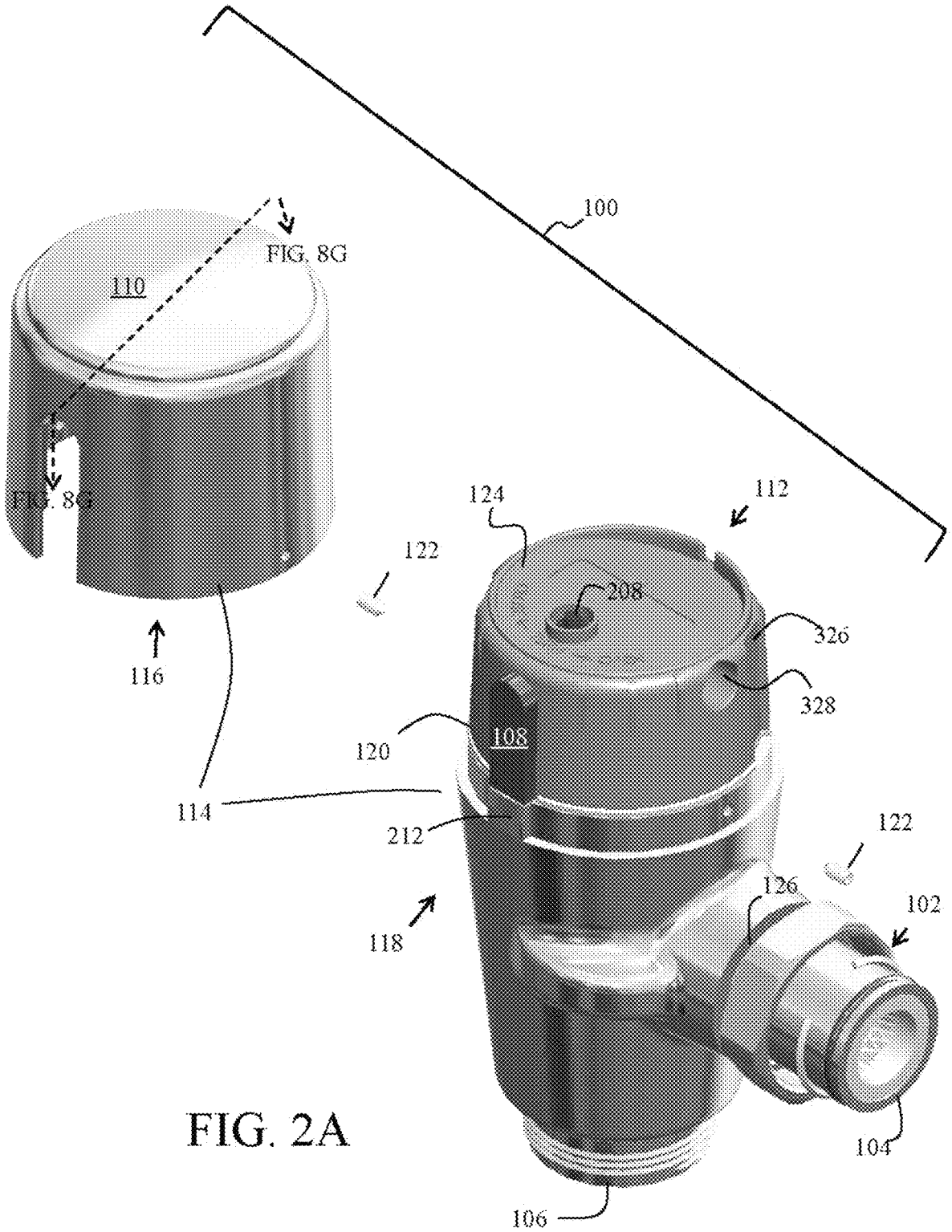
FIGS. 2A to 2H are non-limiting, exemplary illustrations of the flush valve assembly illustrated in FIGS. 1A to 1C, progressively illustrating a non-limiting, exemplary method of removal and replacement of a flush valve cartridge from a valve housing in accordance with one or more embodiments of the present invention.
Figure 2B:
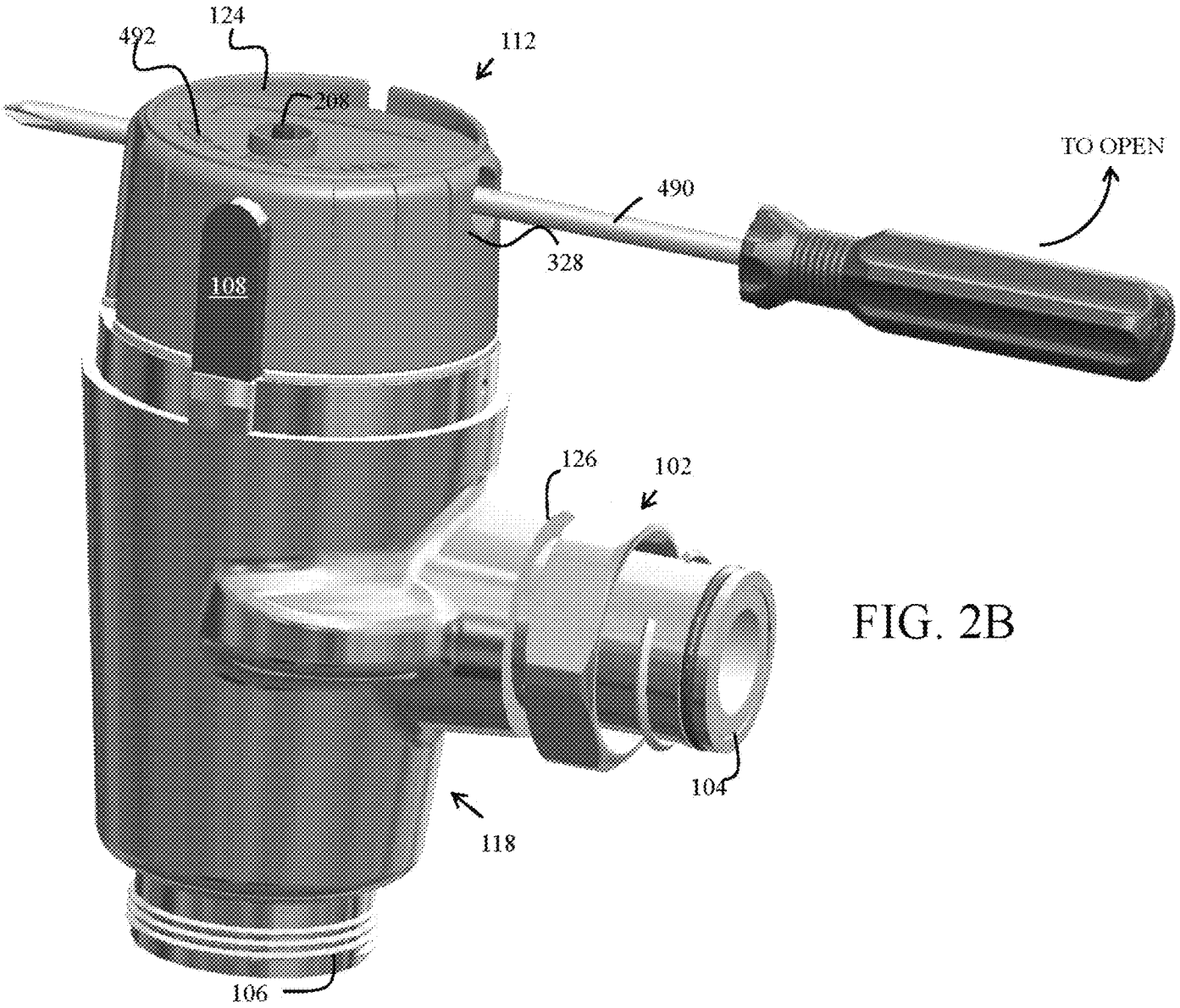

Cartridge cap 124 is provided with a simple instruction 492 (FIG. 2A to 2E) as to which direction to rotate flush valve cartridge 112 to remove and replace. As best shown in FIG. 2B, cartridge cap 124 further includes transversal through-opening (an orifice 328) for optional use and insertion of a bar, a rod, or some tool such as the illustrated screw driver 490, with the tool facilitating added torque in turning cartridge cap 124 for removal. Use of a tool to turn cartridge cap 124 is not necessary. It should be noted that the manner of securing cover 116 onto main body 118 might vary without departing from the scope of the current invention. Accordingly, the use of fasteners 122 should not be limiting.

It is important to note that end-users are not required to have any knowledge of existing upstream fixtures 484 such as a stop valve or any requirement or need to close or shut-off water from main or some upstream fixture 484 prior to replacement of flush valve cartridge 112. As importantly, end-users are not required to open any upstream fixtures 484 to enable flow of water once a used flush valve cartridge 112 is replaced by a new flush valve cartridge 112.

As further detailed below, as the used flush valve cartridge 112 is rotated, water is automatically shut and cannot enter via inlet 126 of main body 118. Additionally, as a new replacement flush valve cartridge 112 is inserted and secured into main body 118, water is automatically enabled to be opened and enters via inlet 126 of main body 118 (as detailed below, opening of gate 130 assumes a dynamic state of operation of flush valve system). Accordingly, truly, the maintenance of flush valve assembly 100 of the present invention is a very simple and easy with no plumbing knowledge, skills, or end-user supplied tools.

As best illustrated in FIGS. 2C to 2F, when rotating a used flush valve cartridge 112 to remove it from main body 118, a closure mechanism 128 is also rotated from an, open position (FIG. 2C) to a closed position (FIG. 2F) where closure mechanism 128 moves maintains a gate 130 at its closed position. As further detailed below, closure mechanism 128 remains at the closed position (FIG. 2F) within main body 118 as the used flush valve cartridge 112 is lifted and removed. In FIGS. 2C to 2F, flush valve system is at a static operational state and hence, the reason gate 130 is shown as closed.

It should be noted that although gate 130 is fully closed and no water enters via inlet pipe 102 due to blocking of closure mechanism 128, initially, prior to lifting and removal of flush valve cartridge 112, the entire flush valve system (main body 118 and the flush valve cartridge 112 therein) is still under equilibrium pressure. That is, upper portion of the system is sealed by a sealing member 260 and lower portion thereof is sealed by sealing member 404. In other words, water pressure inside main body 118 with a fully inserted flush valve cartridge 112 is still at an equilibrium (static state of operation) within the various chambers (detailed below) defined by main body 118 and flush valve cartridge 112 combination.

Further, since the upper portion of the flush valve cartridge 112 has a greater surface area than that of the lower portion thereof, remaining water pressure therein would tend to push flush valve cartridge 112 up and out of main body 118 once flush valve cartridge 112 is fully rotated and reached the end of rotation. However, in general, no water would spill out since as soon, as flush valve cartridge 112 is slightly moved up, main valve seat 384 (with its seal member 404) will be quickly dismounted from valve seat support 286, discharging remaining water quickly via discharge chamber 410 (FIG. 15A) while at the same time, sealing member 260 would continue to prevent water from spewing upward.

Figure 2C:
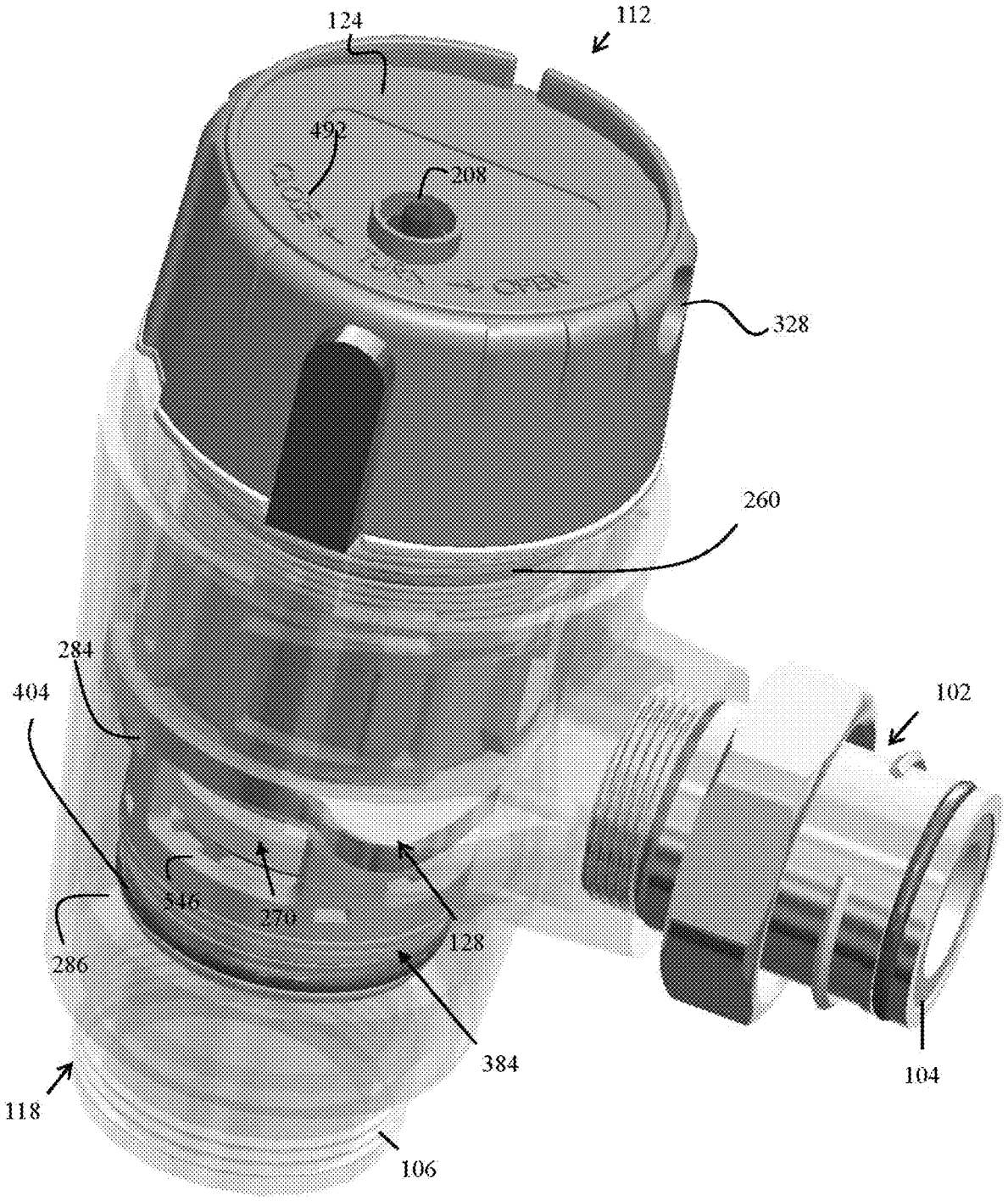
Figure 2D:
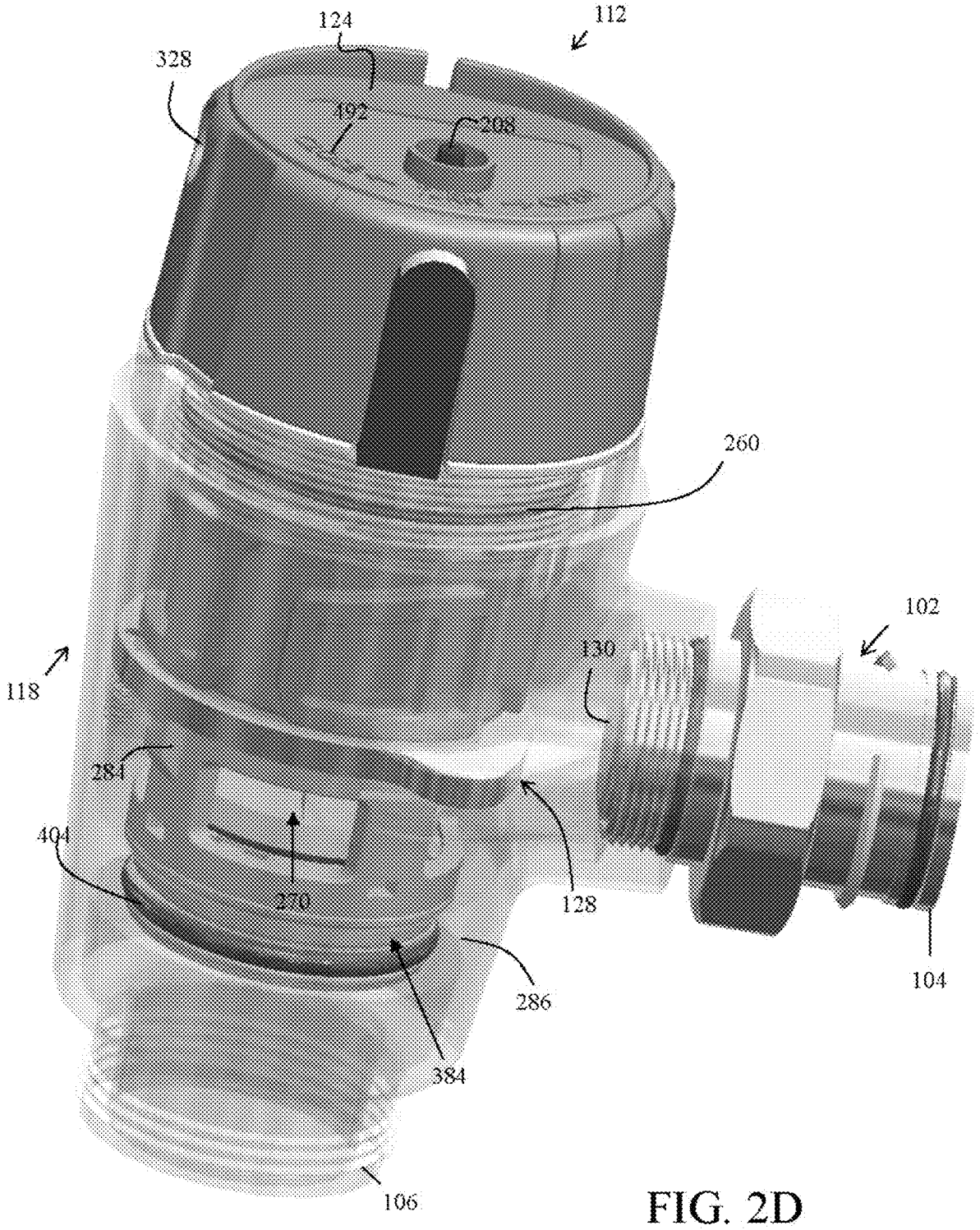
Figure 2E:
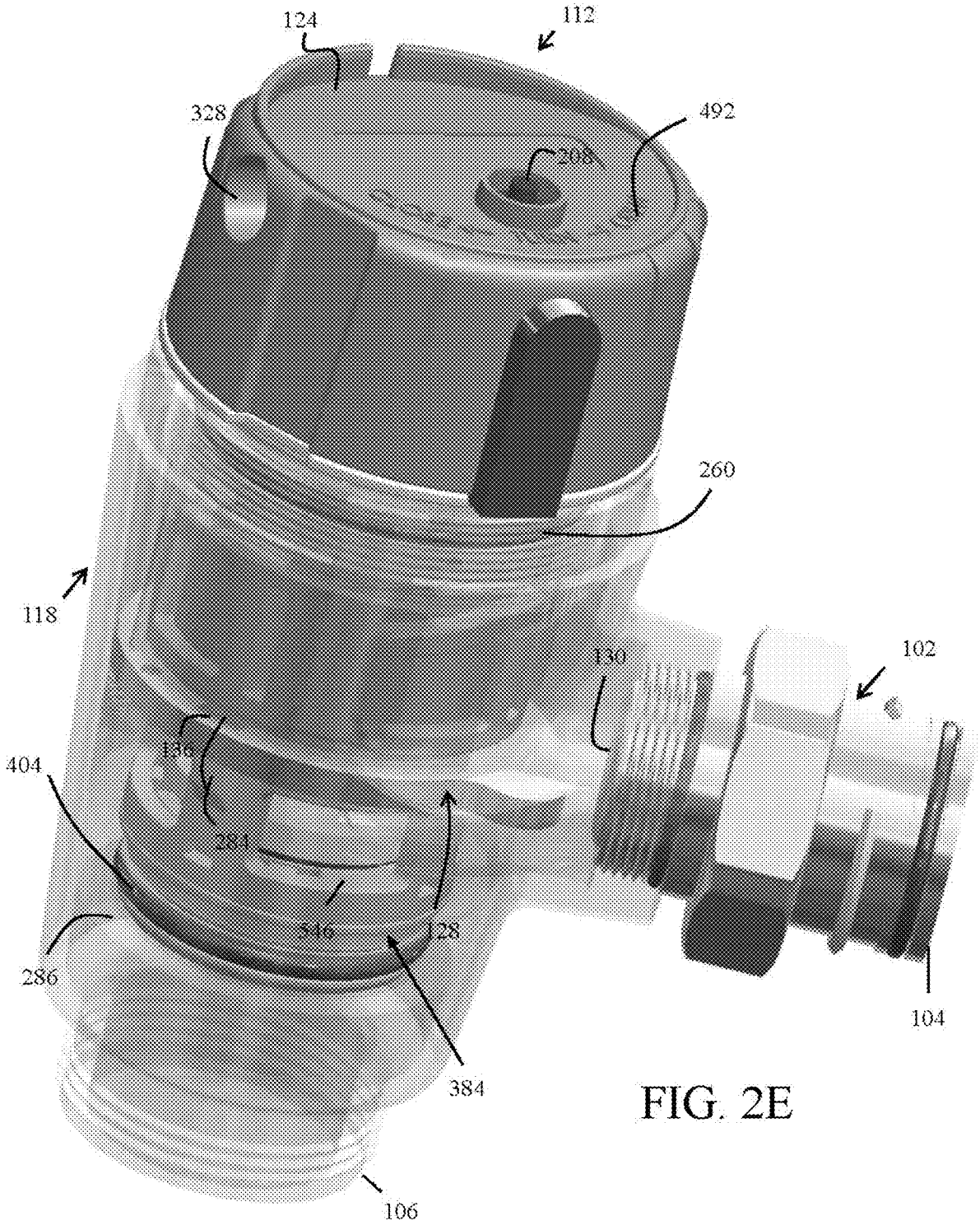

As further detailed below, when a new replacement flush valve cartridge 112 is inserted into main body 118, flush valve cartridge 112 engages closure mechanism 128 to rotate it from its closed position (FIG. 2F) to open position (FIG. 2C). It should be noted that due to the location of interlocking projections 250 (FIGS. 6A-1 to 6B) relative to interlocking guide tracks 252, flush valve cartridge 112 is prevented from premature rotation until interlocking guide tracks 252 are interlocked with interlocking projections 250 thereby preventing flush valve cartridge 112 from being pushed upwards by water pressure building in main body 118 as a result of gate 130 opening.

Gate 130 would remain in the closed position were it not for the upstream water pressure within inlet pipe 102 being greater than pressure within valve body. As further detailed below, gate 130 remains closed via a biasing element 514 when the flush valve system is at a static state.

It should be noted that no upstream fixture 484 is, required to be shut-off when replacing flush valve cartridge 112. Accordingly during insertion of flush valve cartridge 112, as soon as closure mechanism 128 disengages from gate 130 at closed position (FIG. 2F) and moves to open position (FIG. 2C), the greater water pressure within inlet pipe 102 (compared to no water inside main body 118) pushes and opens gate 130 to ultimately restore pressure equilibrium within flush valve assembly 100 for normal use of flush valve assembly 100 with no requirement, knowledge, or skill of any plumbing.

Figure 3:
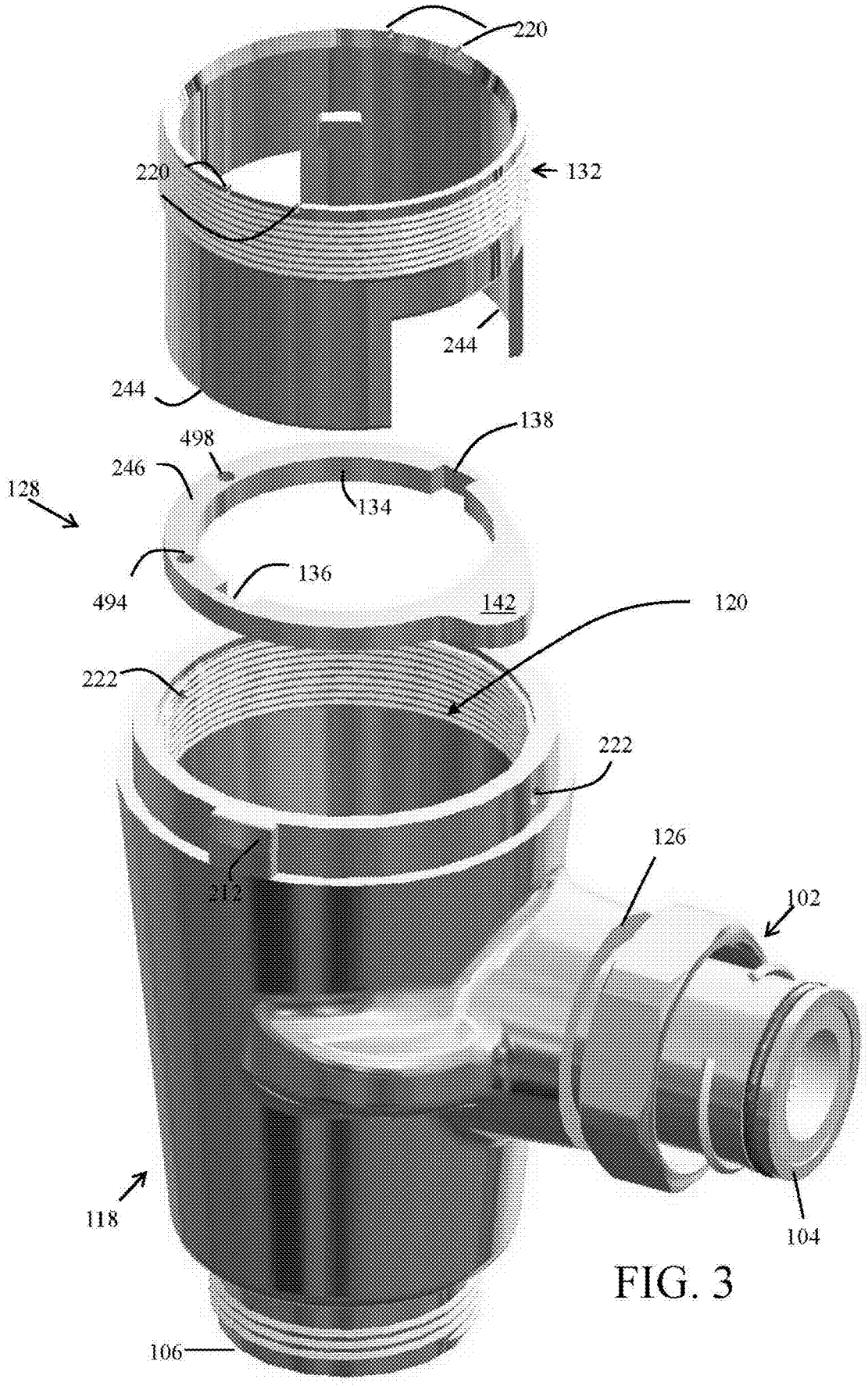
FIG. 3 is a non-limiting exemplary exploded view illustration of the various components housed within the main body (with flush valve cartridge removed) in accordance with one or more embodiments of the present invention.

FIG. 3 is a non-limiting exemplary exploded view illustration of the various components housed within the main body (with flush valve cartridge 112 removed) in accordance with one or more embodiments of the present invention. The exploded view shown in FIG. 3 illustrates disassembled, separated components that show the cooperative working relationship, orientation, positioning, and exemplary manner of assembly of the various components of main body 118 in accordance with one or more embodiments of the present invention, with each component detailed below in relation to FIGS. 4A to 6B.

As illustrated in FIG. 3, main body 118 simply houses a retainer-adapter 132 (detailed below) and closure mechanism 128 also detailed below (in addition to the removable flush valve cartridge 112). Accordingly, and as further detailed below, main body 118 does not require complex machining to provide orifices or openings for proper operation of flush valve assembly 100.

FIGS. 4A to 4F are non-limiting, exemplary illustrations of a closure mechanism shown in FIGS. 1A to 3 in accordance with one or more embodiments of the present invention. As illustrated in FIG. 4A to 4F, in, addition to residing within main body 118 (FIGS. 4A and 4B), closure mechanism 128 also engages (interlocks with) flush valve cartridge 112 (FIGS. 2C to 2F) when flush valve cartridge 112 is fully installed within main body 118.

Closure mechanism 128 is to maintain and close shut gate 130 prior to extraction and removal of flush valve cartridge 112 to block and prevent water flow from upstream fixture 484 and therefore, various types of closure mechanisms may be used. In the non-limiting, exemplary instance, closure mechanism 128 is comprise of a generally annular disc that includes an inner circumference 134 having first and second notches 136 and 138 recessed into the generally annular disc positioned at opposite one another.

Notches 138 and 136 receive projections 284 of flush valve cartridge (FIGS. 2D to 2K and 2H), which enables flush valve cartridge 112 to move (or rotate) closure mechanism 128 from one of closed to open or open to closed positions as flush valve cartridge 112 is rotated during insertion or removal. The positions of notches 136 and 138 function, to provide a proper indexing feature to enable proper seating of flush valve cartridge 112 in its final position where sensor 108 is properly aligned with indexing flanges 212 of main body 118.

Figure 2F:
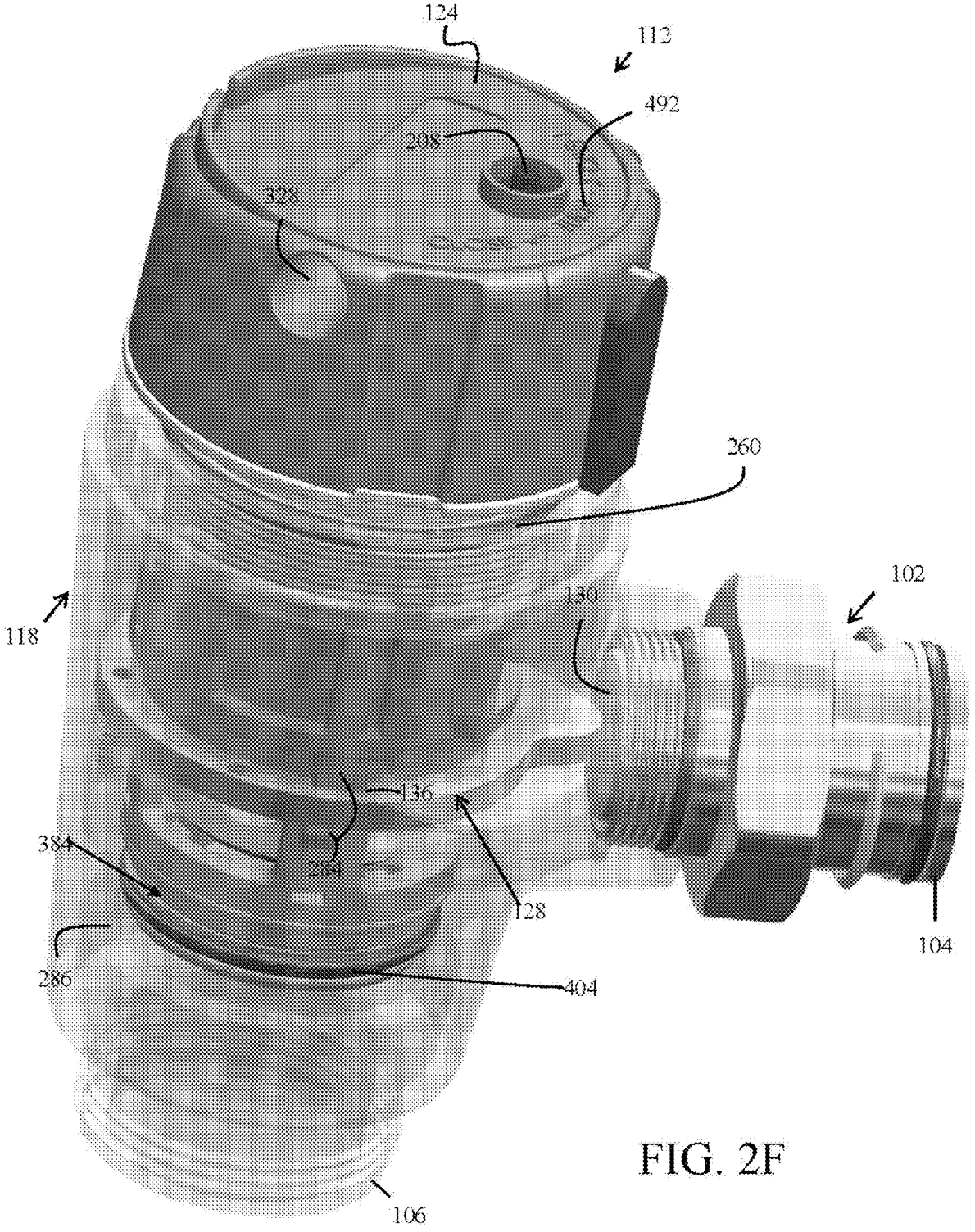

The generally annular disc further comprises an outer perimeter 140 having an engagement projection 142 extending from an outer perimeter surface of the generally annular disc. As best illustrated, in FIG. 4C-3, engagement projection 142 operates as a cam to engage and close shut gate 130 when closure mechanism 128 is in the closed position (FIGS. 2F and 4C-3). That is, engagement projection 142 engages gate 130, maintaining gate 130 at the biased closed position (detailed below) to thereby ultimately maintain closed inlet opening 126.

Engagement portion 142 of closure mechanism 128 disengages gate 130 when the removable flush valve cartridge 112 is fully inserted into valve housing, with upstream water pressure pushing gate 130 from closed to open position. Closure mechanism 128 further includes a first relief-opening 494 for engagement with a latch mechanism 496 (FIGS. 4C-1) that facilitates in maintaining closure mechanism 128 at an open position. Closure mechanism 128 further includes a second relief-opening 498 for engagement with latch mechanism 496 to maintain closure mechanism 128 at a closed position.

Latch mechanism 496 provides an audible "click" sound and "snap" "feel" that gate 130 is shut or that flush valve cartridge 112 may now be further properly rotated out of flush valve body (FIG. 4C-3). Latch mechanism 496 also provides an audible "click" sound and "snap" "feel" that gate 130 is free to open and that flush valve cartridge 112 is properly rotated to its final resting position within main body 118 (FIGS. 4C-1 and 4C-2). It should be noted that first relief-opening 494 provides the added advantage of allowing biasing mechanism 504 to remain near its default, extend biased position. This increases the overall life of biasing mechanism 504.

Latch mechanism 496 also ensures that closure mechanism 128 remains at a closed position. For example, once flush valve cartridge 112 is removed, a plumber may wish to clean the interior of main body 118 prior to inserting a new replacement flush valve cartridge 112. Latch mechanism 496 ensures that closure mechanism 128 stays closed during cleaning and that it would not open accidentally.

Figure 4A:
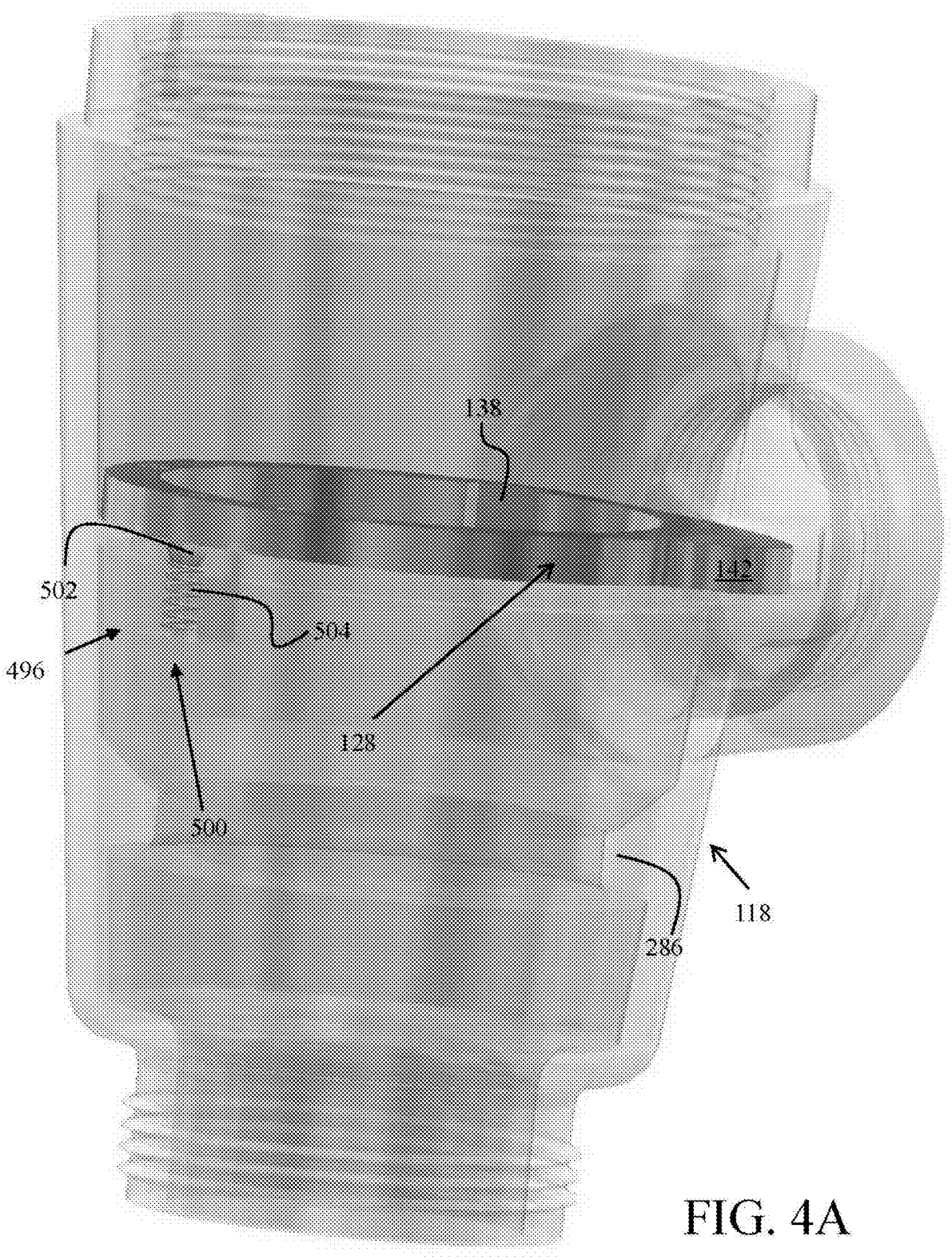
FIGS. 4A to 4F are non-limiting, exemplary illustrations of a closure mechanism shown in FIGS. 1A to 3 in accordance with one or more embodiments of the present invention.
Figure 4B:
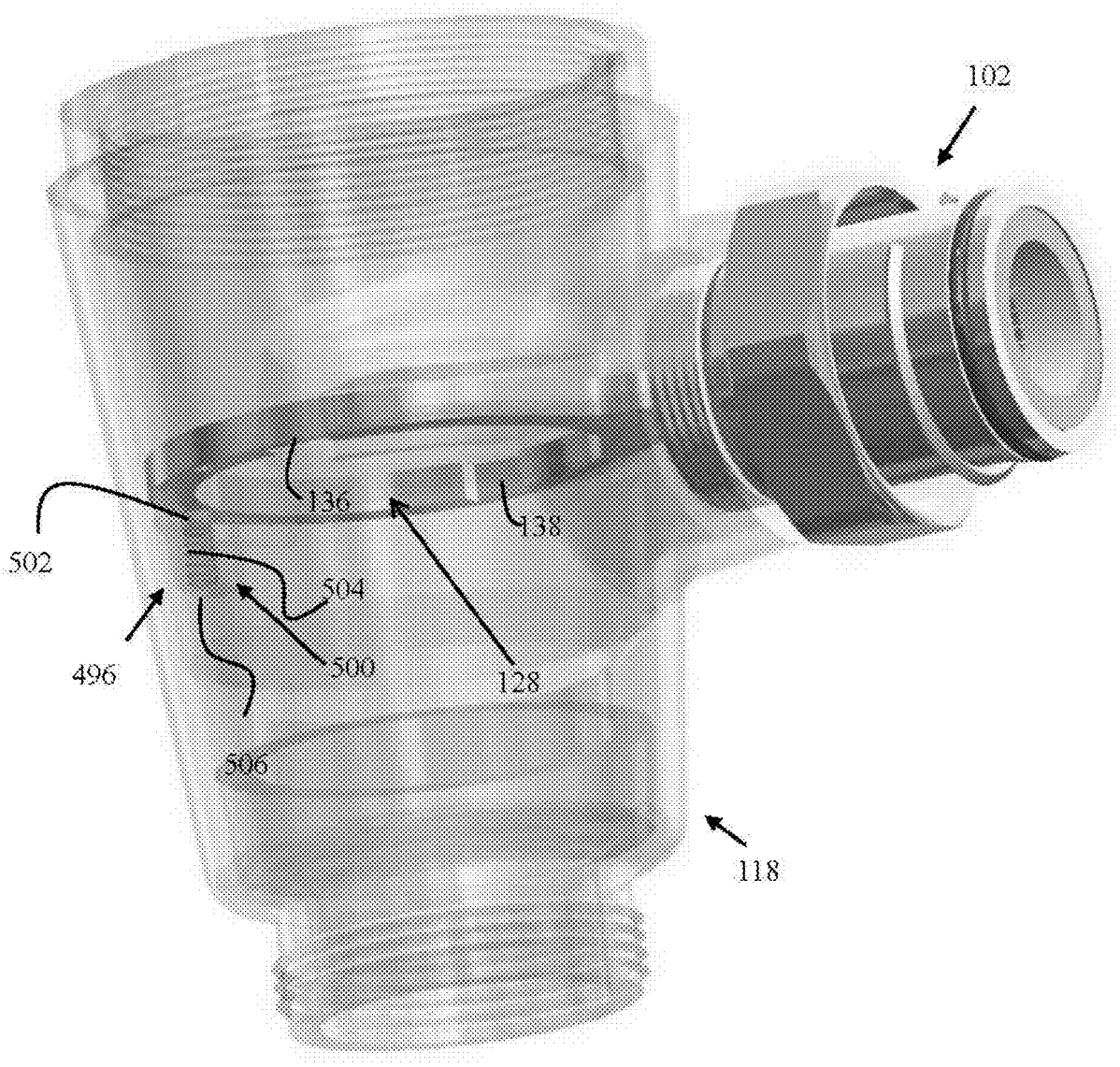
Figures 1, 4C:
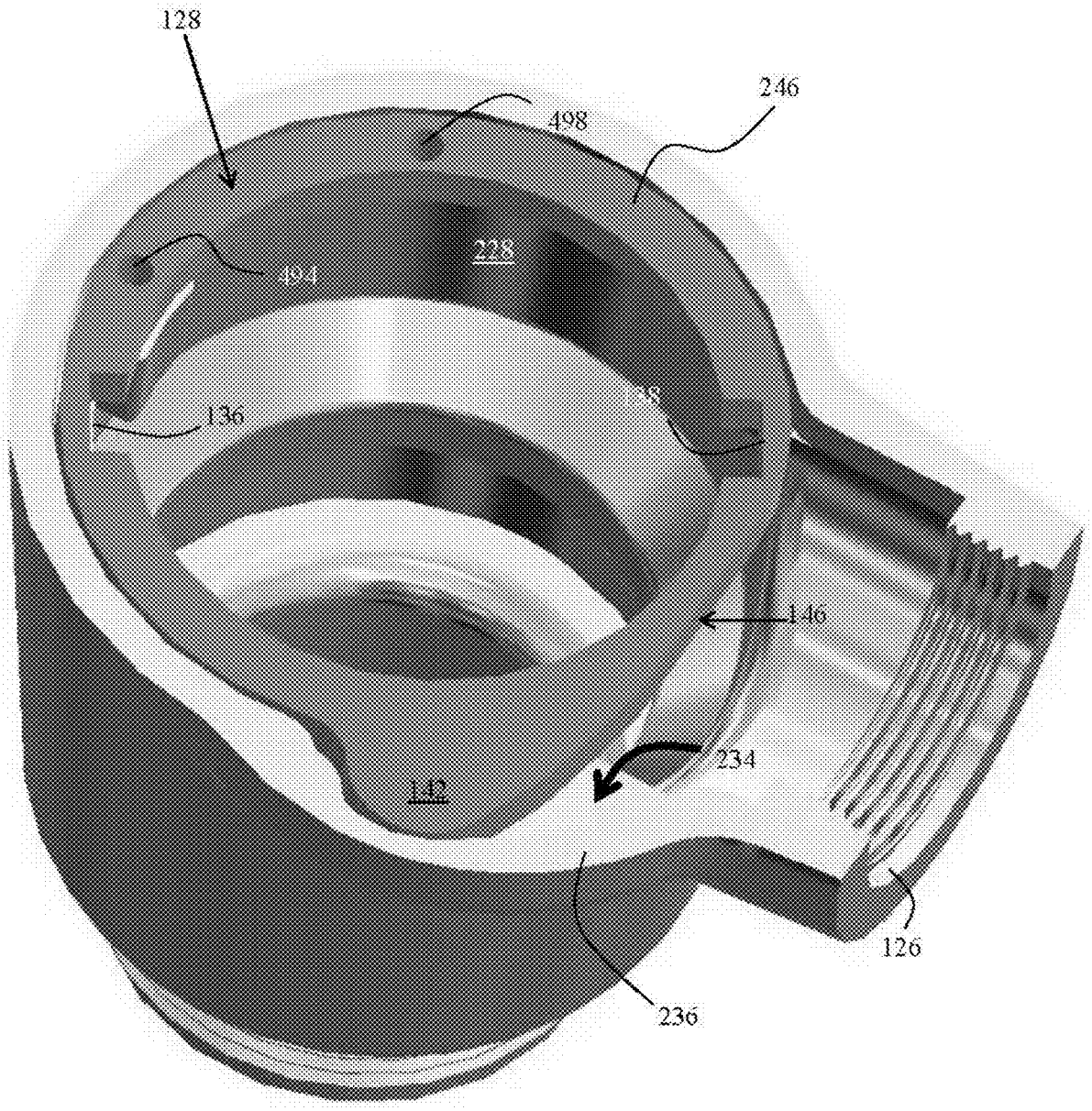
FIGS. 6A-1 to 6B are non-limiting, exemplary illustrations of a retainer-adapter of flush valve assembly illustrated in FIGS. 1A to 5H in accordance with one or more embodiments of the present invention.
Figures 2, 4C:
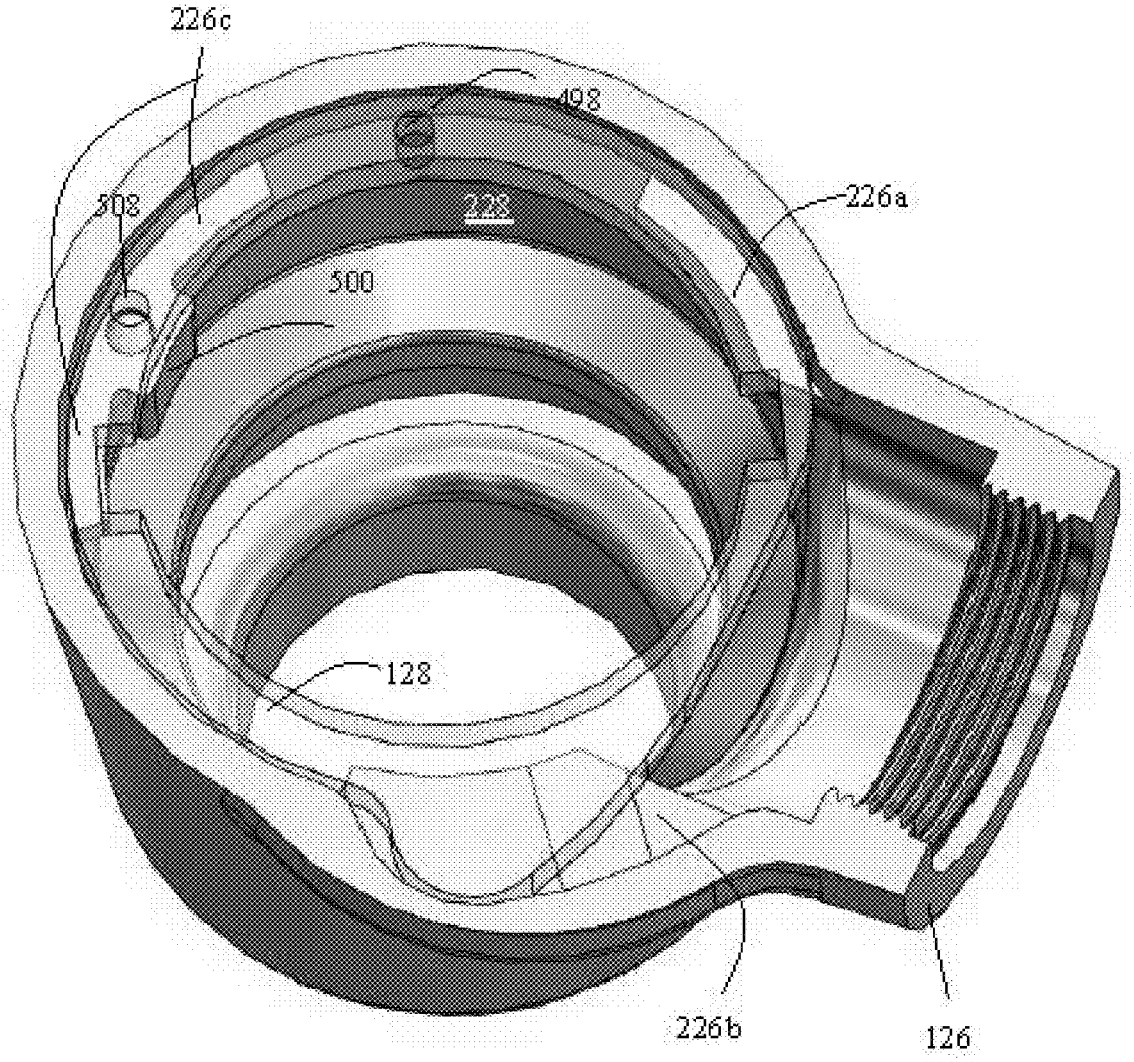
Figures 3, 4C:
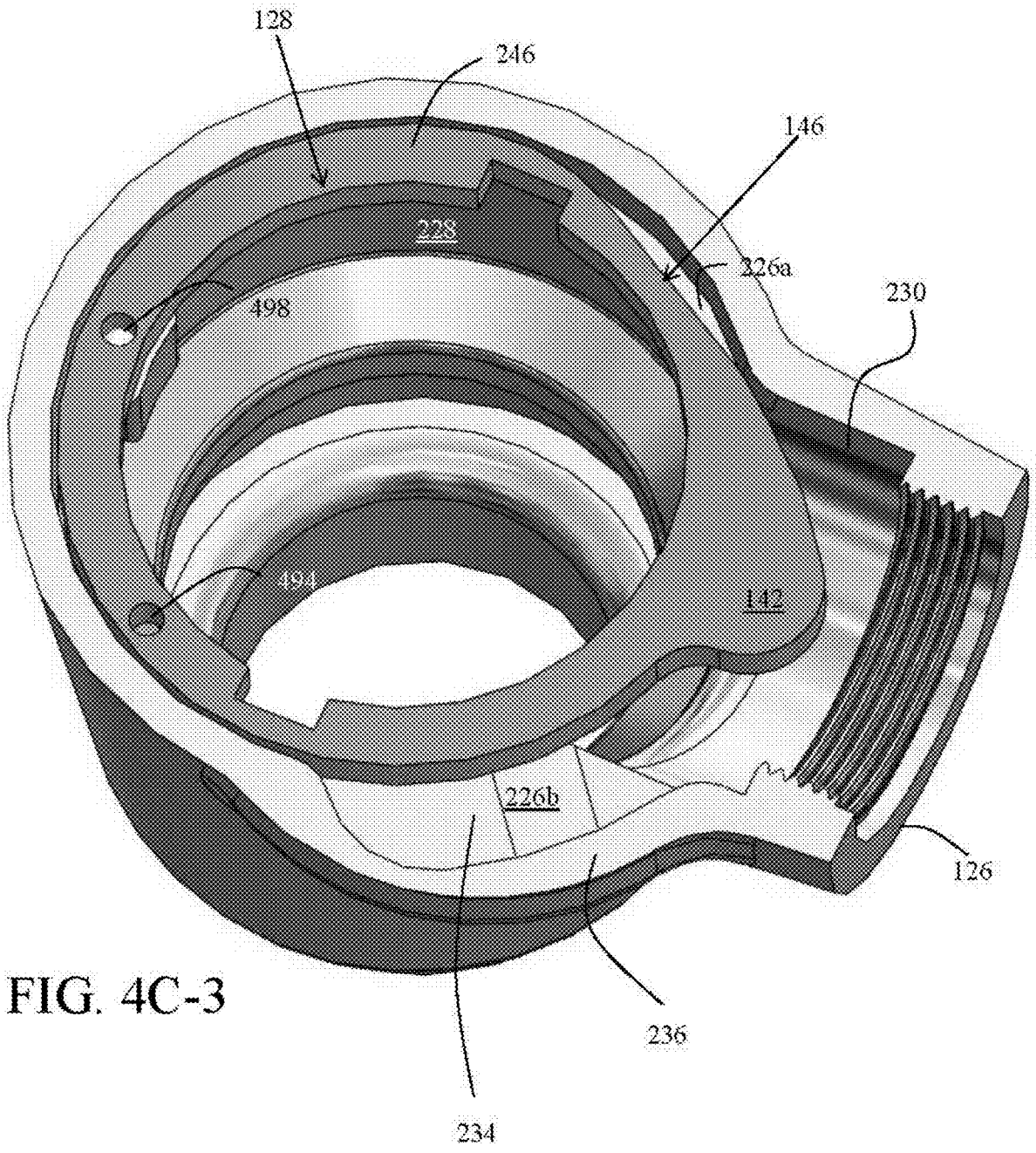
Figure 4D:
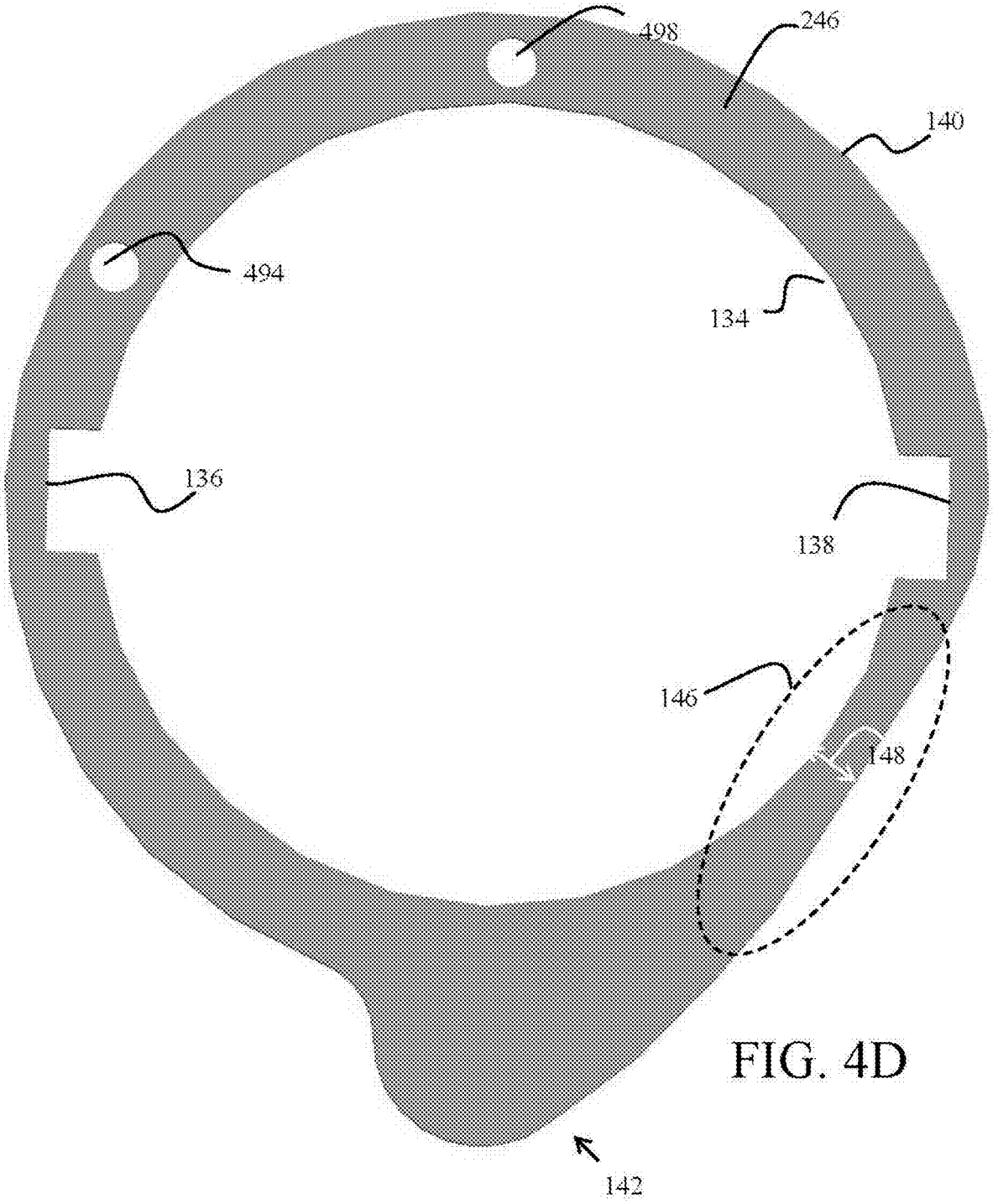
Figure 4E:
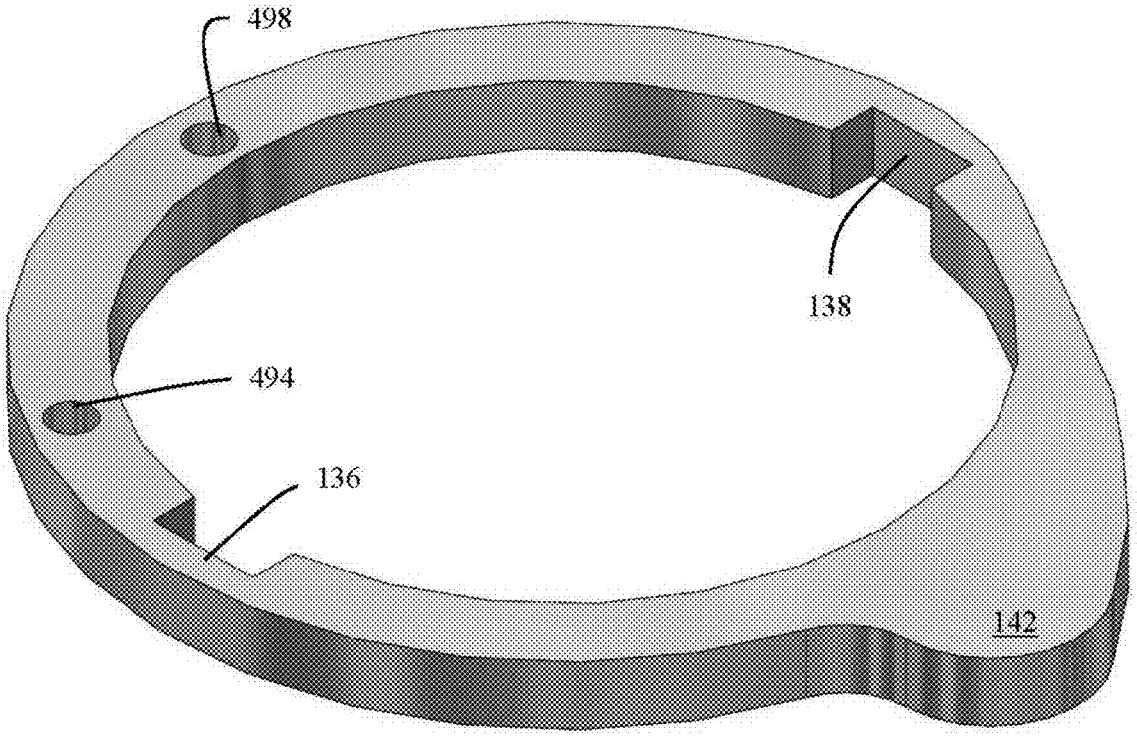
Figure 4F:
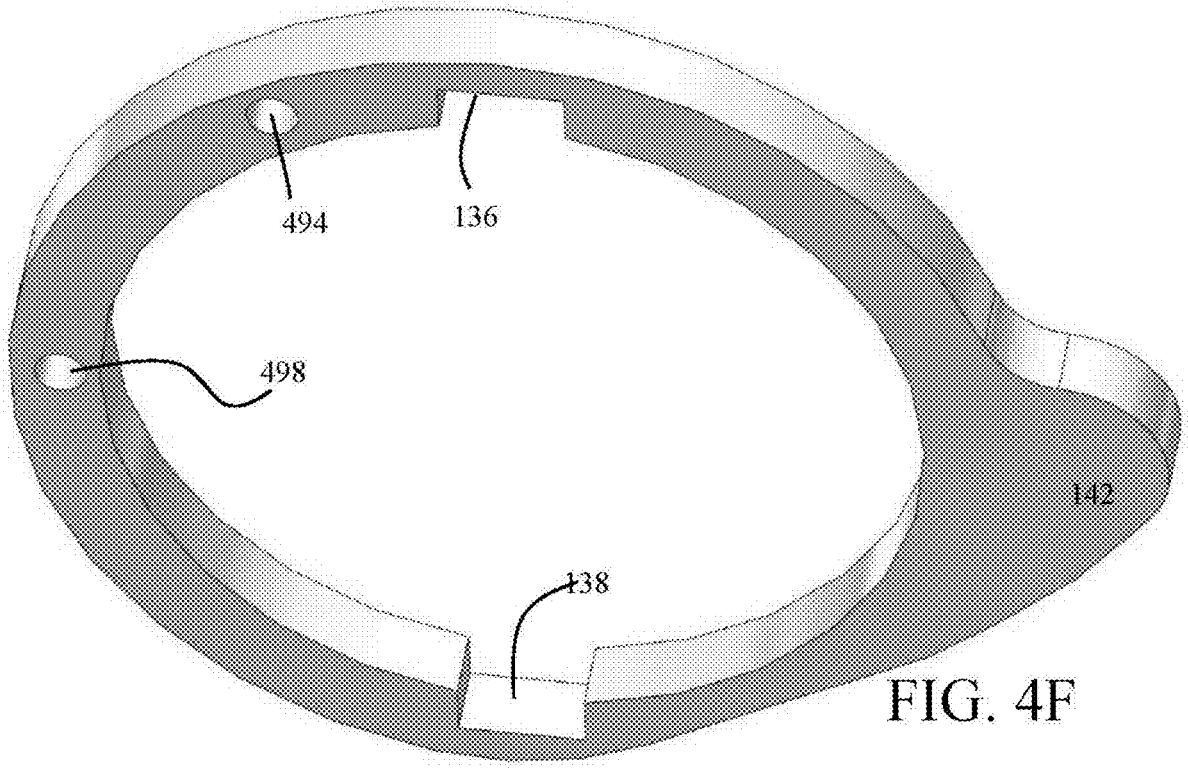
Figure 5A:
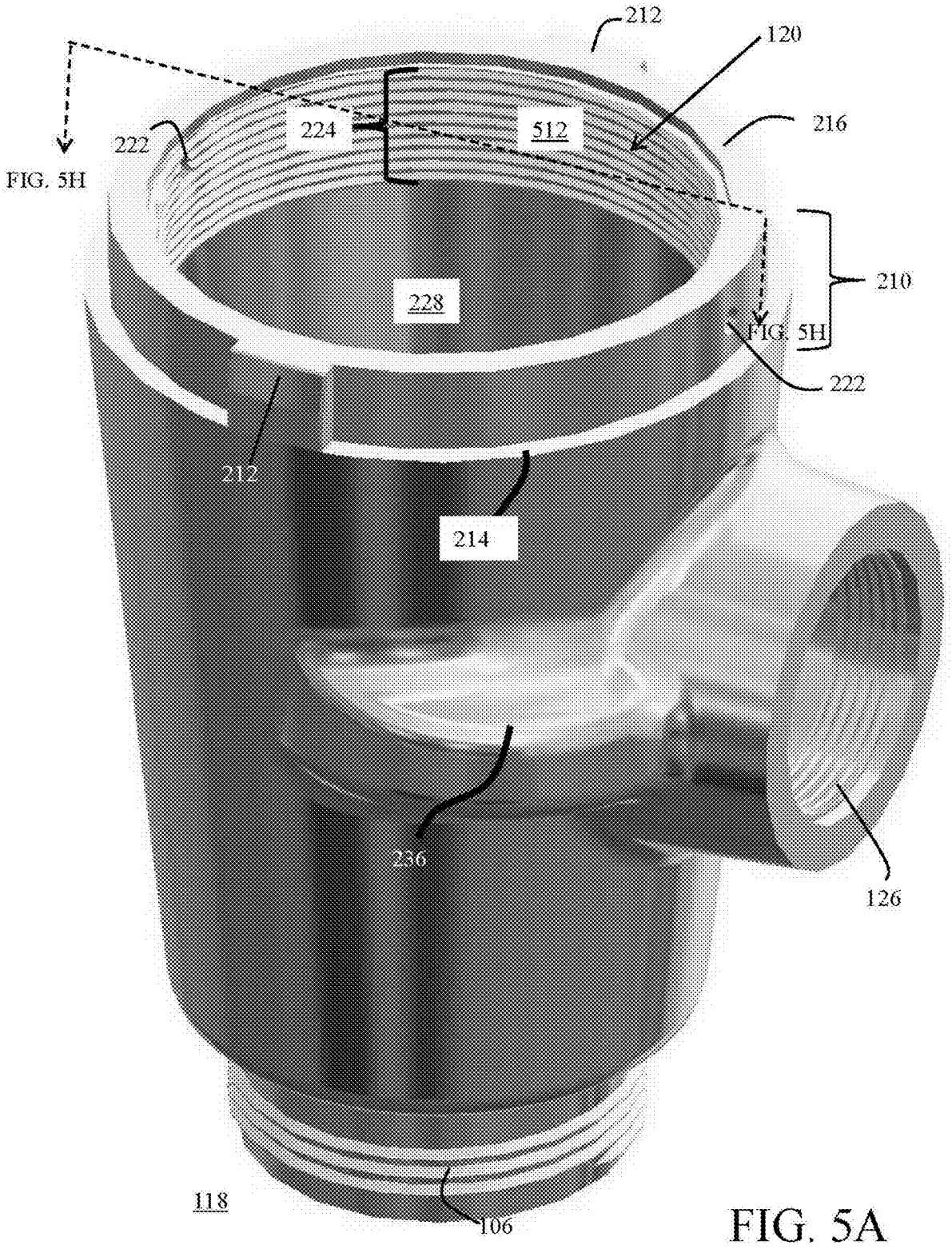
FIGS. 5A to 5H are non-limiting, exemplary illustrations of main body of valve housing of flush valve assembly illustrated in FIGS. 1A to 4F in accordance with one or more embodiments of the present invention.
Figure 5B:
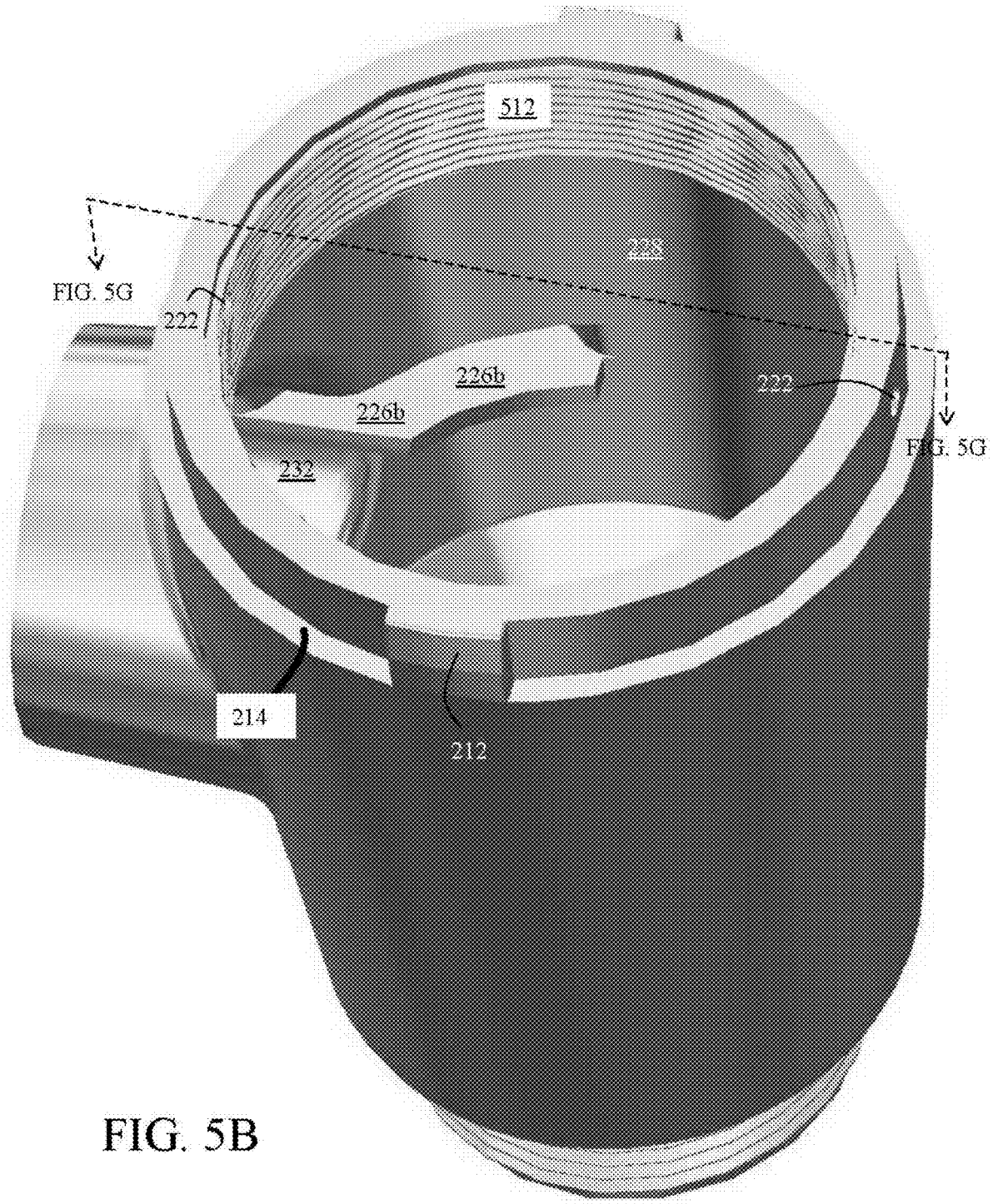
Figure 5C:
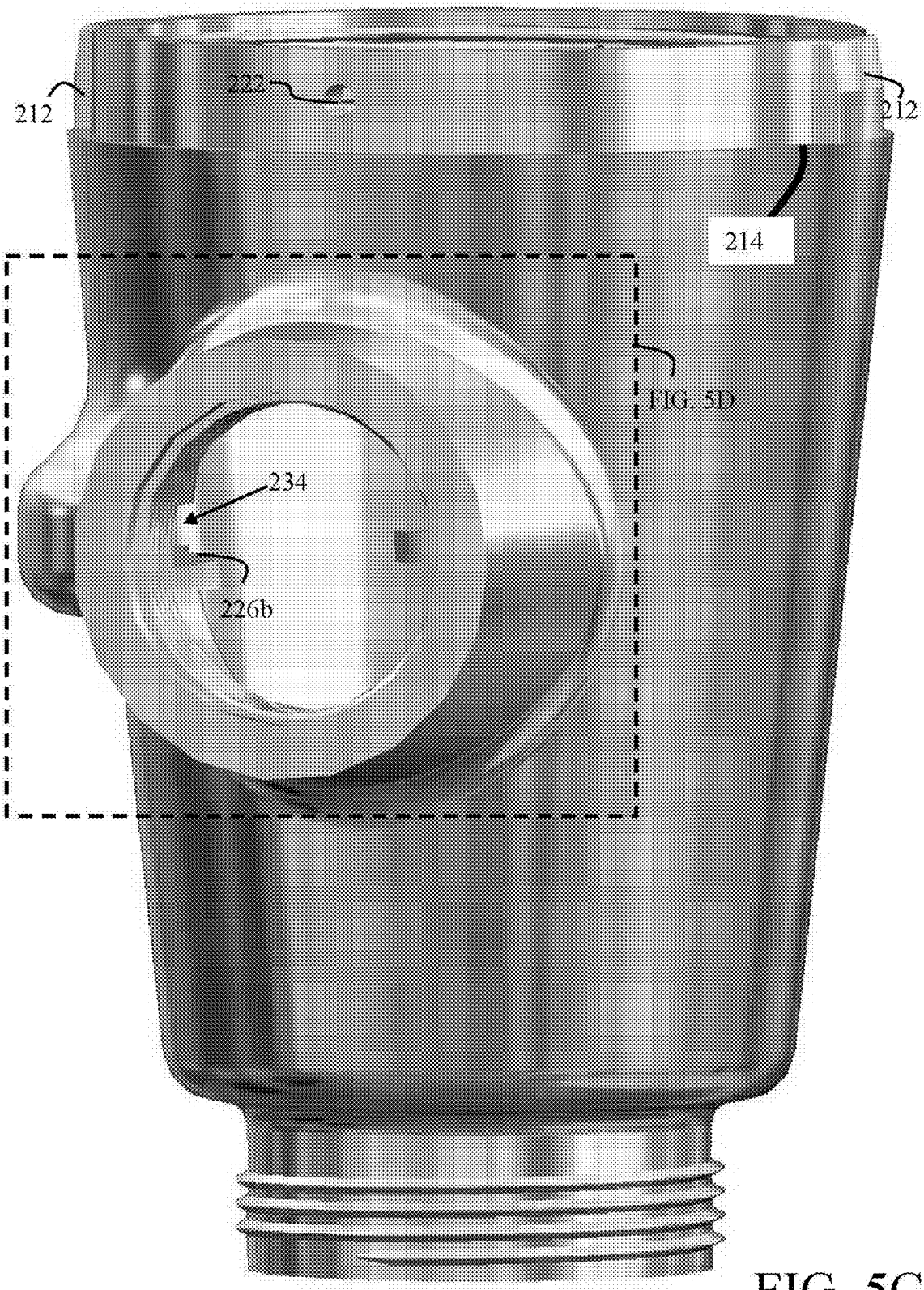
Figure 5D:
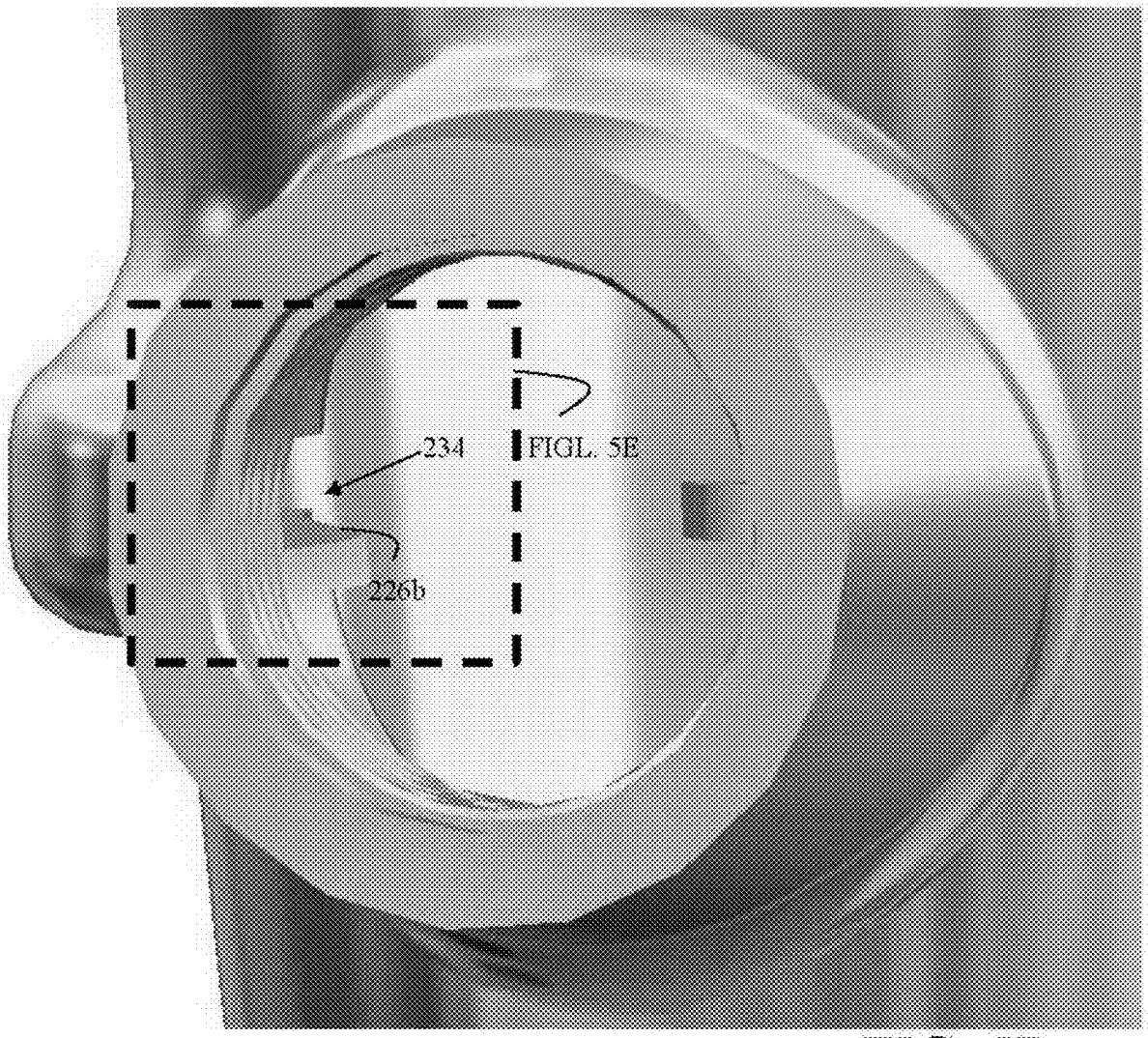
Figure 5E:
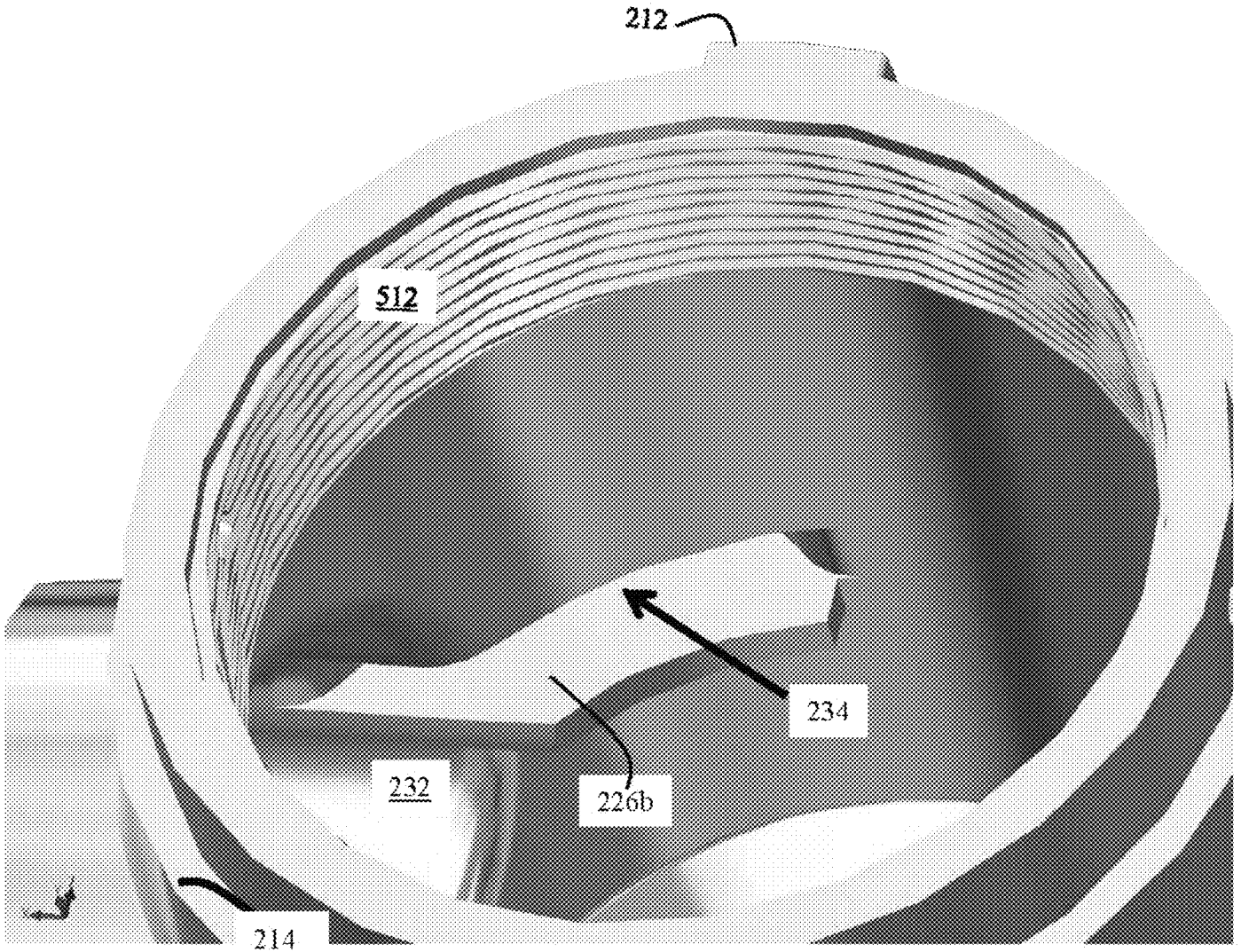
Figure 5F:
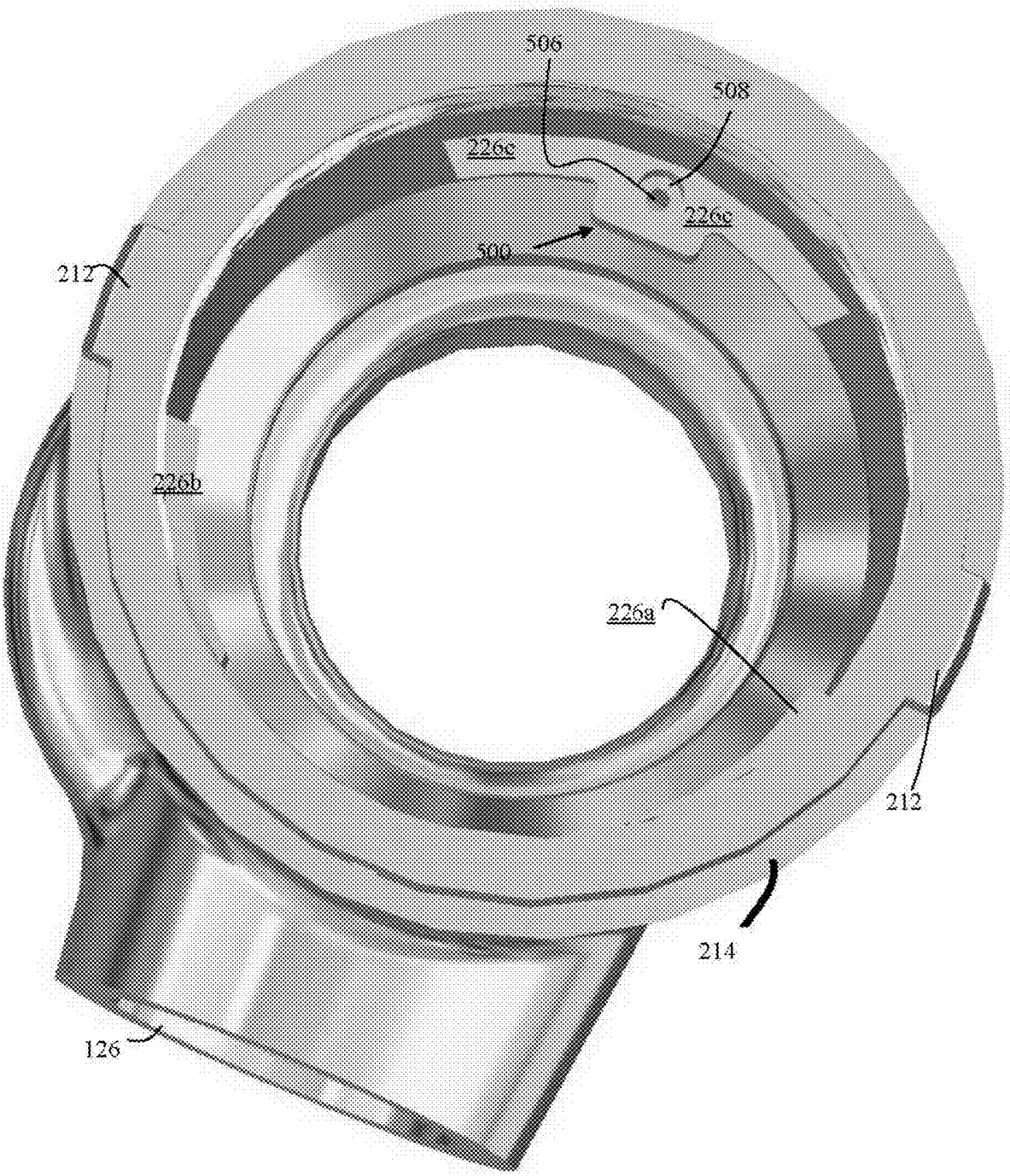
Figure 5G:
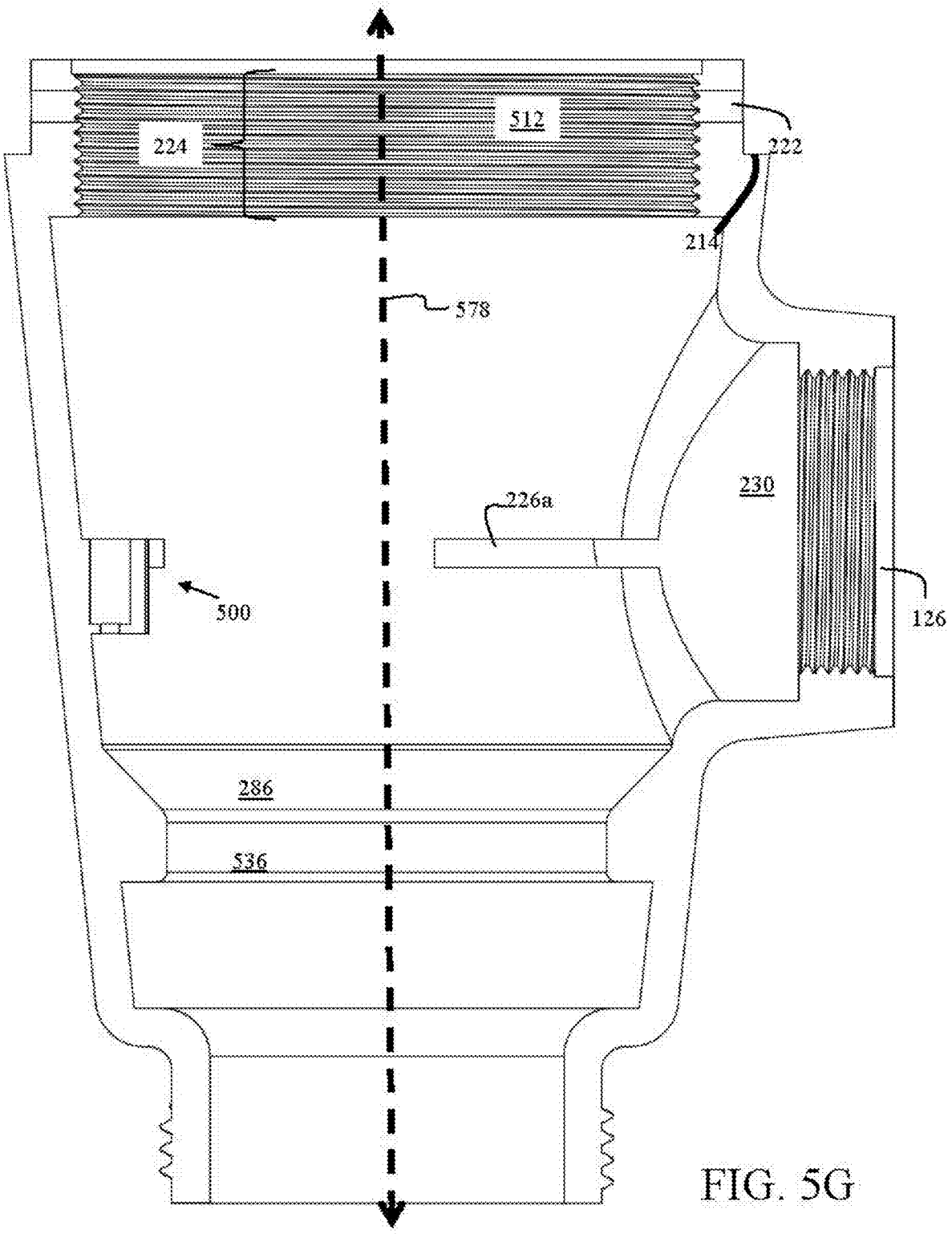
Figure 5H:
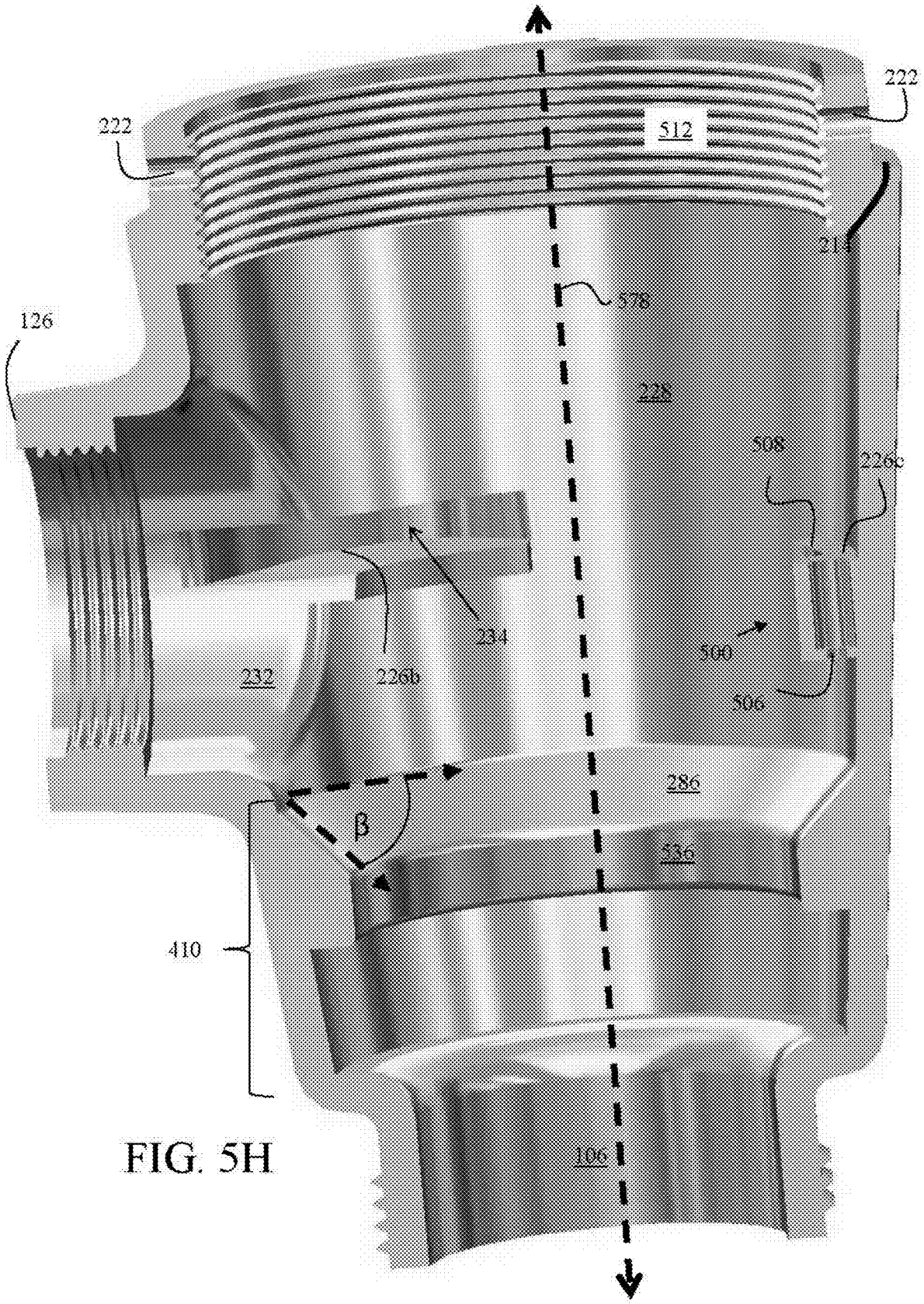

As best illustrated in FIGS. 4A and 4B, latch mechanism 496 is housed within a latch housing 500 that is an integral part of main body 118. Latch housing 500 includes a drainage opening 506 at its bottom for drainage of water, and a latching opening 508 (FIGS. 4C-2, 4F, 5H) at top, from which a latch member 502 partially extends out. Drainage opening 506 has a smaller inner diameter than the inner diameter of latching opening 508, similar to a funnel.

Latch mechanism 496 is comprised of latch member 502 in a form of a ball that is biased (pushed) into engagement with first and second relief-openings 494 and 498 by biasing mechanism 504, which is a resilient member in a form of a non-limiting exemplary spring. Sufficient rotational force must be applied to rotate flush valve cartridge 112 out of its latched-closed or latched-open position. That is, the force applied to rotate flush valve cartridge 112 to remove it or to replaced it must be greater than the force of biasing mechanism 504 that latched-opened or latched-closed closure mechanism 128.

When inserting a new flush valve cartridge 112, projections 284 engage with recesses 136 and 138 of closure mechanism 128. In other words, while being lowered, set of engagement sections 284 of flush valve cartridge 112 interlock with first and second notches 136 and 138 of closure mechanism 128 (similar to a key-lock combination).

It should be noted that engagement sections 284 are slanted (or beveled) and hence, function as chamfered surface to facilitate ease of insertion of flush valve cartridge 112 into main body 118 and engagement with recesses 136 and 138.

A narrow portion 146 of the generally annular disc, near engagement portion 142 has a smaller expanse 148 than a remaining portion of the generally annular disc. The narrow portion 146 provides sufficient space for gate 130 to move to a fully open position. In other words, narrow portion 146 provides sufficient space, for gate 130 to fully open. This way, gate 130 extends into main body 118 in open position during dynamic state of operation of flush valve system. The specific position of closure mechanism 128 in relation to interior of main body 118 is detailed below in relation to description of main body 118.

FIGS. 5A to 5H are non-limiting, exemplary illustrations of main body of valve housing of flush valve assembly illustrated in FIGS. 1A to 4F in accordance with one or more embodiments of the present invention. As illustrated, main body 118 is a generally cylindrically configured piece with no complex machining inner parts. Main body 118 includes a receiver opening 120 for receiving flush valve cartridge 112, an inlet 126 (with a threaded inner diameter), and an outlet 106 with a threaded outer diameter.

An upper outer surface 210 of main body 118, near receiver opening 120 includes a set of indexing extensions 212 that indicate the final, proper resting position of flush valve cartridge 112 inside main body 118. It should be noted that indexing extensions 212 enable flush valve cartridge 112 to rest and be secured within main body 118 in one of two, opposite positions. This way, the main upstream connections via inlet pipe 102) may be a left side or a right side installation.

Figure 8A:
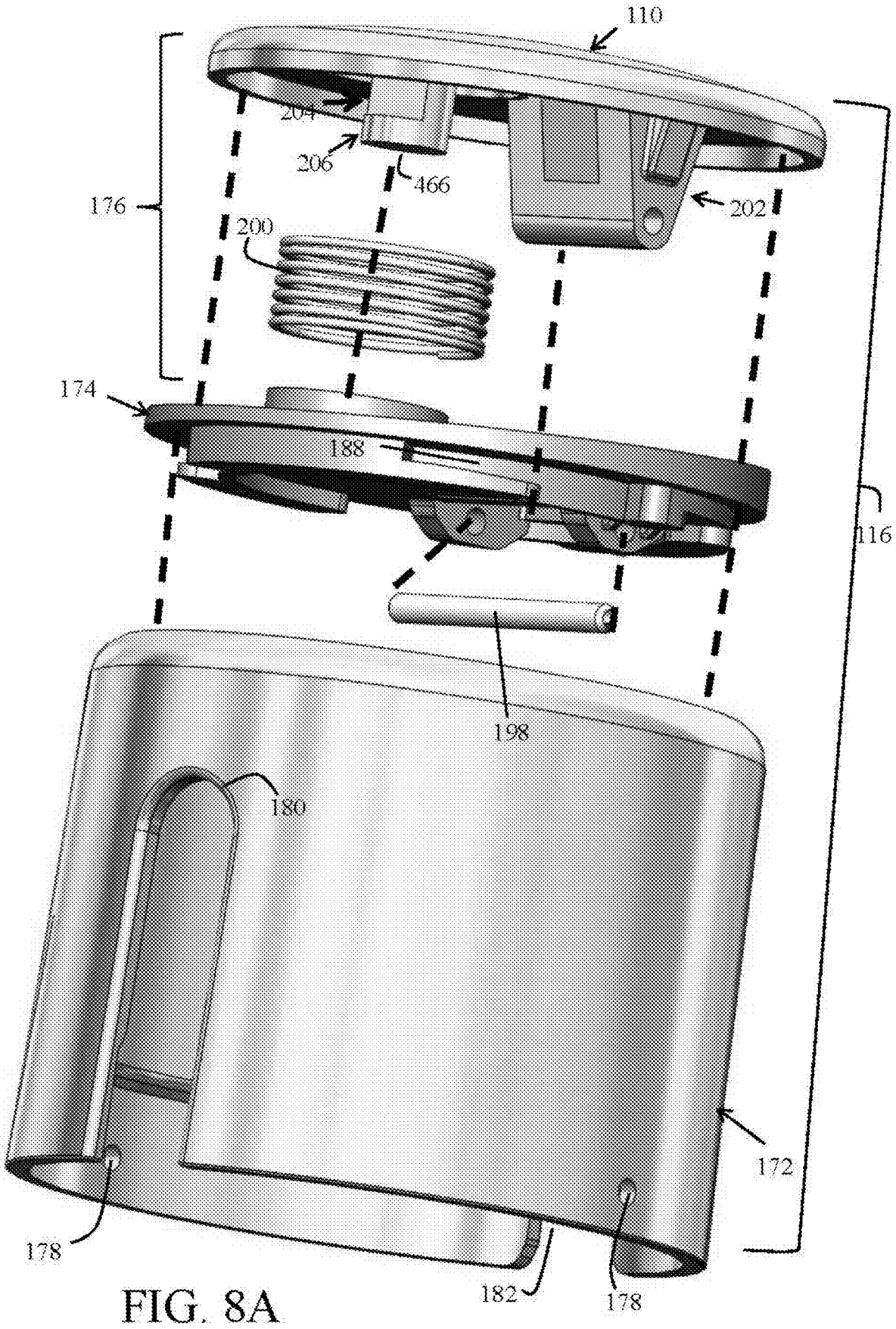
FIGS. 8A to 8G are non-limiting, exemplary illustrations of cover of valve housing of flush valve assembly illustrated in FIGS. 1A to 7F in accordance with one or more embodiments of the present invention.
Figure 8B:
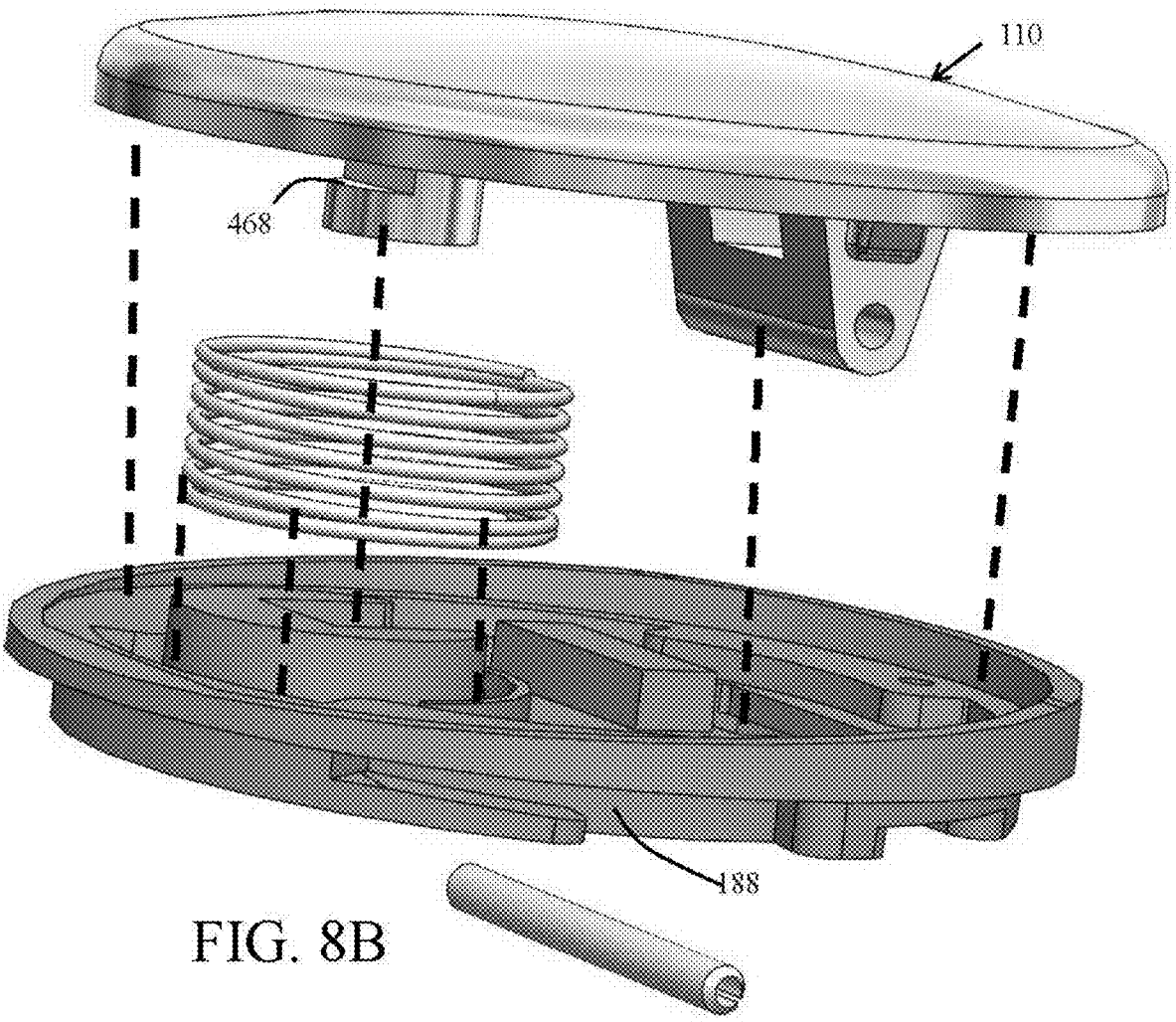

Indexing extensions 212 also enable cover 116 of valve housing 114 to be properly positioned in relation to main body 118. That is, sensor opening 180 (FIG. 8A) and index opening 182 of cover 116 receive indexing extensions 212 (as best illustrated in FIGS. 1A to 1C). Indexing extensions 212 are defined by a step or ledge 214 around periphery of upper outer surface 210 of main body 118, with step 214 enabling cover 116 to rest flush (or level) with main body 118 (as best shown in FIGS. 1A to 1C).

Upper outer surface 210 of main body 118 further includes lateral openings 222 for fasteners 122 to secure cover 116 onto main body 118. An upper interior surface 224 of main body 118 has an, inner diameter that is threaded for securing a retainer-adapter 132 (detailed below).

Interior of main body 118 further includes a plurality of distinct flanges (best shown in FIG. 4C-2) with different lengths projecting from an interior surface 228 of main body 118, generally perpendicular a central longitudinal axis 578 of main body 118, forming plurality of ledges 226*a*, 226*b*, 226*c* that provide a seat for closure mechanism 128. It should be noted that a continuous ledge may also be provided instead of a plurality of separate ledges 226*a,b,c*.

Use of shorter span separate ledges 226*a*, 226*b*, 226*c* rather than a single, elongated continues ledge around inner surface 228 of main body 118 is preferable in that the separate ledges 226*a,b,c* provide a smaller contact surface with closure mechanism 128, which would prevent closure mechanism 128 from binding with main body 118. Binding may take place if water source used is calcium rich, or includes dirt or debris. Use of a single elongated ledge may potentially be particularly problematic if main body 118 and closure mechanism 128 are both comprised of different (or dissimilar) metals (e.g., a brass main body 118 and stainless-steel closure mechanism 128).

A first ledge 226*a* of the plurality of ledges is positioned adjacent a first interior side 230 of inlet 126 of main body 118 has a first length, and accommodates the narrow portion (linear or straight part) 146 of closure mechanism 128 when closure mechanism is in fully closed position. Accordingly, first ledge 226*a* has sufficient length and width to continue to accommodate a seat for the thinned out (narrow portion) 146 of closure mechanism 128.

A second ledge 226*b* of the plurality of ledges 226 is positioned adjacent a second, interior side 232 of inlet 126 of main body 118, across from first ledge 226*a*, has a second length, to accommodate projection portion 142 of closure mechanism 128 when closure mechanism 128 is in a fully open position. A first relief 234 in a form of a recess (or groove) adjacent and above the second ledge 226*b* houses projection portion 142 of closure mechanism 128 when closure mechanism is in a fully open position.

Engagement portion (the cam) 142 rests on second ledge 226*b* in open position; the protruding cam portion 142 is moved into first relief 234 when enclosure mechanism 128 is at open position. First relief 234 is a cavity within main body 118, an exterior of which is bulge 236.

It should be noted that another benefit of positioning protruding cam portion 142 tucked away inside groove or cavity 234 is to allow free flow or discharge of water during flush cycle. Leaving protruding cam portion 142 in the way of the water flow in hold chamber (detailed below) will restrict or reduce water flow and hence, it is best to get the protruding cam portion 142 out of the way of water flow and into relief section 234.

As indicated above, main body 118 has no machining parts to which, flush valve cartridge 112 may be secured and hence, one or more embodiments of the present invention provide an adapter (a retainer-adapter) 132 that enables securing of flush valve cartridge 112 with main body 118, while moveably, retaining closure mechanism 128. It should be noted that optionally, retainer-adapter 132 may also be an integral part of main body 118 instead of a separate piece that is fixed therein.

Valve seat support 286 is slanted sloped at an angle β (best shown in FIG. 5H) to quickly drain water downward and out of outlet chamber 106 of main body 118. The slanted slopping, angle of valve seat support 286 would also facilitate removal of any accumulated dirt, potential rust, and debris after every flush due to gravity, acting similar to drain. Sealing surface 536 of valve seal support 286 engages sealing member 404 of main valve seat 384 (detailed below).

Figures 1, 6A:
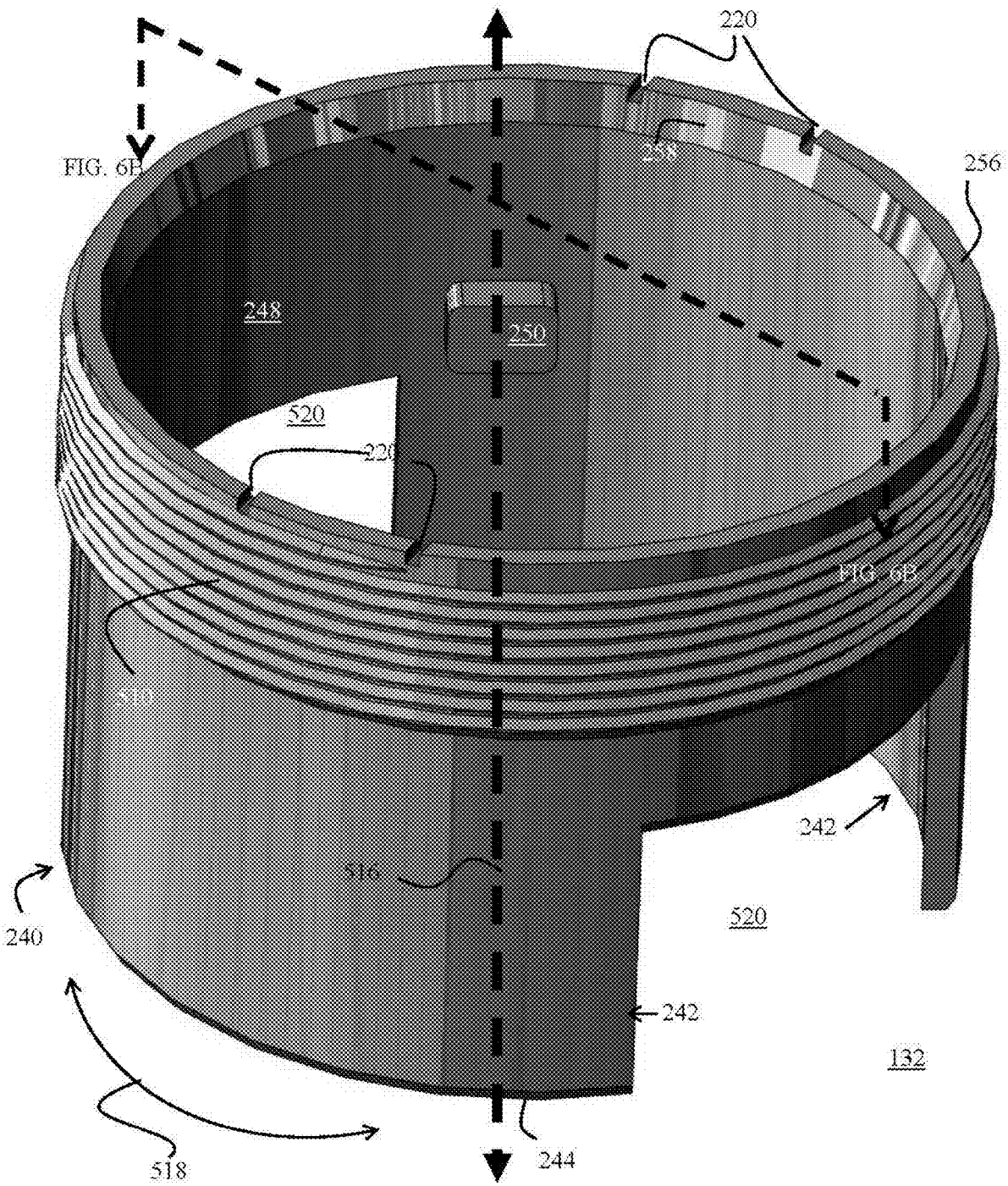
Figures 2, 6A:
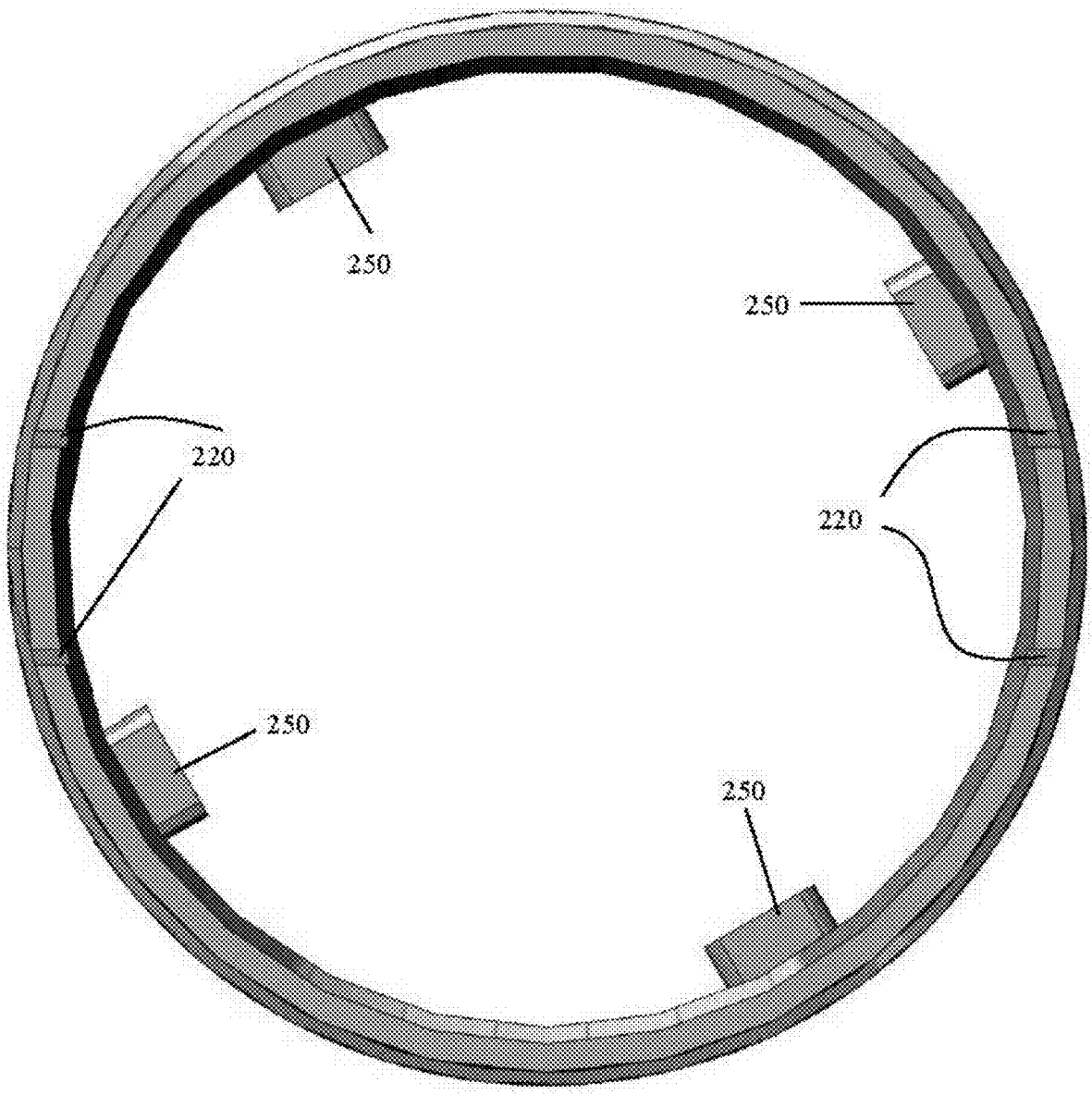
Figures 3, 6A:
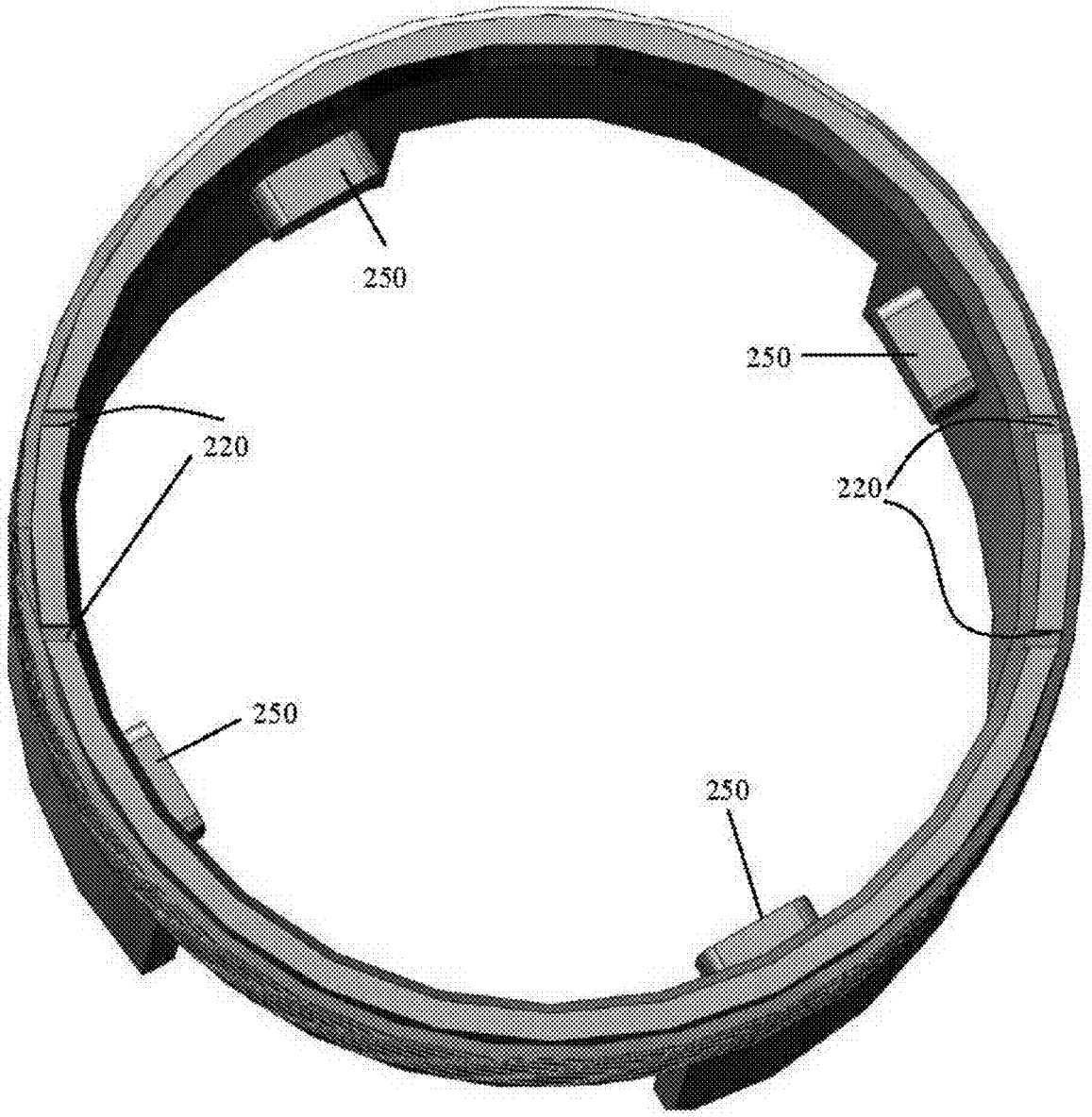
Figure 6B:
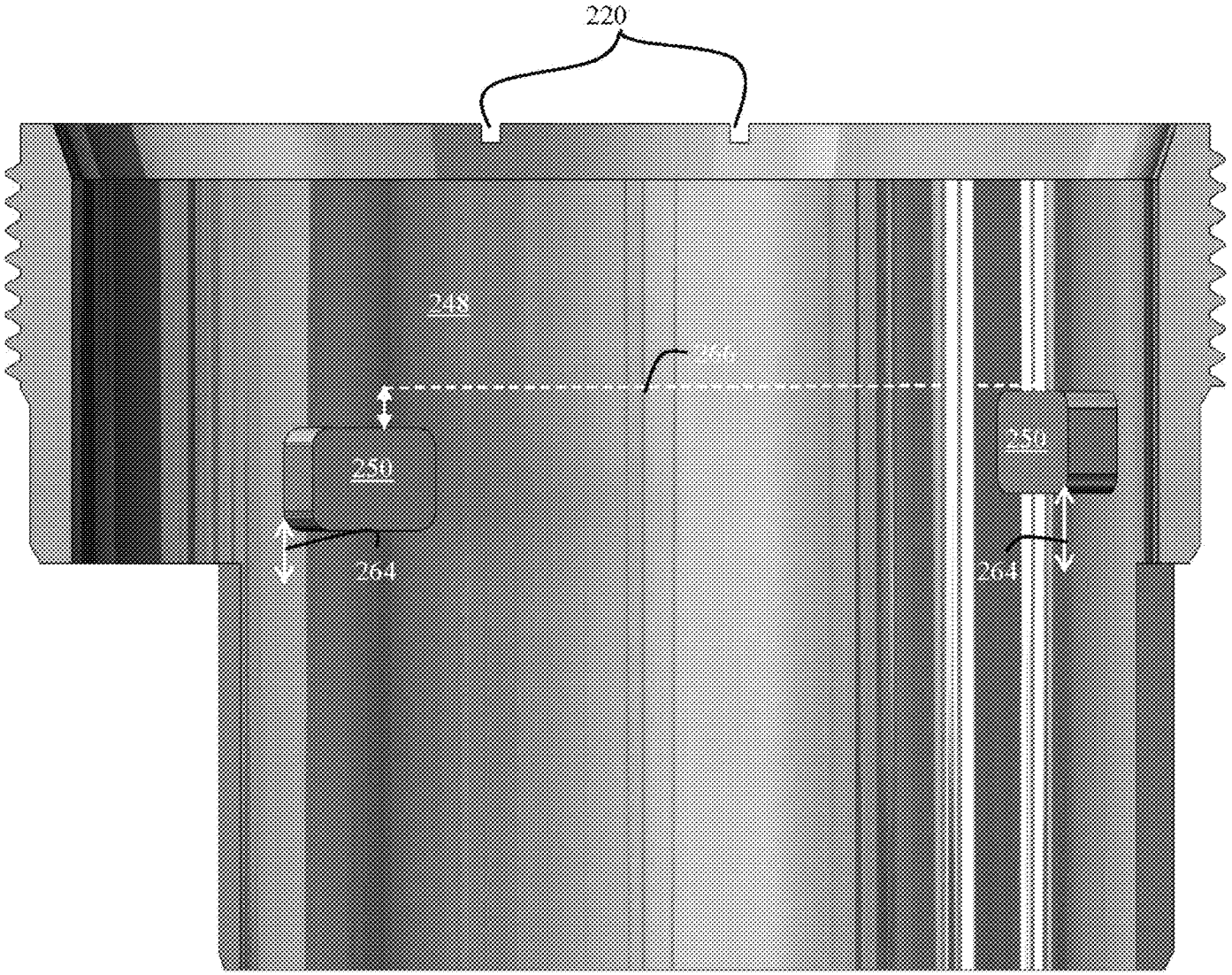

FIGS. 6A-1 to 6B are non-limiting, exemplary illustrations of a retainer-adapter of flush valve assembly illustrated in FIGS. 1A to 5H in accordance with one or more embodiments of the present invention. As illustrated in FIGS. 1A to 6B, retainer-adapter 132 is comprised of an annulus cylinder 240 with retainer supports 242 that extend parallel central longitudinal axis of annulus cylinder 240. Annulus cylinder 240 includes threads 510 that thread onto threading 512 of upper interior surface 224 of main body 118 with flush valve cartridge 112 engaging retainer-adapter 132 as detailed below.

Bottom ends 244 of retainer supports 242 of annulus cylinder 240 engage a top surface 246 of closure mechanism 128 to thereby prevent up/down movement of closure mechanism 128 to maintain an in-plane rotational motion to prevent wobbling or tilting or out of plane motion of enclosure mechanism 128 as closure mechanism 128 rotates. It should be noted that the retainer supports have sufficient arcuate span 518 (extending transverse to longitudinal axis 516) to rest over a large portion of top surface 246. Openings 520 between the peripherally symmetrical retainer supports 242 enables flow of water from inlet member 102.

Annulus cylinder 240 (which may, generally be comprised of stainless steel) includes an outer surface with threads 510 that threads onto inner threaded surface 512 of upper interior portion 224 of main body 118, near receiver opening 120. Outer circumferential surface is comprised of fine (rather than coarse) threaded outer diameter 510 that fastens onto inner circumferential surface threading 512 of main body 118, which, is a threaded inner diameter. Fine thread (NF standard) may optionally be used with bonding material to properly seal the connection between retainer-adapter 132 and main body 118 to prevent water leak through the threaded connection. Other non-limiting examples of "bonding" may include, for example, soldering, welding, or brazing as "hot" bonding. There are many common methods of bonding or securing one body of material to another that may be used for securing retainer-adapter 132 within main body 118.

Annulus cylinder 240 is further comprised of a smooth inner surface 248 with one or more interlocking projections 250 protruded perpendicular inner surface 248 that engage a corresponding set of interlocking guide tracks 252 of an outer surface 254 of flush valve cartridge 112, to thereby detachably secure flush valve cartridge 112 within valve housing 114 under water pressure.

At the very top edge 256 of annulus cylinder 240 are a pair of notches 220 at opposite ends that are used to index and position retainer-adapter. That is, at the final position of retainer-adapter 132, indexing flanges 212 of main body 118 fall in between notches 220. The final position is where top edge 256 is generally flush with the top edge 216 of main body 118 (best shown in FIG. 2H).

It should be noted that the connection of retainer-adapter 132 to main body 118 is done during the manufacture and assembly phase of flush valve assembly 100 and not at service field. Nonetheless, these indexing schemes position retainer-adapter 132 properly so as to position interlocking projections 250 at the correct angle, orientation, and location to enable proper, final positioning of flush valve cartridge 112 so that sensor 108 is properly aligned with indexing flanges 212 of main body 118.

Top inner edge 258 of annulus cylinder 240 is chamfered to allow sealing member (e.g., O-ring) 260 around flush valve cartridge 112 to slip through with ease. O-ring 260 on flush valve cartridge 112 rests above interlocking projections 250, in contact with smooth inner surface 248 of annulus cylinder 240 to thereby provide a seal to prevent movement of water above the seal 260 and into dry-side, generally referenced as 262 (FIG. 10C) of flush valve cartridge 112.

Interlocking projections 250 are positioned along different elevations 264 (FIG. 6B), within different transverse planes 266. Varying the position of interlocking projections 250 provides, an indexing feature or functionality to properly insert flush valve cartridge 112 into main body 118 in one of two positions for proper seating, and positioning of flush valve cartridge 112 and sensor 108. This way, sensor 108 will align with indexing flanges 212 of main body 118. Simply stated, the misalignment of interlocking projections 250 is yet another form of fail-safe infrastructure to ensure that flush valve cartridge 112 is installed properly in one of two orientations for right or left installations of flush valve assembly 100.

FIGS. 7A to 7F are non-limiting, exemplary illustrations of an inlet member shown in FIGS. 1A to 6B in accordance with one or more embodiments of the present invention. As illustrated, flush valve assembly 100 includes inlet member 102 (in a form of a pipe) the illustrated ingress end 104 of which is connected to an upstream fixture 484 such as a stop valve, while its egress end 150 has an outer threading that connects to inner threading of inlet 126 of main body 118.

Ingress opening 104 includes a mesh 152 thread-secured to ingress opening 104 for filtering debris from entering flush valve assembly 100 from upstream flows. Inner circumferential surface 154 of inlet pipe 102, generally near ingress opening 104 is optionally stepped 156 to secure an optional flow-control member seat 158 therein that also includes a corresponding stepped outer diameter 160. The optional flow-control member seat 158 is a single piece, annular member with inner diameters that reduce in size, from upstream side to downstream side of flow-control member seat 158 to thereby control the flo432 w of volume of water into flush valve assembly 100.

As illustrated, flow control member seat 158 is positioned between ingress opening 104 and egress opening 150. Flow control member seat 158 and the flow control member (not shown) are well known.

Figure 7A:
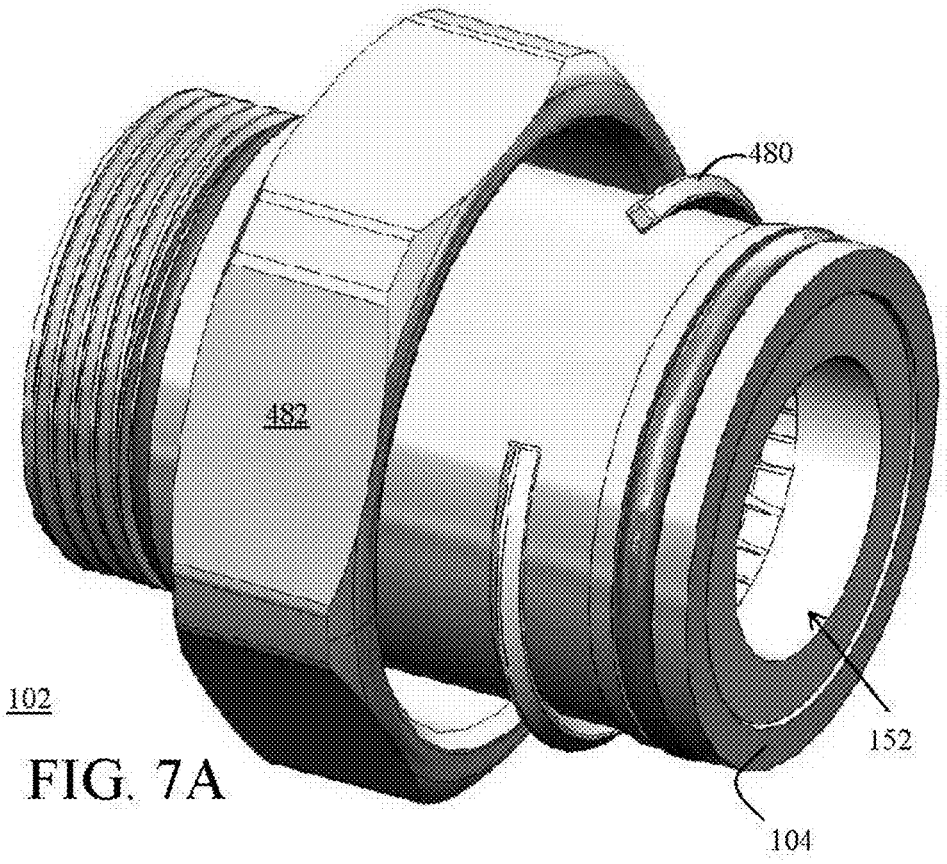
FIGS. 7A to 7F are non-limiting, exemplary illustrations of an inlet member shown in FIGS. 1A to 6B in accordance with one or more embodiments of the present invention.
Figure 7B:
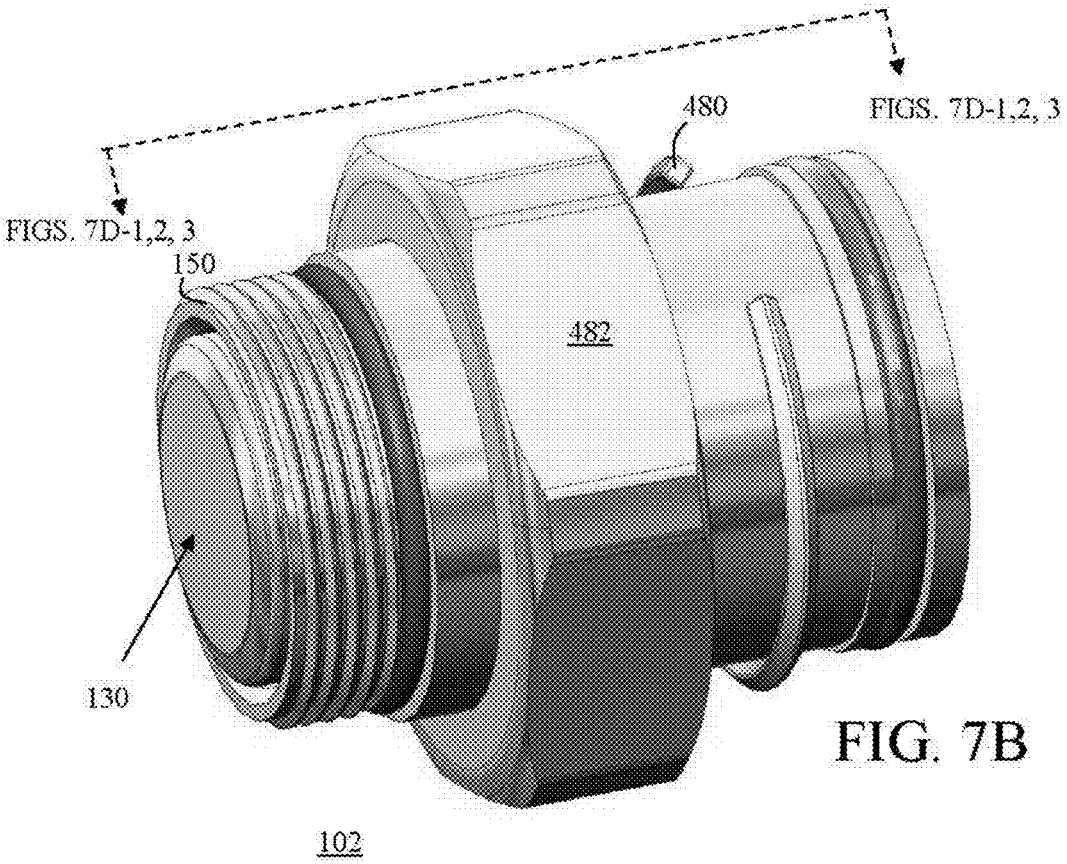
Figure 7C:
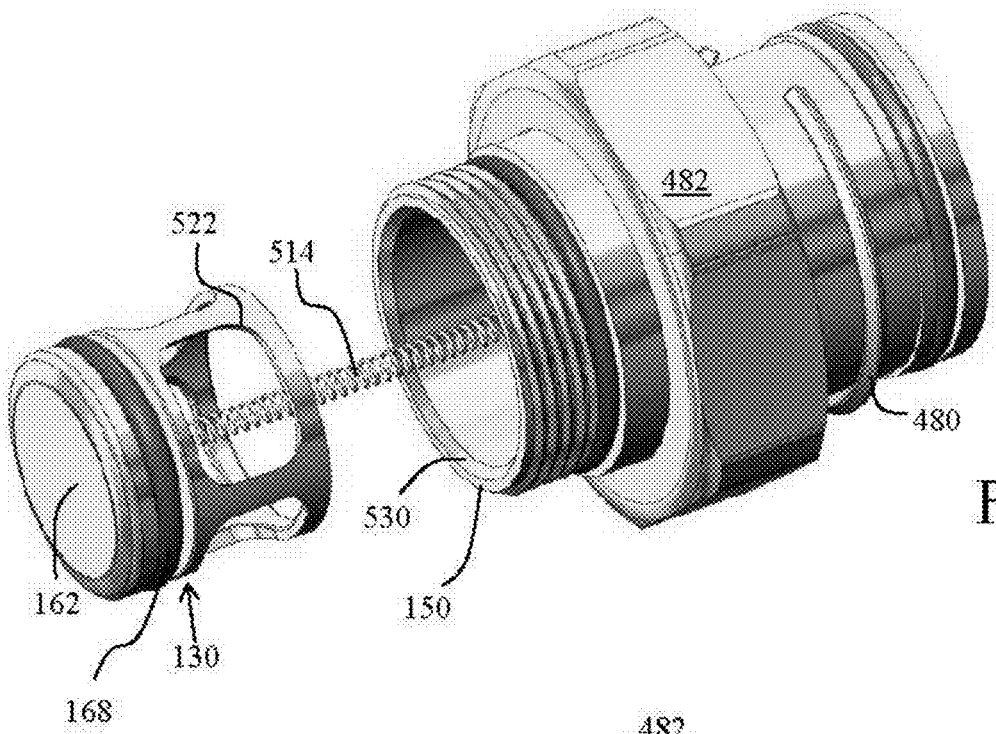
Figures 1, 7D:
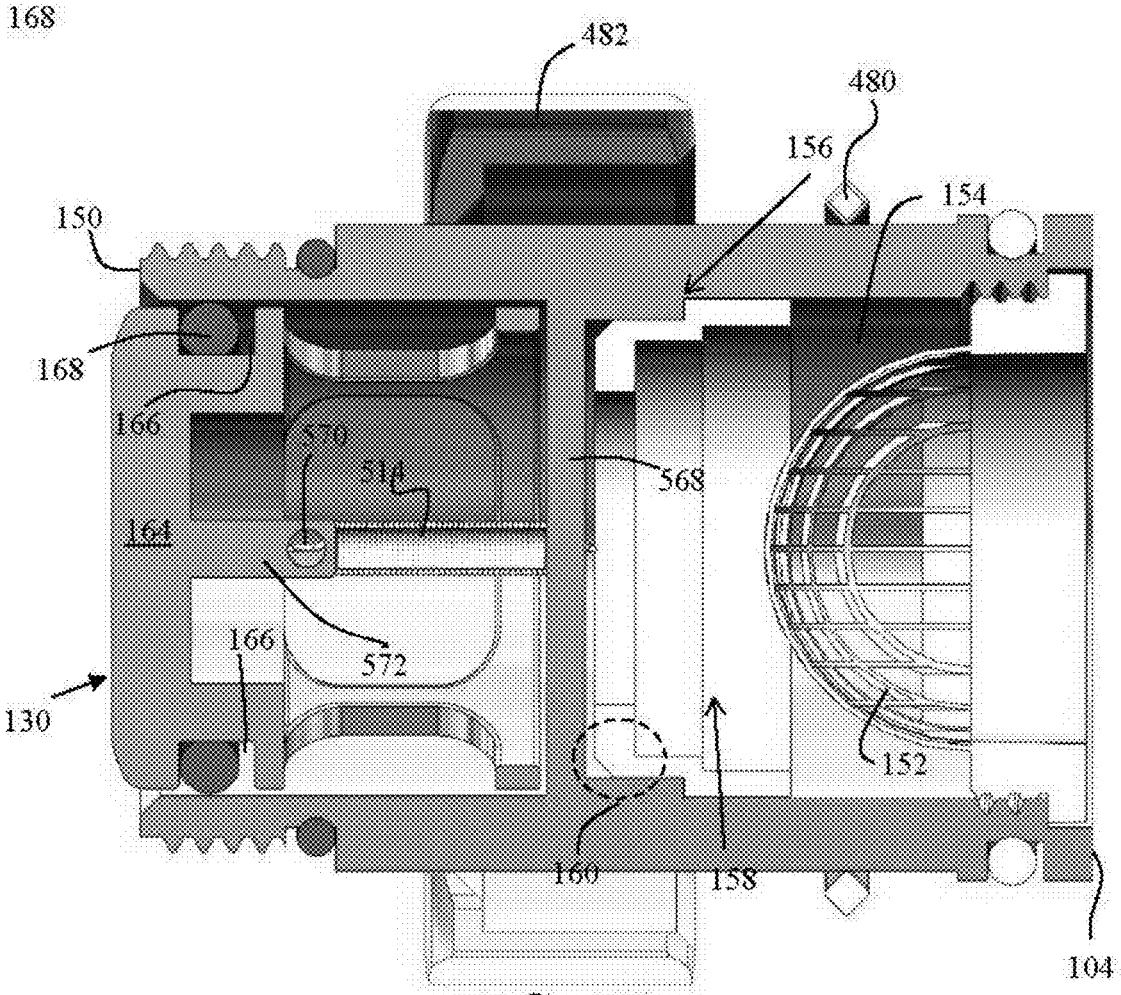
Figures 2, 7D:
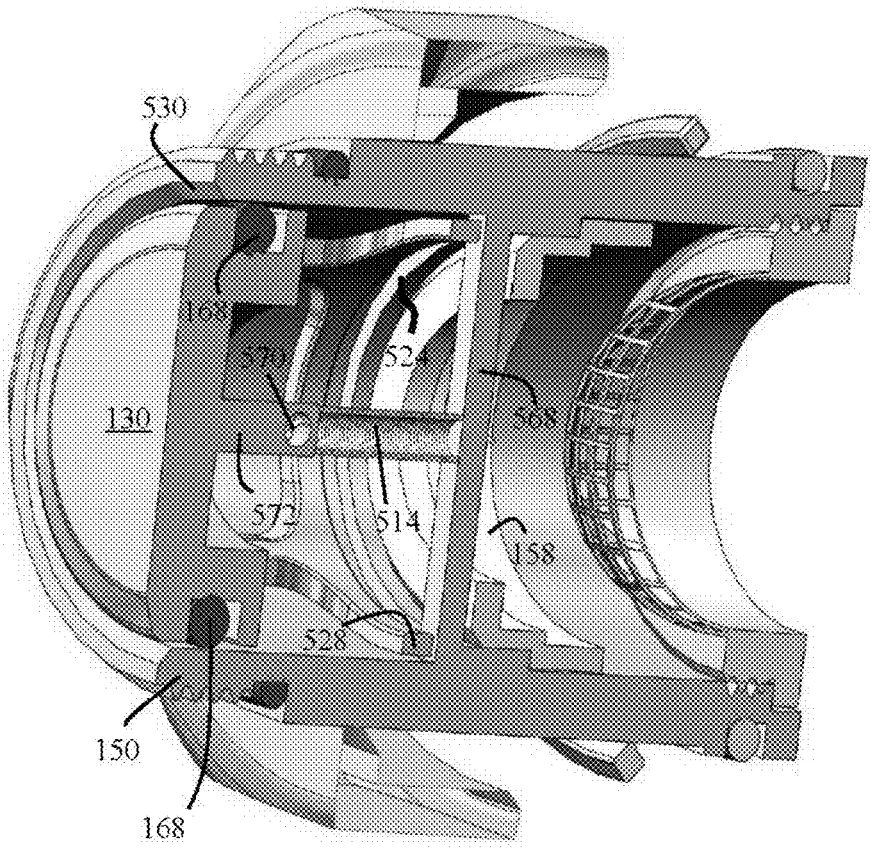
Figures 3, 7D:
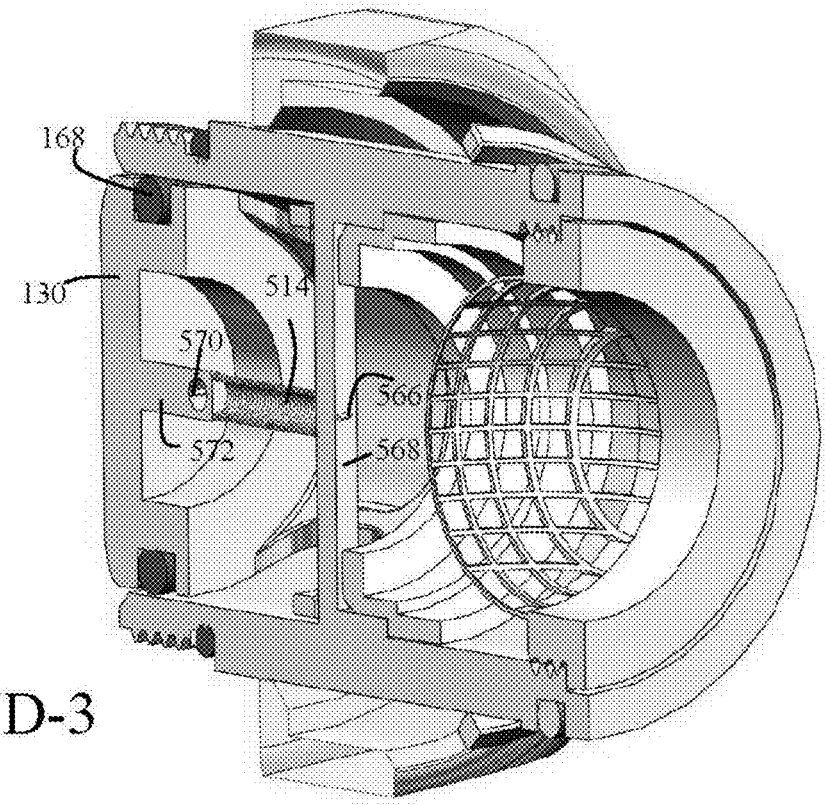
Figure 7E:
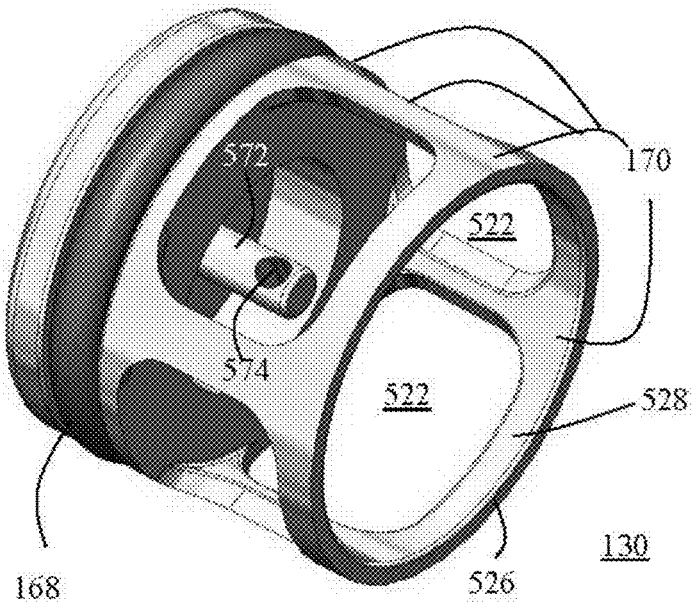
Figure 7F:
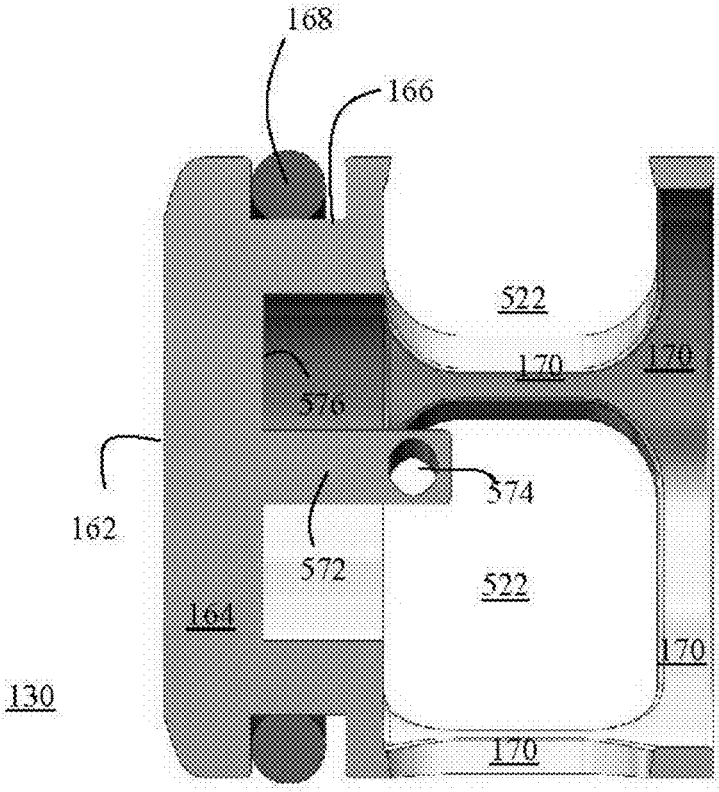

Upstream side of flow-control member seat 158 is an inner circumferentially raised portion 524 (FIG. 7D-2), which functions as a stopper for gate 130 at its closed position. This way, gate 130 will not move inside inlet pipe 102 too far in to push or pop-out flow-control member seat 158 out of its seated place when gate 130 returns to its closed position. Accordingly, edge 526 of upstream ring portion 528 of alignment (or centering) members 170 of gate 130 engage the downstream side of inner circumferentially raised portion 524 as shown in FIG. 7D-2 when gate 130 is at the closed position.

Egress opening 150 includes gate 130 that is biased closed by a biasing mechanism 514, and remains shut when the removable flush valve cartridge 112 is removed out of main body 118 to thereby prevent flow of water into main body 118 without shutting-off main water. Biasing mechanism 514 is a resilient member in a form of a spring with its rest position being contracted as shown in FIGS. 7D-1 to 7D-3.

Gate 130 opens when the force of the water flow pressure from upstream fixture 484 is greater than the biasing force of the biasing mechanism 514. Maintaining gate 130 at a closed position by the biasing mechanism 514 during static state of the flush valve is important in preventing potential water backflows thus functioning as a backflow preventer—for example, in case of pressure drop in, water, supply system upstream of inlet member 102.

Another reason for the biasing mechanism 514 is that it maintains gate 130 at a closed position which makes turning of closure mechanism 128 to remove flush valve cartridge 112 easier. That is, closure mechanism 128 need not push gate 130 to its closed position as it is rotated to remove flush valve cartridge 112 because gate 130 is already pulled to its closed position by biasing mechanism 514. During initial rotation of flush valve cartridge 112, water pressure is at equilibrium since the flush valve system is static and hence, the reasons biasing mechanism 514 closes gate 130.

As further illustrated in FIGS. 7D-1 to 7D-3, upstream end 566 of biasing mechanism 514 is connected (or hooked) to a bar 568 that internally extends diagonally across inside of inlet member 102. A downstream end 570 of biasing mechanism 514 is connected (or hooked) to an opening 574 of a centrally extending projection 572 of gate 130. Centrally extending, projection 572 extends from a recessed base 576 of upstream side of barrier 164. Recessed base 576 (resulting from removing material) lightens the overall weight of gate 130.

It should be noted that conventional flush, valves required shut-off of external upstream supply valve generally known as stop-valves to stop flow of water from the main prior to service work on conventional flush valves. This way, water will not spew out of the conventional flush valve while being serviced. As indicated above, gate 130 enables automatic closure or shut-off of water into main body 118 upon removal of flush valve cartridge 112 without closure of upstream fixtures 484.

It should further be noted that stop-valves used with flush valves require tools for closure and hence, with the present invention, water flow into main body 118 will be stopped without the need or requirements of tools. As importantly, stop valves are not just used to open or close water flow into flush valve assembly 100, but are also used to adjust the amount of flow rate of water into flush valve assembly 100. Therefore, if they are closed to service the flush valve assembly 100, they must also be opened and readjusted or recalibrated by a plumber to provide the appropriate flow rate for flushing. Accordingly, gate 130 of the present invention enables the stop-valve or any other upstream valve to remain as they are without having to close and then be opened and readjusted, reducing labor-intensive, time-consuming work and in fact, eliminating the requirements for skilled, costly labor. In other words, flush valve cartridge 112 may be easily replaced without the need to operate (close, open, adjust, recalibrate, etc.) any upstream fixture 484.

As further illustrated gate 130 at the egress opening 150 of inlet pipe 102 may be maintained shut at egress opening 150 by closure mechanism 128, which is actuated when flush valve cartridge 112 is removed from valve housing 114. Closure mechanism 128 is comprised of engagement, portion 142 that engages surface 162 of a down-stream side of gate 130 (or barrier 164), pushing or maintaining gate 130 at closed position to thereby close egress opening 150. This way, no external upstream fixtures 484 (e.g., stop valves) need to be shut-off to stop flow of water while the flush valve cartridge 112 is removed to be replaced. No plumbing skills are needed or required to restore a flush valve. The services or, maintenance crew no longer need to close upstream valves to replace or maintain the flush valves.

Additionally, engagement portion 142 of closure mechanism 128 disengages surface 162 of the down-stream side of gate 130 when flush valve cartridge 112 is fully inserted into main body 118, with water pressure pushing gate 130 from closed to open position. In other words, engagement portion 142 no longer blocks movement of gate 130 from closed to open position.

Gate 130 is comprised of barrier portion 164 that opens and closes egress opening 150, with upstream side of barrier portion 164 having a groove 166 for receiving a sealing member 168 in a form of an O-ring that engages inner diameter of egress opening 150 of inlet pipe 102. Barrier portion 164 has surface 162 that engages engagement portion 142 of closure mechanism 128 for moving gate 130 from the open to the closed position (or maintaining the gate at closed position). It should be noted that egress end 150 is also chamfered 530 for easy in-and-out movement of O-ring 168 as gate 130 moves from open to closed position.

Gate 130 further includes alignment (or centering) members 170 extending from the upstream side of barrier portion 164 that slide over, inner circumference 154 of inlet pipe 102 to prevent tilting or wobbling of barrier portion 164 while moving from open to close or close to open positions. Openings 522 enable passage of water from inlet pipe 102 and into valve body 118 when gate 130 is at an open position (e.g., FIG. 7C).

FIGS. 8A to 8G are non-limiting exemplary illustrations of cover of valve housing of flush valve assembly illustrated in FIGS. 1A to 7F in accordance with one or more embodiments of the present invention. As illustrated in FIGS. 1A to 8G, cover 116 includes a main piece 172 that engages and covers over main body 118. Cover 116 further includes an adapter piece 174 that connects to main piece 172 and houses primary actuator assembly 176.

Main piece 172 has a general hollow cylindrical configuration with a top inner diameter and, a bottom inner diameter, with lateral fastener openings 178, a sensor opening 180, and an index opening 182. Top edge 184 of main piece 172 includes interlocking flanges 186 that interlock with recesses or notches 188 of adapter piece 174.

Figure 8C:
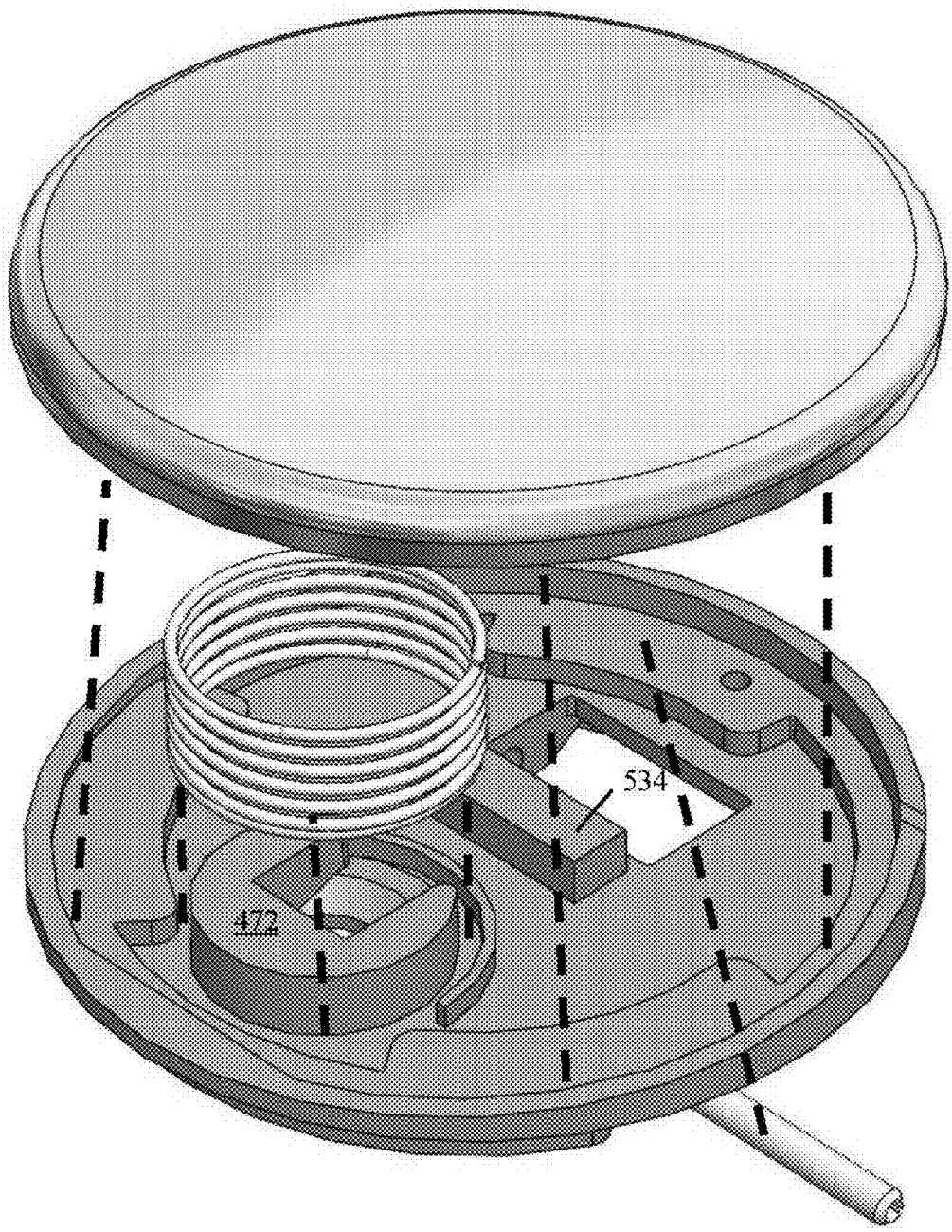
Figure 8D:
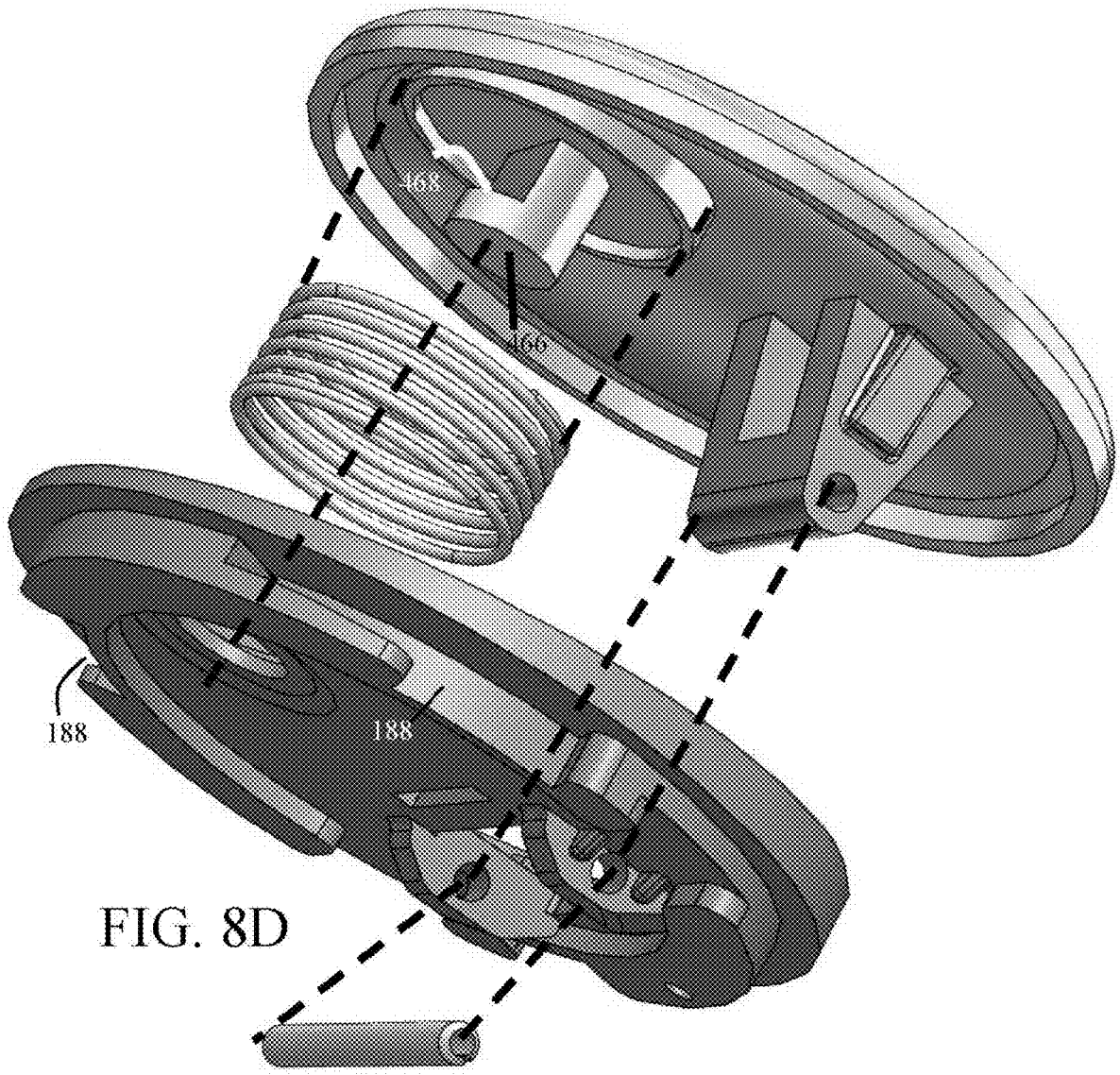
Figure 8E:
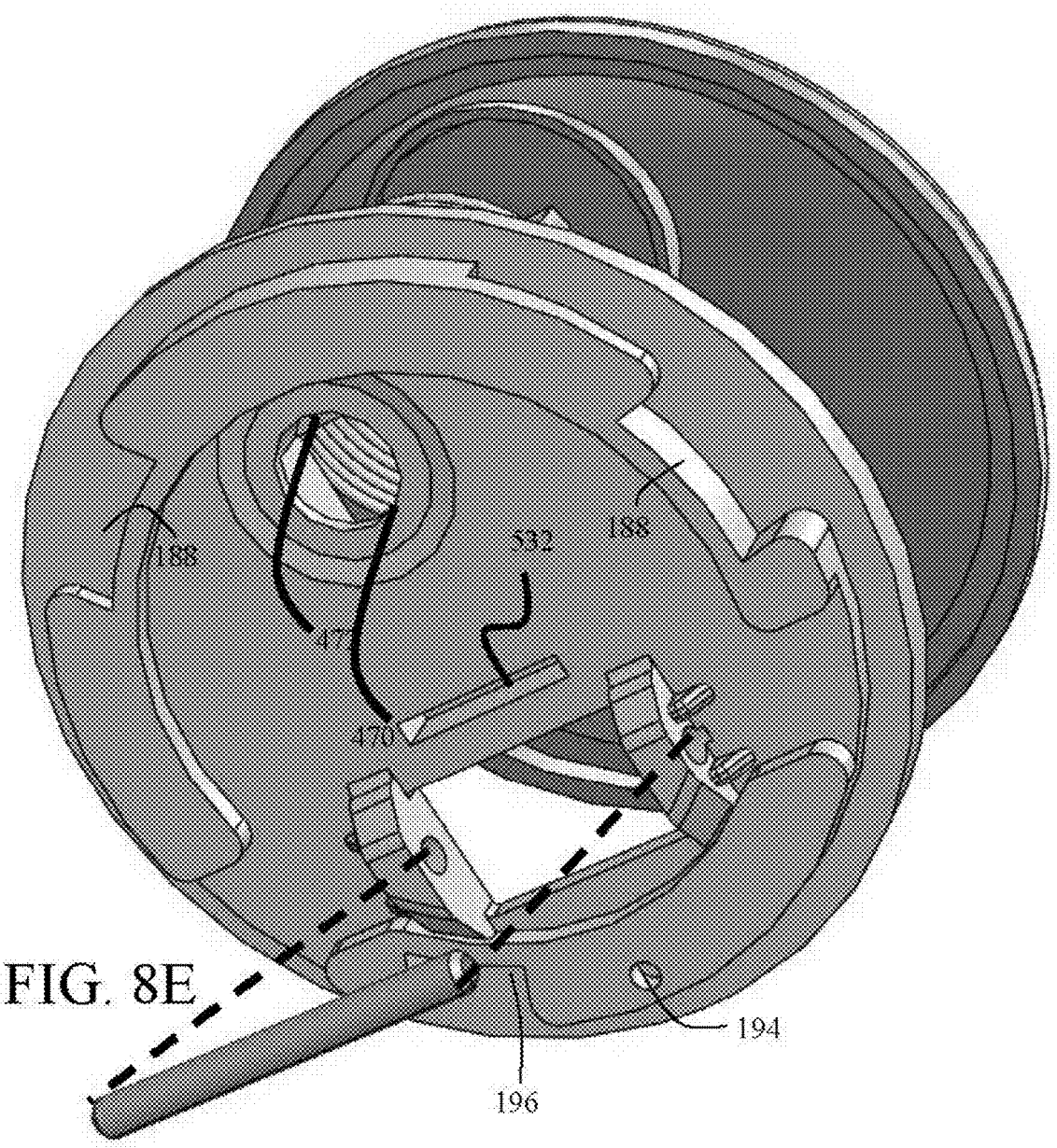
Figure 8F:
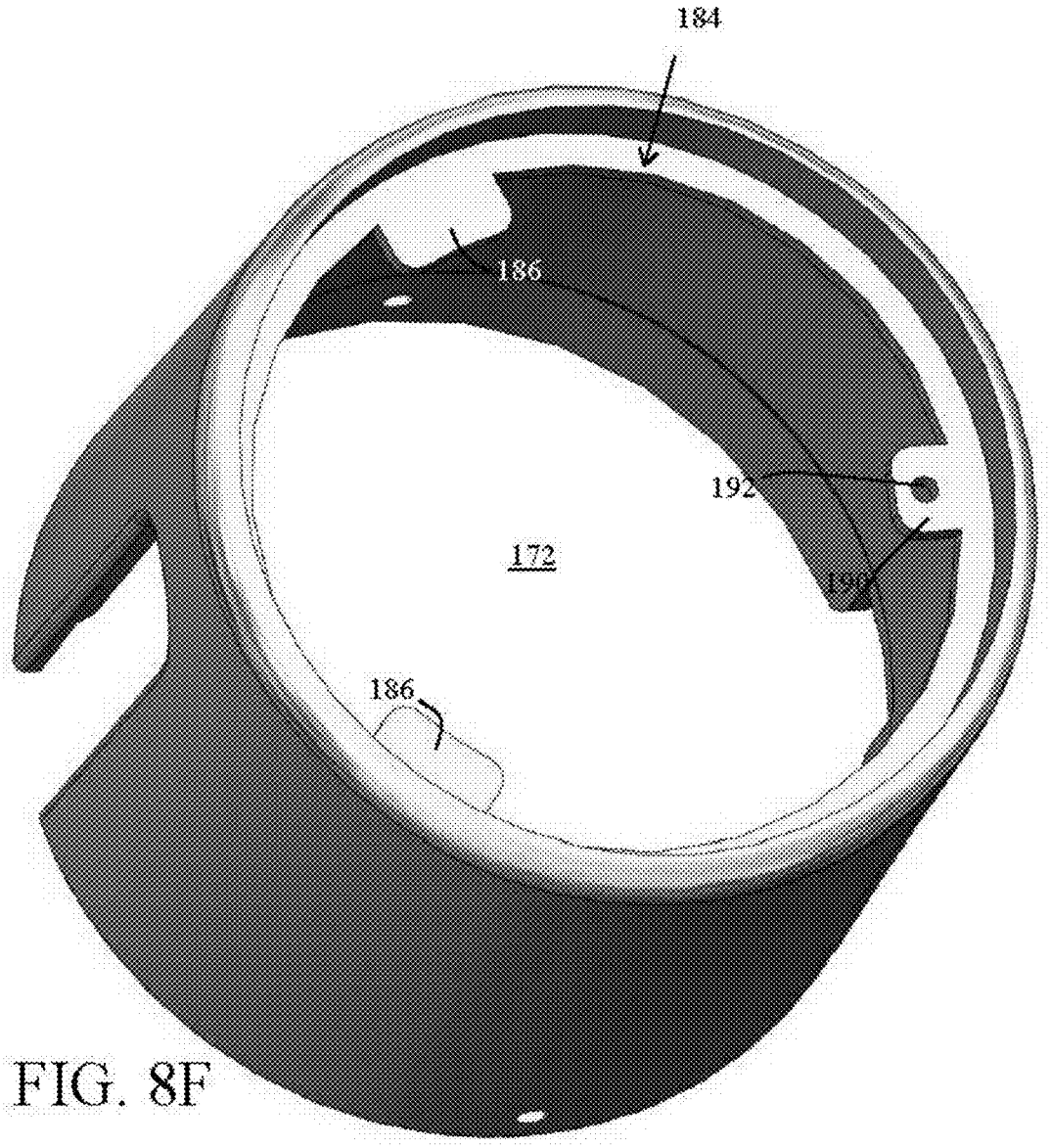
Figure 8G:
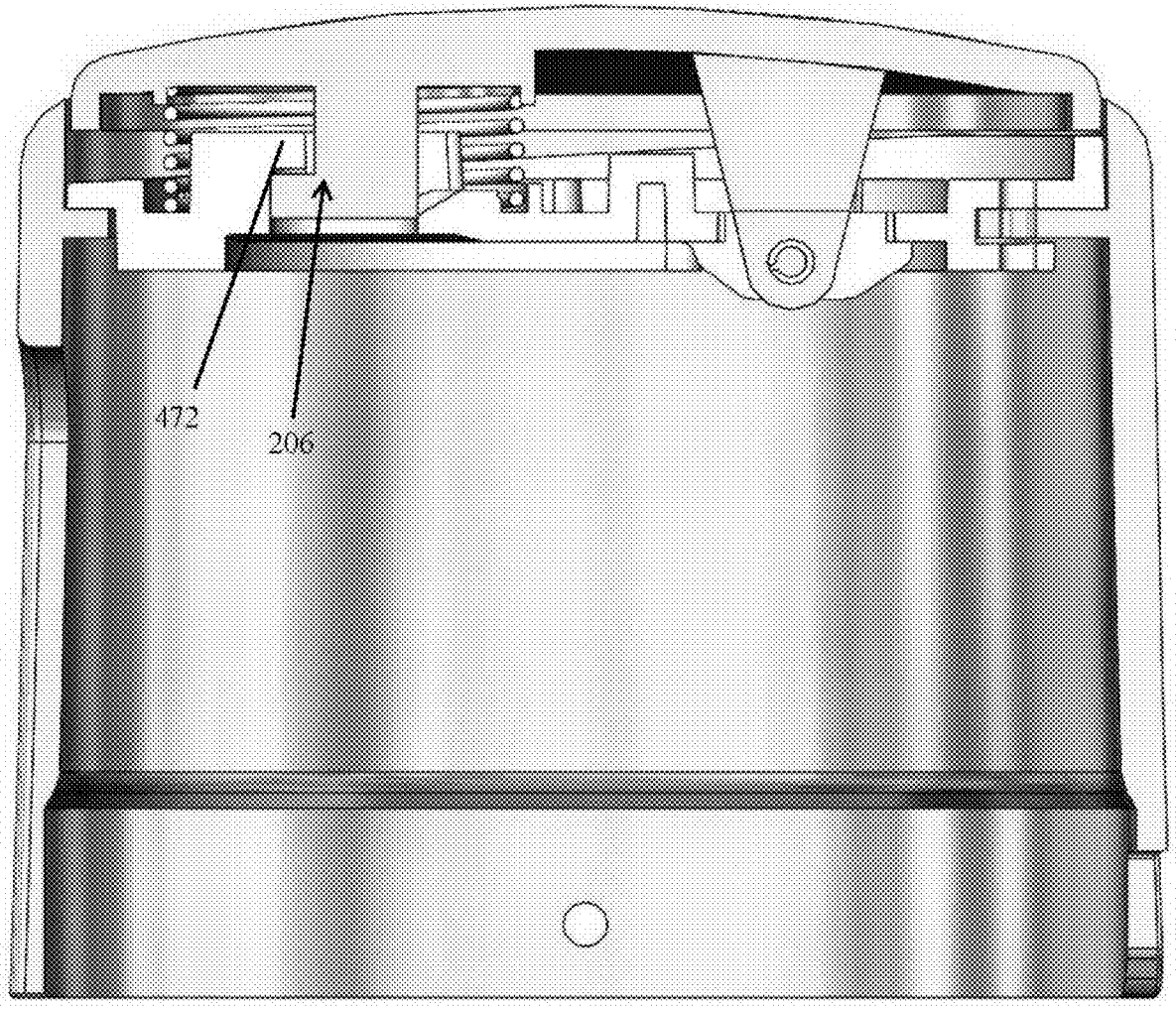
Figure 9A:
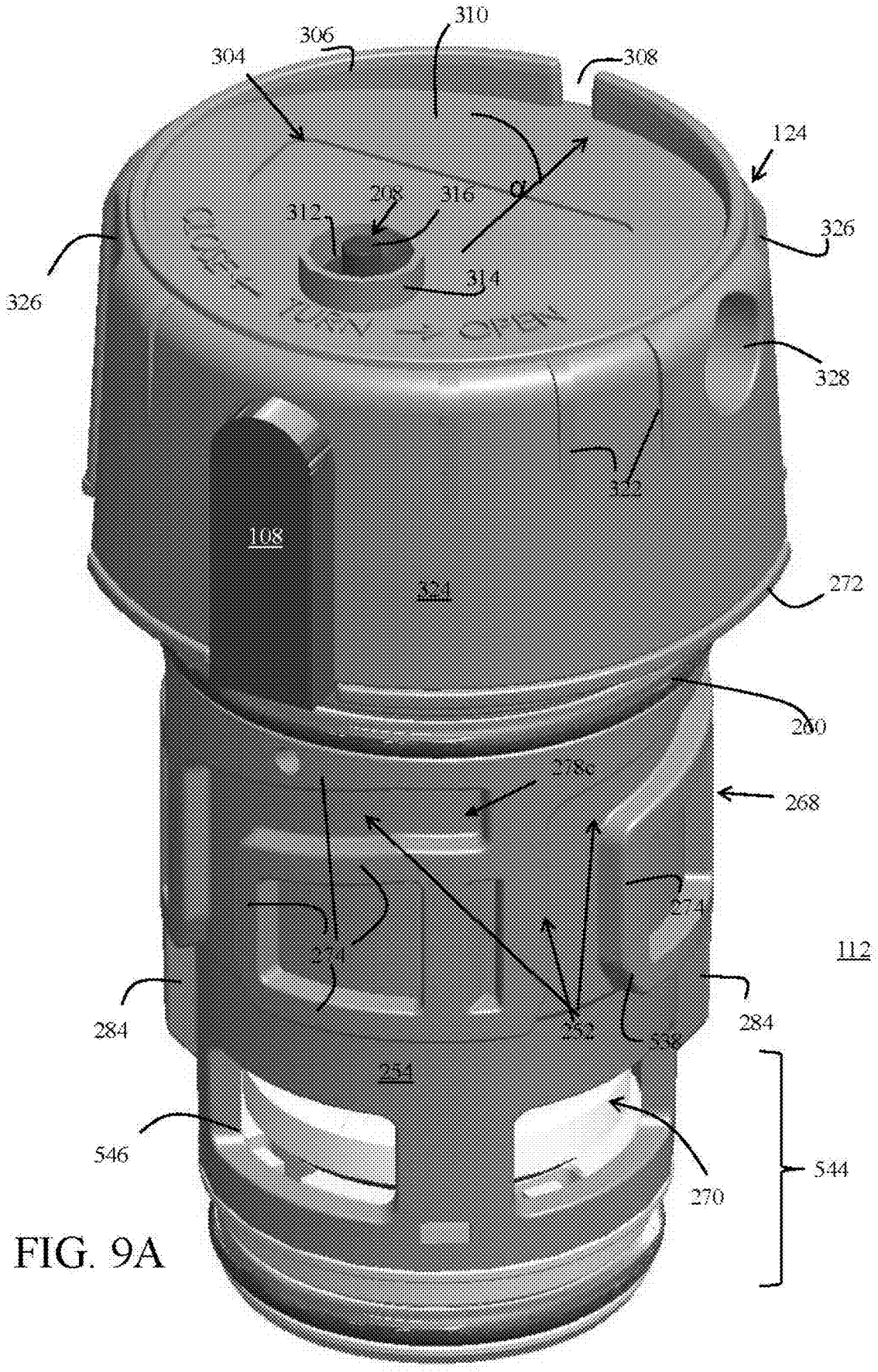
FIGS. 9A to 9D are non-limiting, exemplary illustrations of a fully assembled flush valve cartridge of the flush valve assembly illustrated in FIGS. 1A to 8G in accordance with one or more embodiments of the present invention.
Figure 9B:
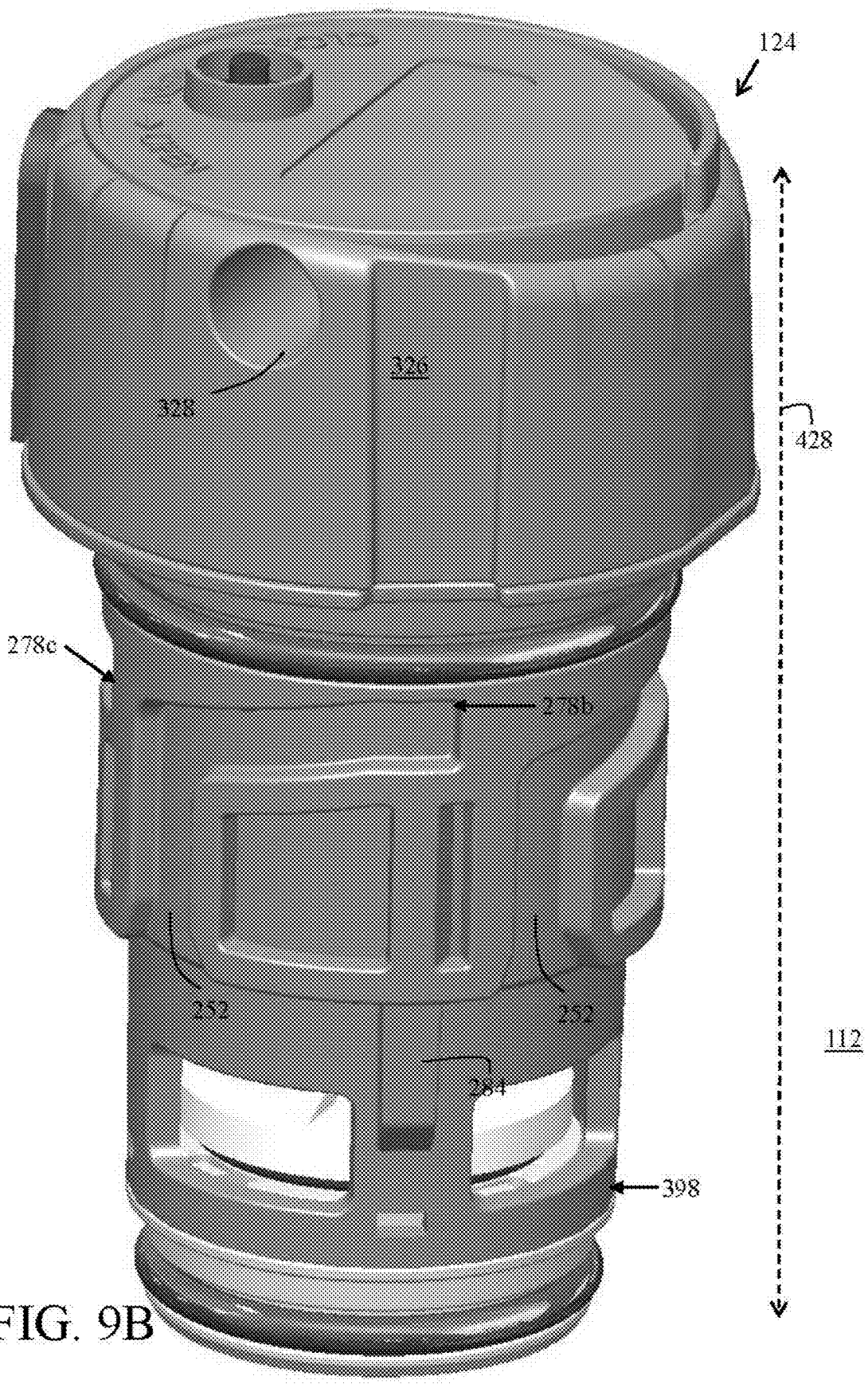
Figure 9C:
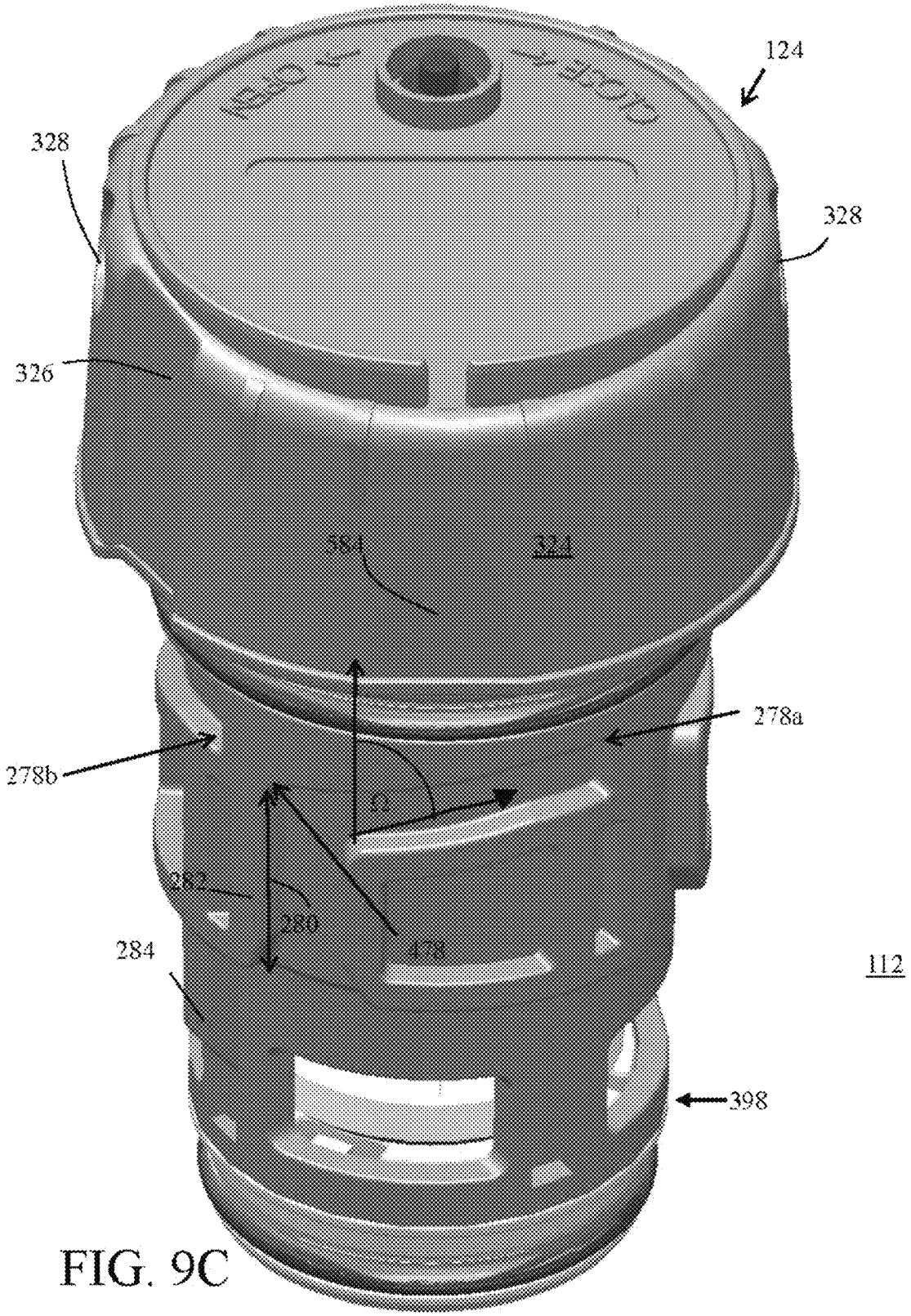
Figure 9D:
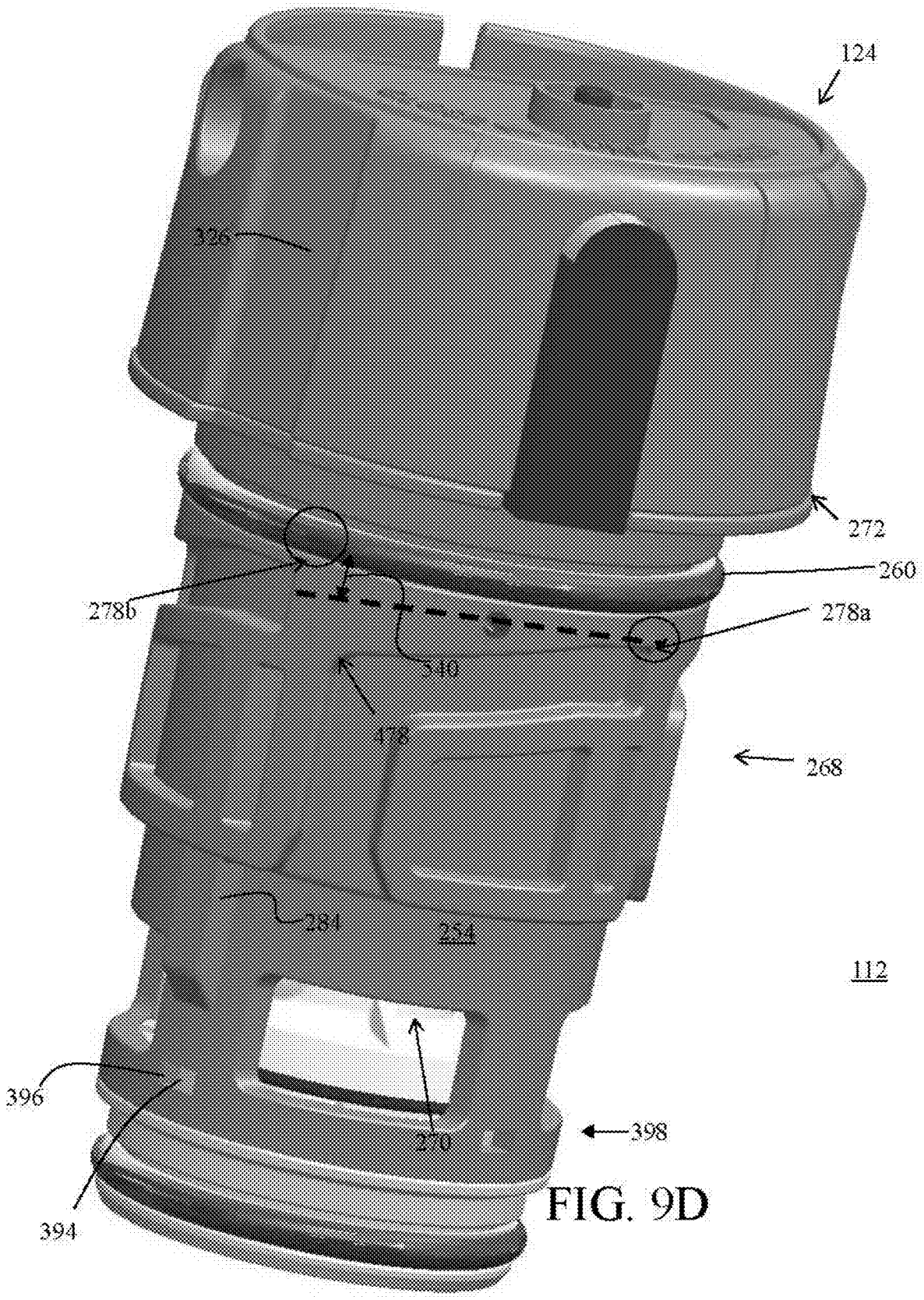

Further included at top edge 184 is a fastening flange 190 with a fastener opening 192 to fix adapter piece 174 onto main piece 172 using a fastener when fastener opening 194 of adapter piece 174 is aligned with fastener opening 192 of main piece 172. Fastening flange 190 also interlocks with its corresponding notch 196 (FIG. 8E).

In general, fastener flange 190 has a smaller expanse compared to interlocking flanges 186 and is used to accommodate the fastener opening 192. It should be noted that the inside distance between interlocking flanges 186 and the outside distances of the two interlocking flanges 186 and fastening flange 190 are not equal to provide an indexing feature for proper assembly of adapter piece 174 to main piece 172 of cover 116. Adapter piece 174 further includes a cavity 532 at a bottom side (FIG. 8E) to facilitate insertion of a coin or some flat tool to enable easy rotation of adapter piece 174 to attach or detach it from main piece 172. (FIG. 8C shows the opposite side of cavity 532 as a cubical protrusion 534.)

Primary actuator assembly 176 includes a primary actuator 110 that is hinged onto adapter piece 174 by a hinge pin 198 at one end, and is biased to static position by a biasing mechanism in a form of a resilient member such as a spring 200 at a second end. Primary actuator 110 includes a smooth top outer surface (an easy to use flush button for manual operation), underneath which is an extended yoke 202 to connect with adapter piece 174 via hinge pin 198.

Underneath primary actuator 110 is a projection 204 with an engagement end 206, a bottom surface 466 of which engages secondary actuator 208 (extending out from a cartridge cap 124) when pressed, with biasing mechanism 200 biasing the entire primary actuator 110 back to static position. The projection 204 and, engagement end 206 in particular, pass through opening 470 of adapter piece 174. A top surface 468 of engagement end 206 is designed to make contact with a lip 472 at opening 470 when primary actuator 110 is released, which prevents primary actuator 110 from moving too far away from adapter piece 174 as a result of the push of biasing mechanism 200.

FIGS. 9A to 9D are non-limiting, exemplary illustrations of a fully assembled flush valve cartridge of the flush valve assembly illustrated in FIGS. 1A to 8G in accordance with one or more embodiments of the present invention. As illustrated, flush valve cartridge 112 includes a cartridge cap 124 that covers over a dry-side 262 (FIG. 10C) of flush valve cartridge 112 that includes sensor 108, electronics, and switches as well as wires, solenoid, batteries, etc.

Flush valve cartridge 112 further includes a cartridge body 268 of generally cylindrical configuration with a smooth interior to allow smooth movement of a piston 270 within (detailed below), with a flange extending transversally from cartridge body 268, forming a base-seat 272 of generally annular disc format. The generally lower part 544 of cartridge body 268 includes openings 546 to allow upstream water from inlet member 102 to ingress into cartridge body 268 (detailed below).

Exterior surface 254 of flush valve cartridge 112 is comprised of four similar, specific set of patterned protuberances 274 that form interlocking guide grooves or tracks 252. As flush valve cartridge 112 is inserted within main body 118, interlocking guide tracks 252 of flush valve cartridge 112 engage interlocking projections 250 of retainer adapter 132. The four similarly patterned protuberances 274 have a chamfered configuration 538 that easily align and guide the three interlocking projections 250 into interlocking guide tracks 252 during initial insertion of, flush valve cartridge 112.

As flush valve cartridge 112 is further inserted and is moved further deeper inside main body 118, the four interlocking projections 250 of retainer-adapter 132 interlock with and are guided by interlocking guide tracks 252 of flush valve cartridge 112, a combination of which guides and compels downward rotational motion of flush valve cartridge 112 further into main body 118 as the four interlocking projections 250 are guided through respective three non-linear, non-uniform sections of interlocking guide tracks 252.

As further illustrated, the four interlocking guide tracks 252 are non-uniform (they are similar but not identical) in terms of their orientation and direction of tracks, forming an indexing feature that allow proper final positioning of flush valve cartridge 112 within main body. For example, an end 278*a* (FIG. 9D) of one interlocking guide track 252 may have a higher elevation 540 than an adjacent interlocking guide track end 278*b* of another interlocking guide track 252 at similar position, defined by specifically patterned variations in the four sets of protuberances 274.

It should be noted that the angle of incline Ω (FIG. 9C) and distance of travel along the incline is identical for all four sets of interlocking guide tracks 252. However, incline start positions 478 of the inclines at end of lengths 280 of linear sections 282 for adjacent interlocking guide tracks 252 are different, which is the reason for differences in the elevations at ends 278.

The differences in the incline start positions 478 of each interlocking guide tracks 252 are commensurate with the differences in transverse, planes 266 of each interlocking projection 250. In other words, interlocking projections 250 are positioned along different elevations 264, within different transverse planes 266 commensurate with each of the four inclines start positions 478 of interlocking guide tracks 252, all of which also function as additional indexing features.

Lengths 280 of linear sections 282 of interlocking guide tracks 252 is critical in that linear portions 282 enable flush valve cartridge 112 to be quickly inserted to a depth defined by linear grooved portion, lengths 280 prior to interlocking projections 250 being guided at about an angle Ω (e.g., 45° degrees) upward the tracks and further curved up to rotate flush valve cartridge 112 into proper position. If linear, portions 282 of tracks 252 did not have sufficient lengths 280, flush valve cartridge 112 would not be moved to sufficient depth to enable engagement of projections 284 with recesses 136 and 138 of closure mechanism 128 and would not be able to properly seal valve seat support 286 of main body 118. As indicated above, lengths 280 of linear sections 282 varies commensurate with variations in elevations 264 of projections 250.

While being inserted through linear portion 282 of tracks 252, lower set of engagement sections 284 of flush valve cartridge 112 interlock with first and second notches 136 and 138 of closure mechanism 128 (similar to a key-lock combination), rotating closure mechanism 128 from a closed position to open position while flush valve cartridge 112 is rotated due to track 252 rotating routes to final position.

Flush valve cartridge 112 is prevented from further motion when interlocking projections 250 reach final ends 278 of interlocking guide tracks 252, with flush valve cartridge 112 being properly positioned, orientated, and aligned in relation to main body 118 at the final ends 278.

Figure 10A:
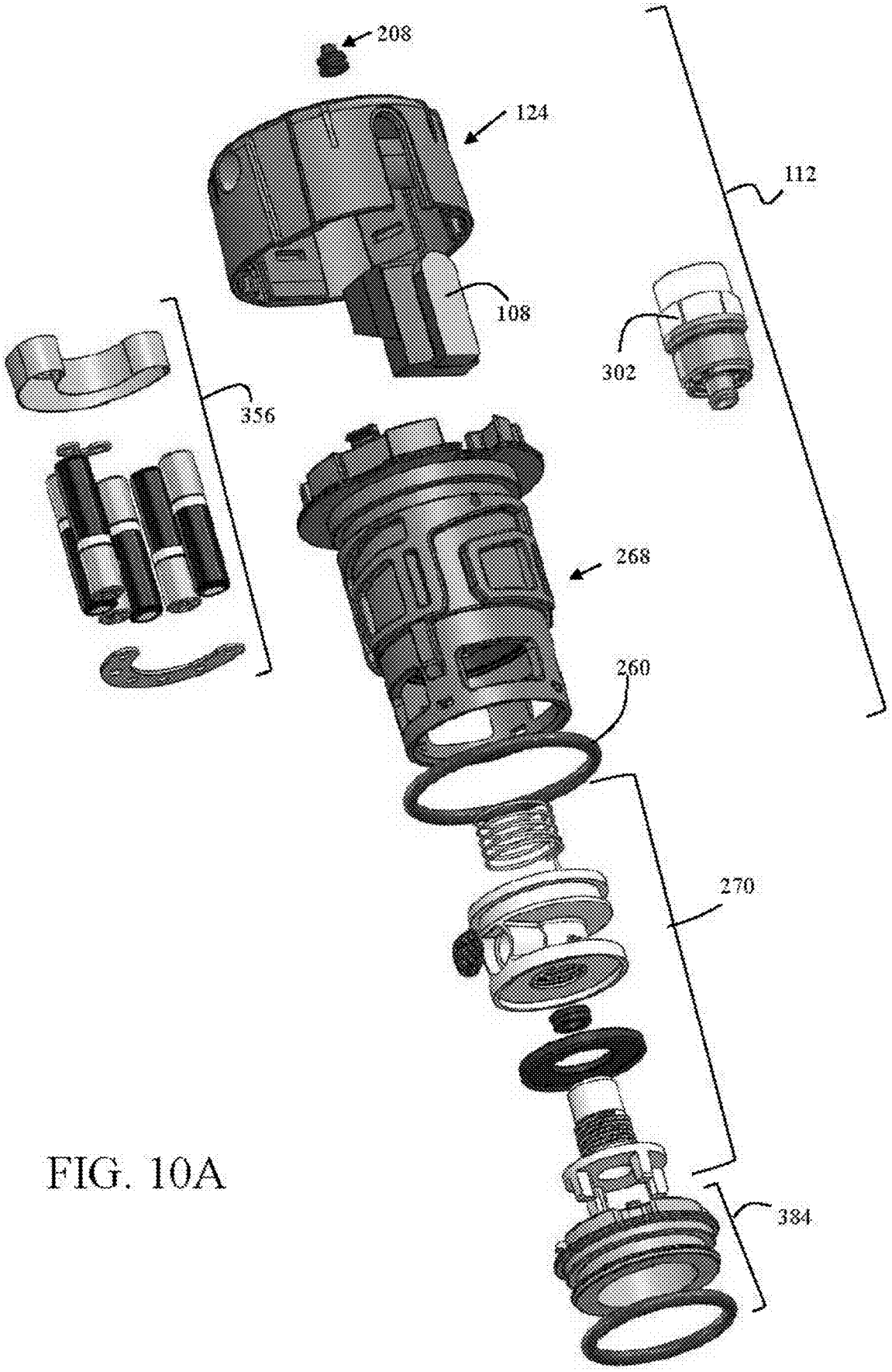
FIGS. 10A to 10C are non-limiting exemplary exploded views illustrations of the various components accommodated within the flush valve cartridge in accordance with one or, more embodiments of the present invention.
Figure 10B:
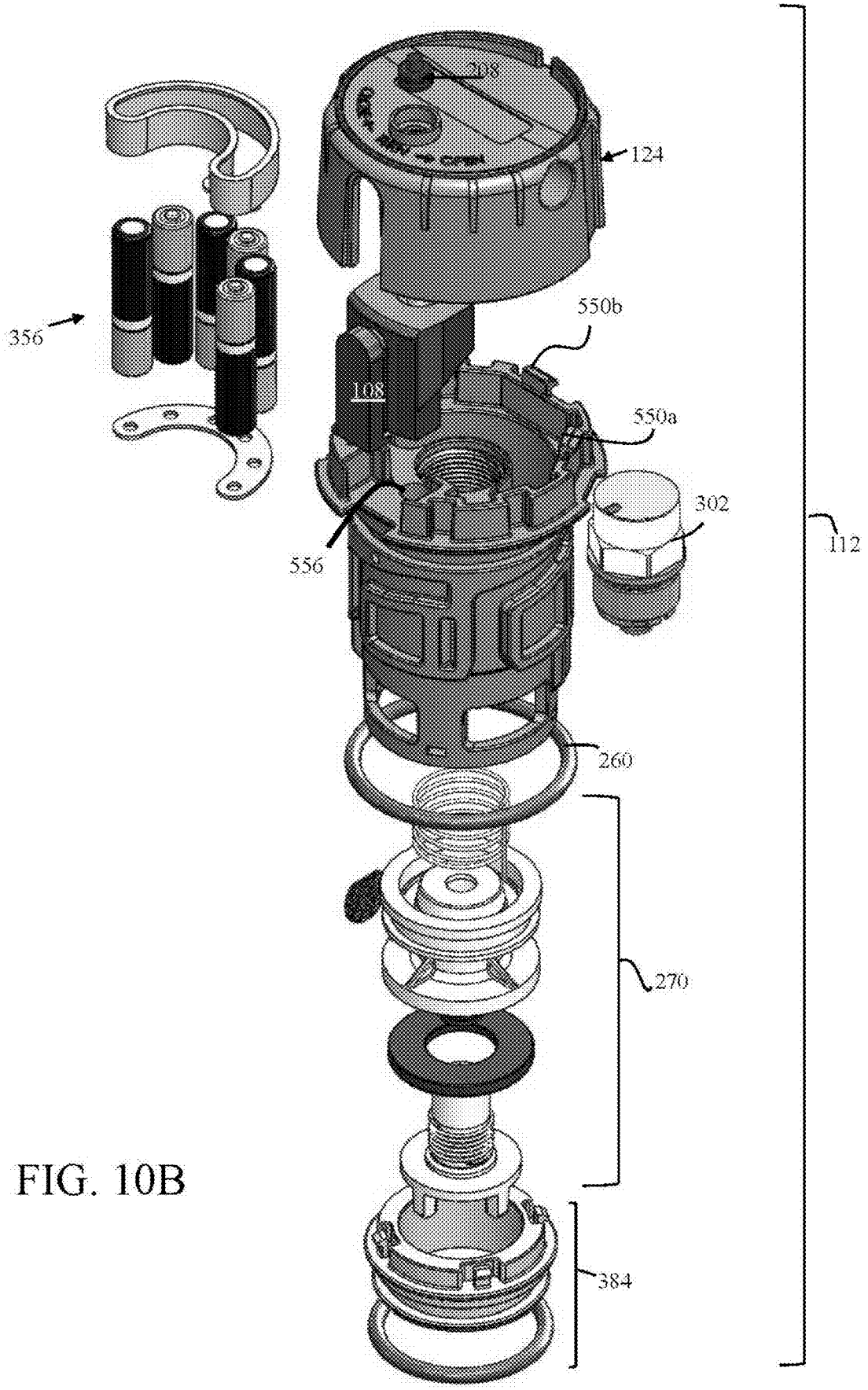
Figure 10C:
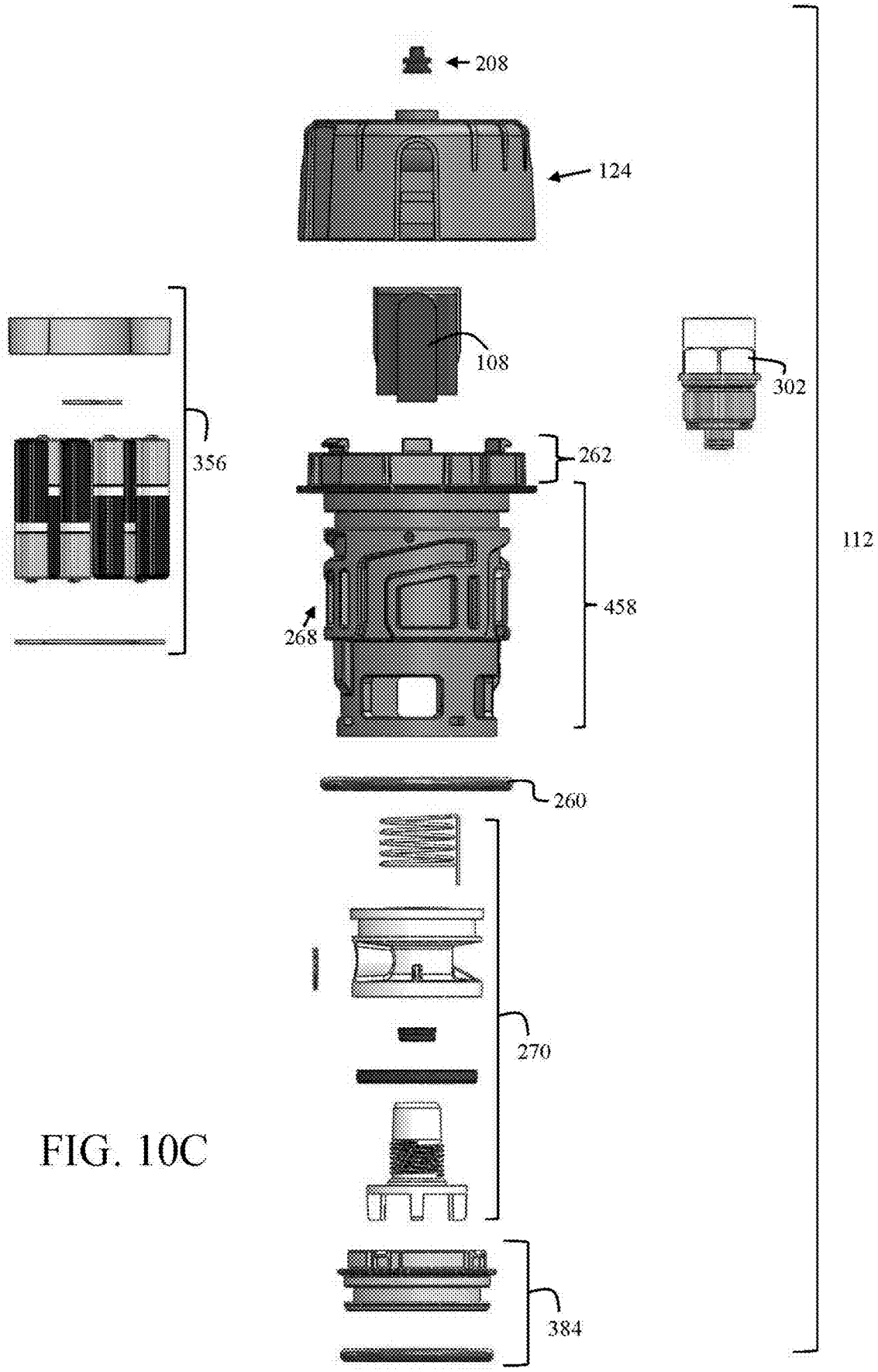

FIGS. 10A to 10C are non-limiting exemplary exploded views illustrations of the various components accommodated within the flush valve cartridge in accordance with one or more embodiments of the present invention. The exploded views shown in FIGS. 10A to 10C illustrate disassembled, separated components that show the cooperative working relationship, orientation, positioning, and exemplary manner of assembly of the various components of flush valve cartridge 112 in accordance with one or more embodiments of the present invention, with each component detailed below.

The present invention uses conventional IR sensor 108 as an integral part of flush valve cartridge 112 that enable automatic operation of the flush valve, and is integrally packaged within cartridge 112. In rare instances, IR sensor 108 accommodated in cartridge 112 may optionally be adjusted (or calibrated) if need be for proper operation of flush valve in a well-known conventional manner. Non-limiting examples of calibrations may include modifications of parameters such as the distance to be set to detect an object, flush duration, volume of water dispensed or discharged, etc.

Figure 11A:
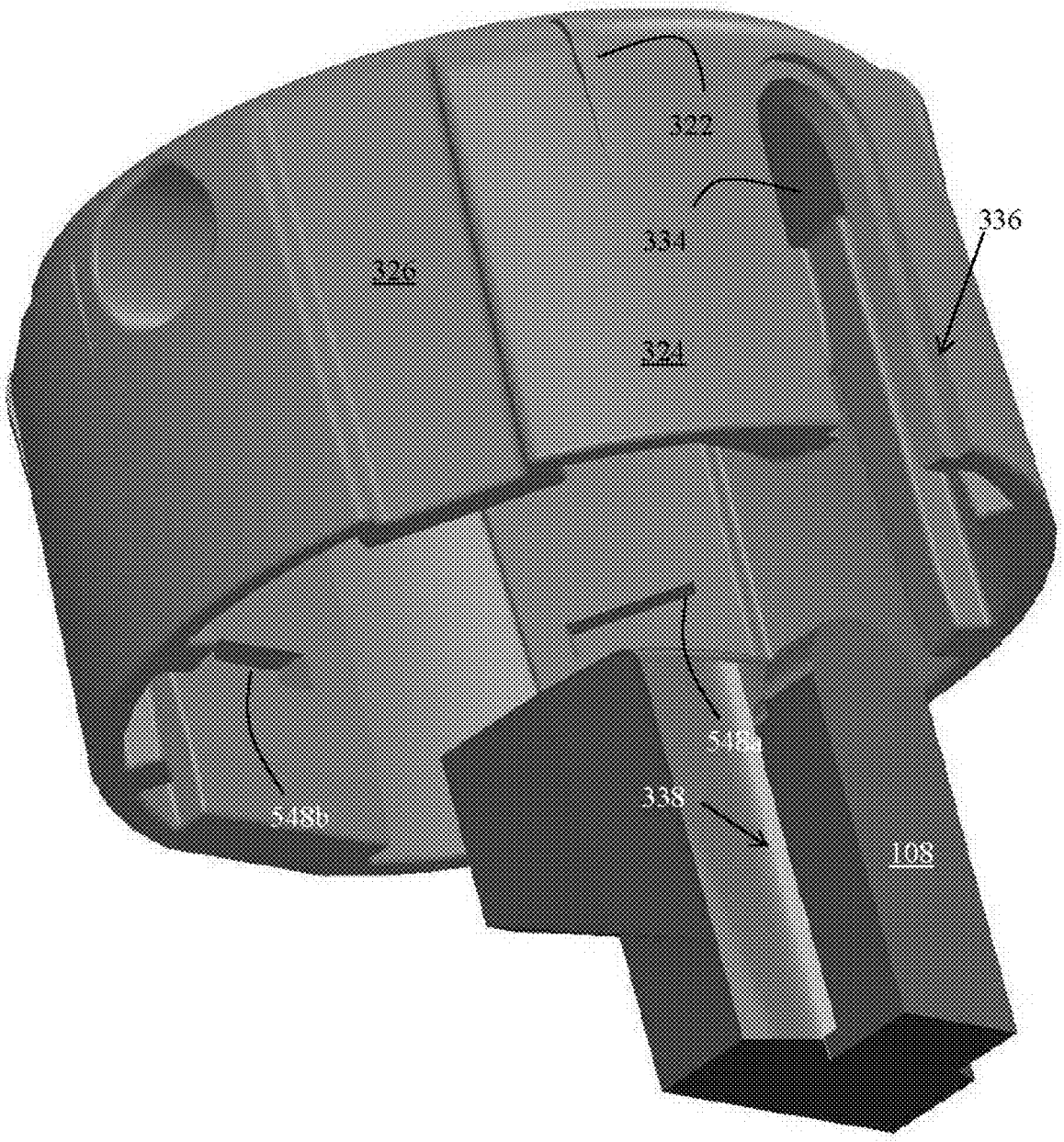
FIGS. 11A to 11C are non-limiting, exemplary illustrations of a cartridge cap of a flush valve cartridge of the flush valve assembly illustrated in FIGS. 1A to 10C in accordance with one or more embodiments of the present invention.
Figure 11B:
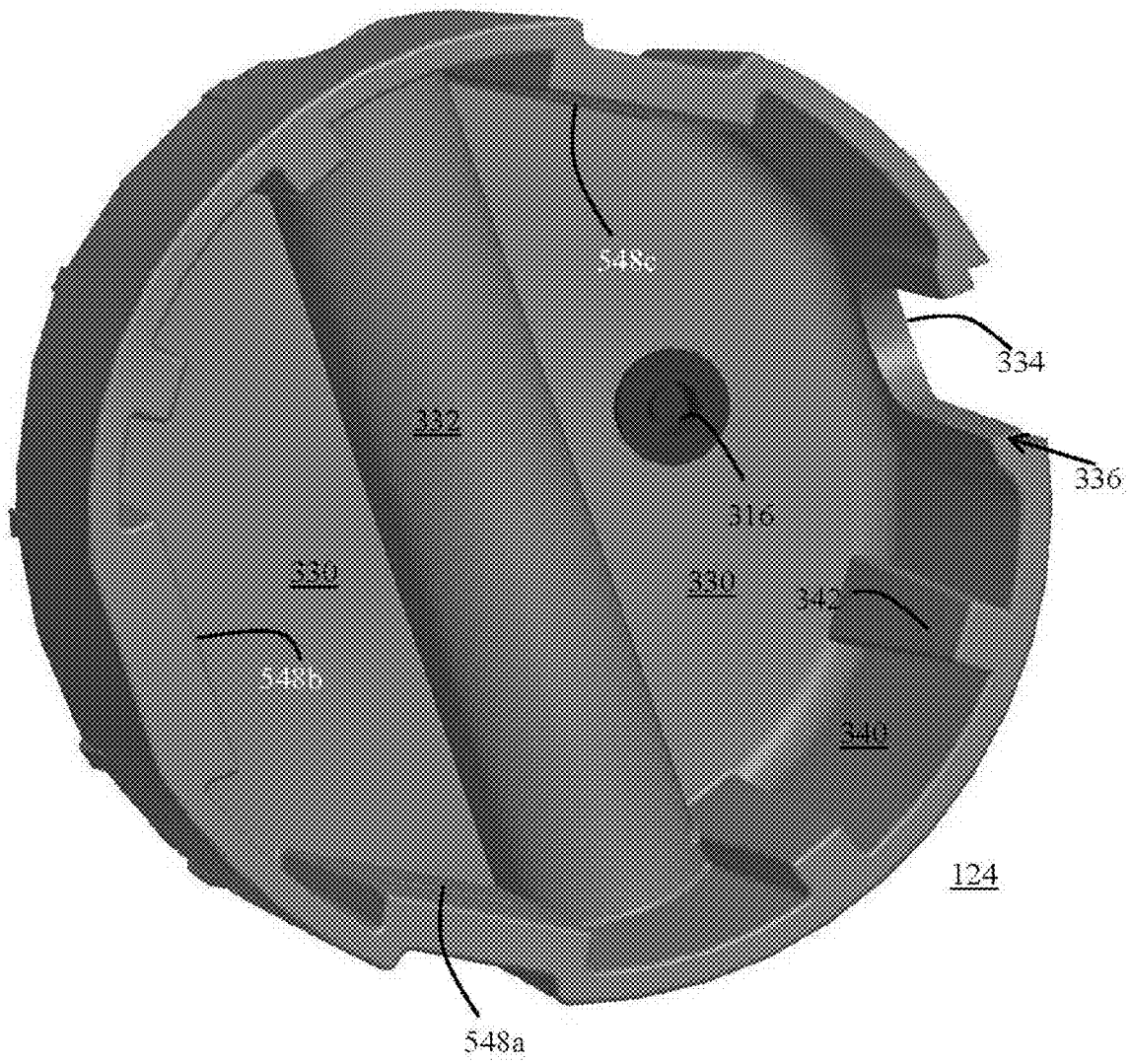
Figure 11C:
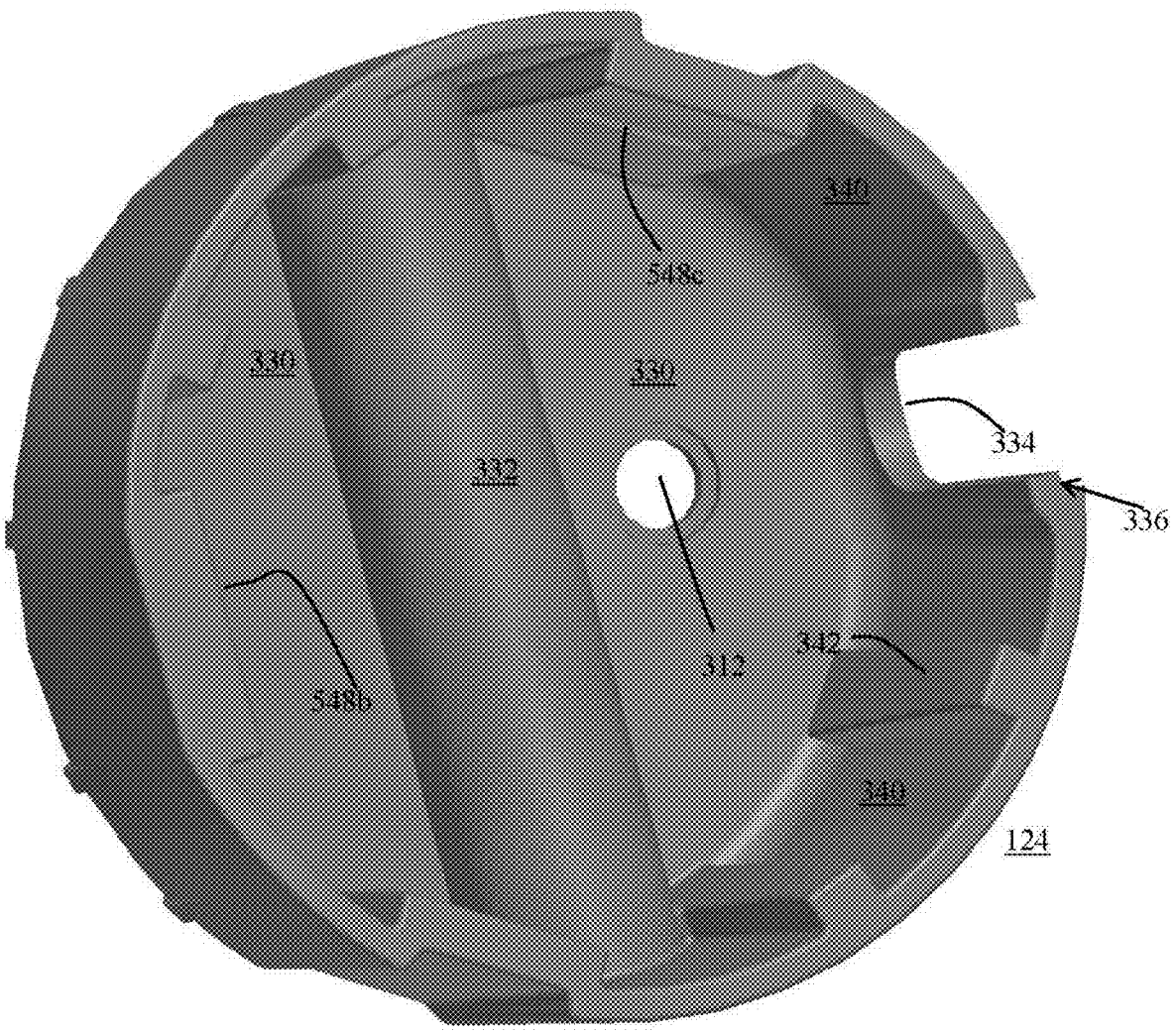

FIGS. 11A to 11C are non-limiting exemplary illustrations of a cartridge cap of a flush valve cartridge of the flush valve assembly illustrated in FIGS. 1A to 10C in accordance with one or more embodiments of the present invention. As illustrated in FIGS. 1A to 11C, cartridge cap 124 includes a top outer surface 304 (best shown in FIG. 9A) that is slanted (or beveled) at an angle α away from a secondary actuator 208 and sensor 108 for proper drainage of any potential water leakage.

Top outer surface 304 of cartridge cap 124 further includes a periphery wall 306 with an opening 308 at lowest slanted elevation 310 of top outer surface 304, to enable draining of water away and off of top outer surface 304. If water somehow accesses the flush valve from top, the water will be channeled away from internals of flush valve cartridge 112 and drain thought the back of flush valve assembly 100 via opening 308 and down channel 584. It should be noted that since water will drain out from back of flush valve assembly 100, any potential stains on exterior of valve body would be inconspicuous from the front part, which is visible to users.

Top outer surface 304 further includes an opening 312 (best shown in FIG. 11C) with a protruded rim 314 through which a plunger 316 of secondary actuator 208 is extended. The protruded rim 314 (which may further receive and house a sealing member such as an O-ring) prevents water from draining through opening 312.

Figure 12A:
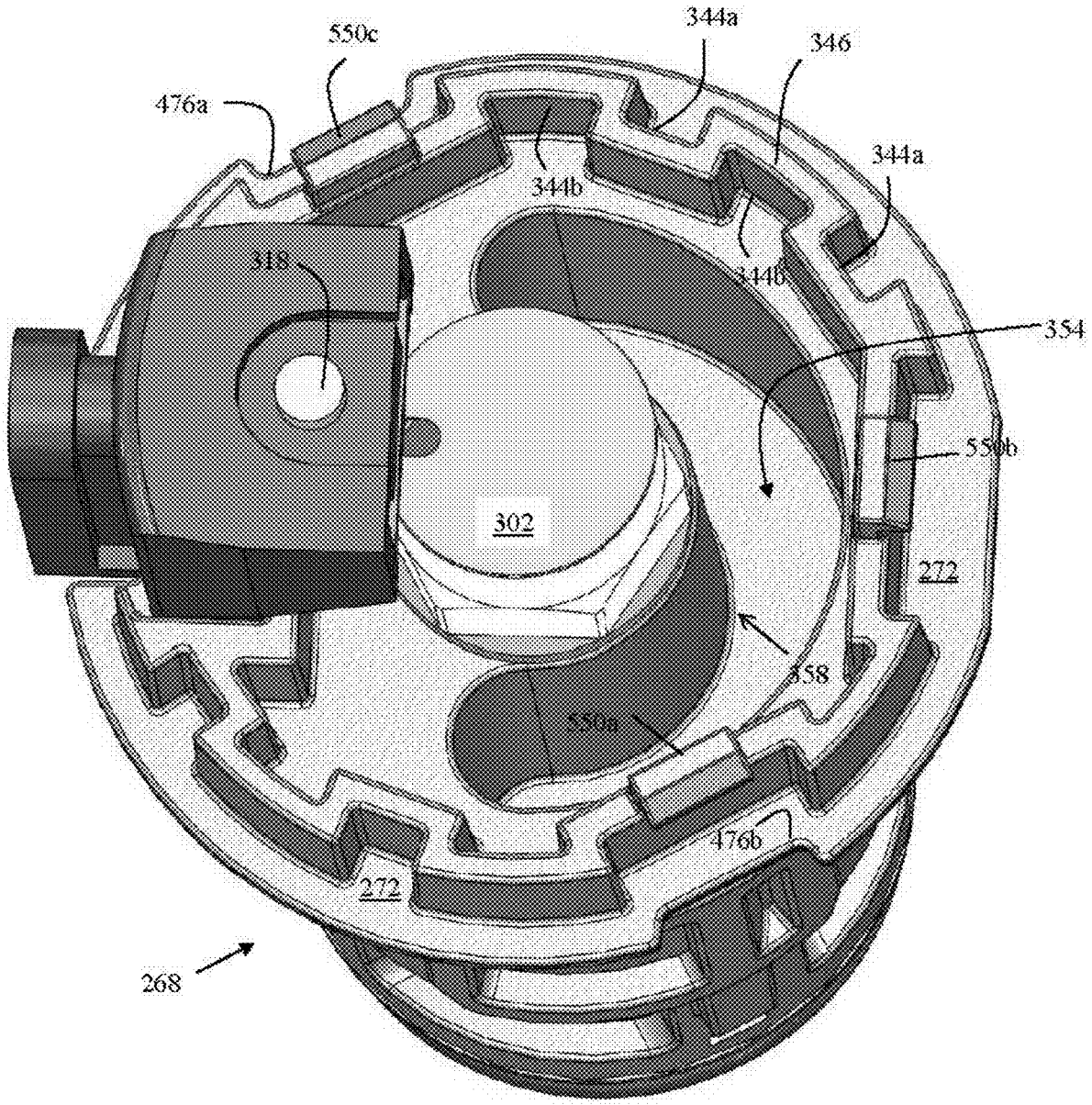
FIGS. 12A to 12G are non-limiting, exemplary illustrations of a cartridge body of the flush valve cartridge of the flush valve assembly illustrated in FIGS. 1A to 11C in accordance with one or more embodiments of the present invention.

Secondary actuator 208 is manually operated by primary actuator 110, with the secondary, actuator 208 actuating an electro-mechanical plunger switch 318 (best shown in FIG. 12A). The closure of the electro-mechanical plunger switch 318 powers solenoid 302 (via a conventional program/firmware within sensor 108) to commence flushing. That is, as further detailed below, to bypass direct sensory 108 operations for flushing, a user may instead press onto primary actuator 110, which in turn, compresses secondary actuator 208, which in turn, presses down electrical plunger (not shown, but well known) of electro-mechanical plunger switch 318 to power solenoid 302 (via firmware within sensor 108) to commence flushing. It should be noted that the well-known conventional program/firmware within sensor 108 maintains activation of solenoid 302 for the same adjusted flush period as when solenoid 302 is activated directly by sensor 108 only.

Cartridge cap 124 further includes axially extending fins 322 (FIG. 9A) along outer lateral side 324 of cartridge cap 124 to provide a better fit with cover 116, especially between a cartridge cap 124 (which may comprise of plastic material) against cover 116 (which may comprise of brass or other metals including non-metallic material such as plastic).

Figure 2G:
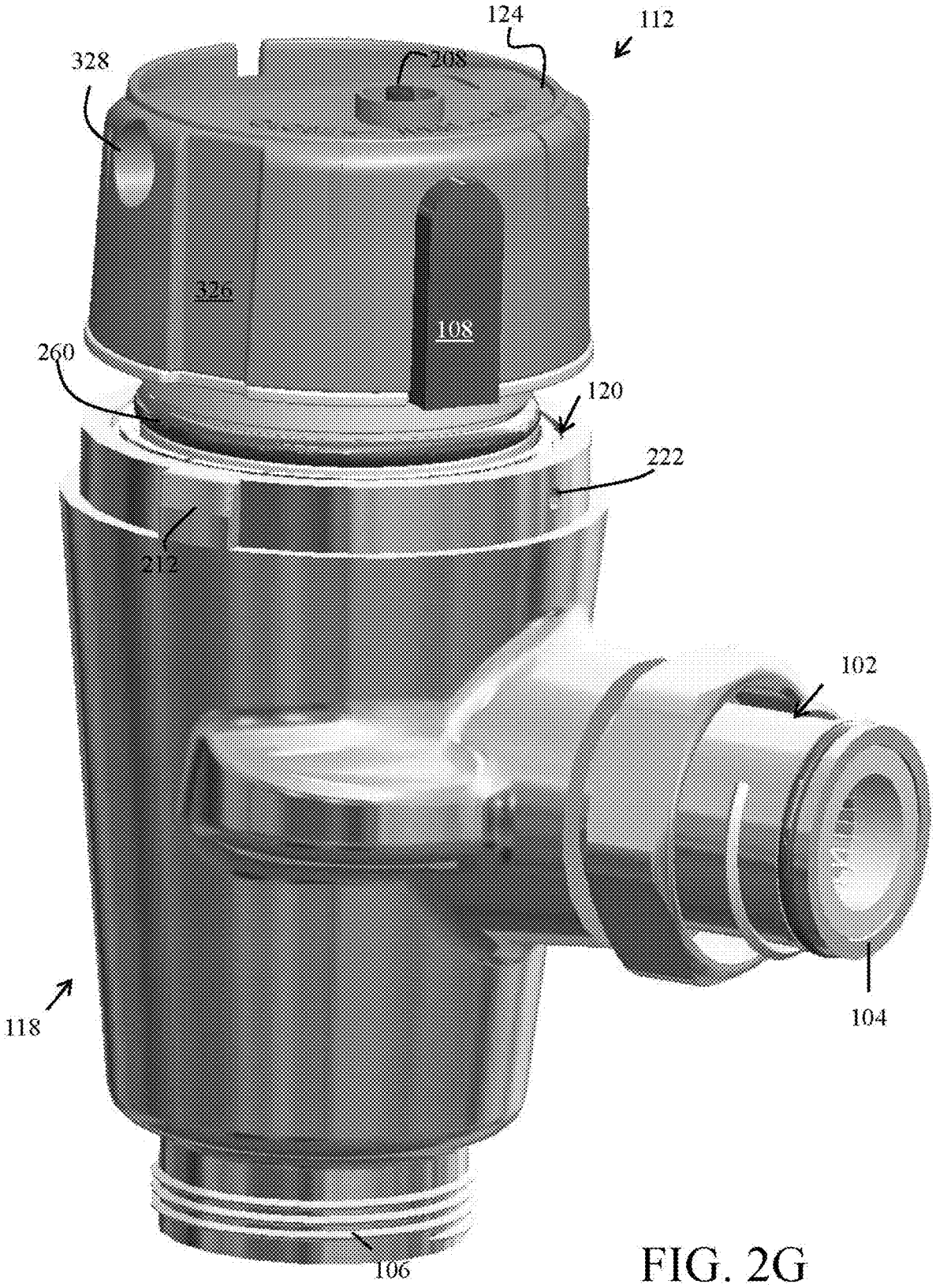
Figure 2H:
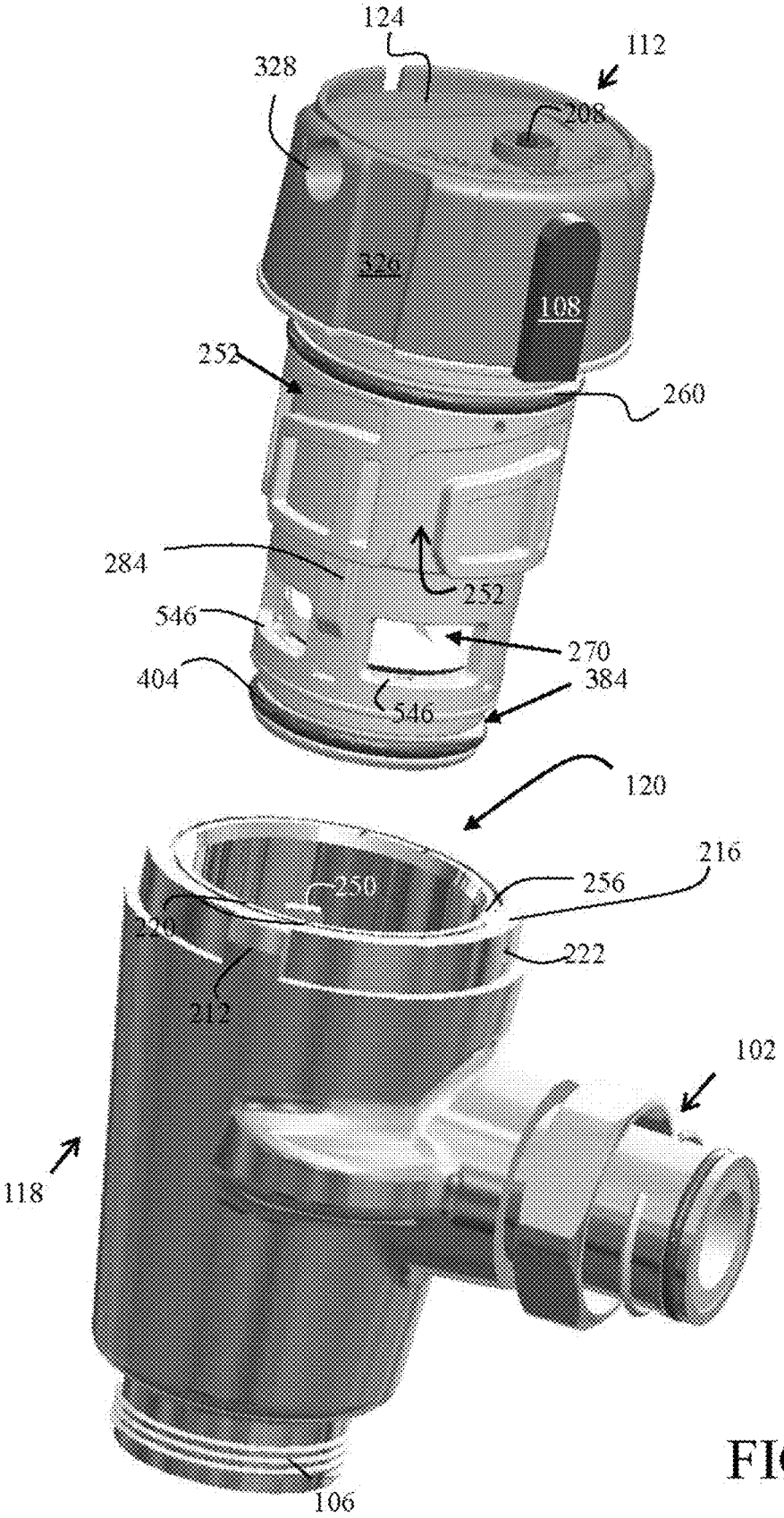

Cartridge cap 124 includes axially extending indexing grooves 326 along lateral side 324 of cartridge cap 124 to facilitate in proper mounting of cartridge cap 124 onto flush valve cartridge body 268. That is, grooves 326 are indexing, features which when aligned with indexing extensions 212 of main body 118 (as shown in FIGS. 2G and 2H) indicate proper alignment of initial insertion position for inserting cartridge 112 into main body 118.

Cartridge cap 124 further includes a transversely oriented through opening (or orifice) 328 through lateral side 324 of cartridge cap 124. The through opening 328 lead to a "tunnel" 332, which is used to insert a rigid tool such as screwdriver or a bar or a rod (if needed) to aid in twisting the entire flush valve cartridge 112 into or out of main body 118 (shown in FIG. 2B). It should be noted that the formed "enclosed tunnel" 332 at the underside 330 of cartridge cap 124 also functions to prevent flow of water to inside (dry-side) of flush valve cartridge 112, and hence, the reason for an enclosed tunnel 332 with end openings 328 at exterior of cartridge cap 124.

Further included is an axially oriented sensor opening 334 along lateral side 324 of cartridge cap 124 that enables sensor 108 to extend out from cartridge cap 124. Sensor opening 334 includes a periphery comprised of a continuous stepped projection 336 that engages a recessed or grooved portion 338 of sensor 108.

As, further illustrated in FIGS. 11A to 11C, an underside 330 of cartridge cap 124, at the bottom or underside of top side surface 304 includes tunnel 332 that defines the transversely oriented through-opening 328. Interior side 340 of lateral side 324 of cartridge cap 124 includes a set of stiffener ribs 342 that also function to engage (or interlock) with corresponding set of exterior facing grooves or recess 344*a* of an engagement wall 346 that extends from a dry-side 262 (detailed below) of a base-seat 272 of flush valve cartridge 112.

Interior wall side 340 of cartridge cap 124 further includes a set of recesses or notches 548*a,b,c* (behind three exterior sections 326) that receive hook-like couplers 550*a,b,c* (FIG. 12A, detailed below) of cartridge body 268 to further secure cartridge cap 124 onto cartridge body 268, in addition to use of adhesives or sonic welding, etc. of cap 124 onto body 268.

It should be noted that flush valve cartridge 112 may be made serviceable or none-serviceable. For example, if made none-serviceable, then above-mentioned adhesion methods of cap 124 onto body 268 may be used not only for structural and water proofing purposes, but also to deny access for service, for maintenance, or for battery replacement of flush valve cartridge 112.

One aspect of the embodiments of the present invention is that it is preferable that flush valve cartridge 112 be replaced when the batteries have been, spent. This replacement aspect maintains the entire flush valve system "new" and properly operational.

In the event that the cartridge is made none serviceable to prevent access for service, fixed bonding, must be used at two points. The first bonding point is that cartridge cap 124 must be fixed-bonded onto cartridge body 268. The second bonding point fixed-bonding main valve seat 384 to flush valve cartridge 112.

Figure 12B:
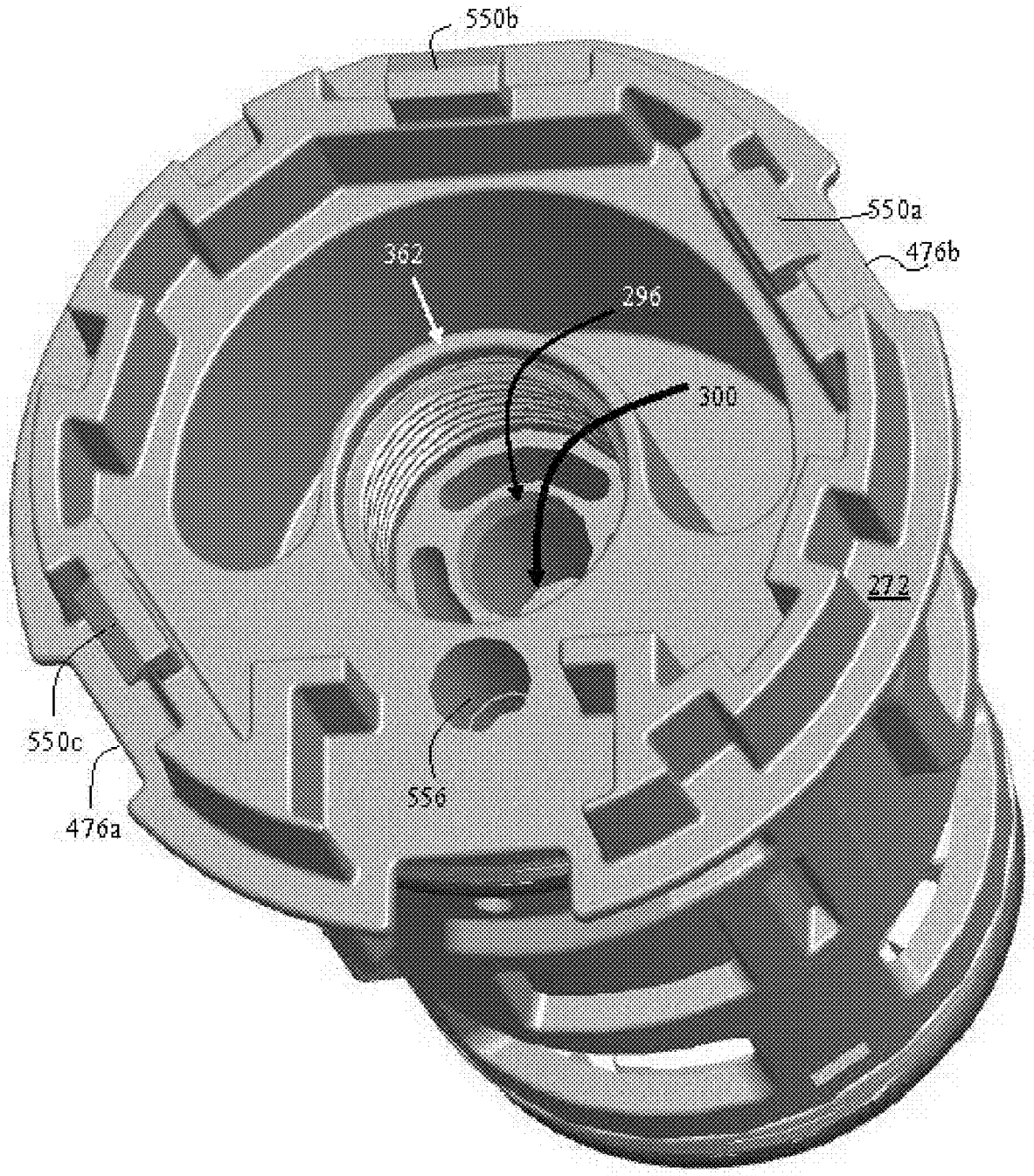
Figure 12C:
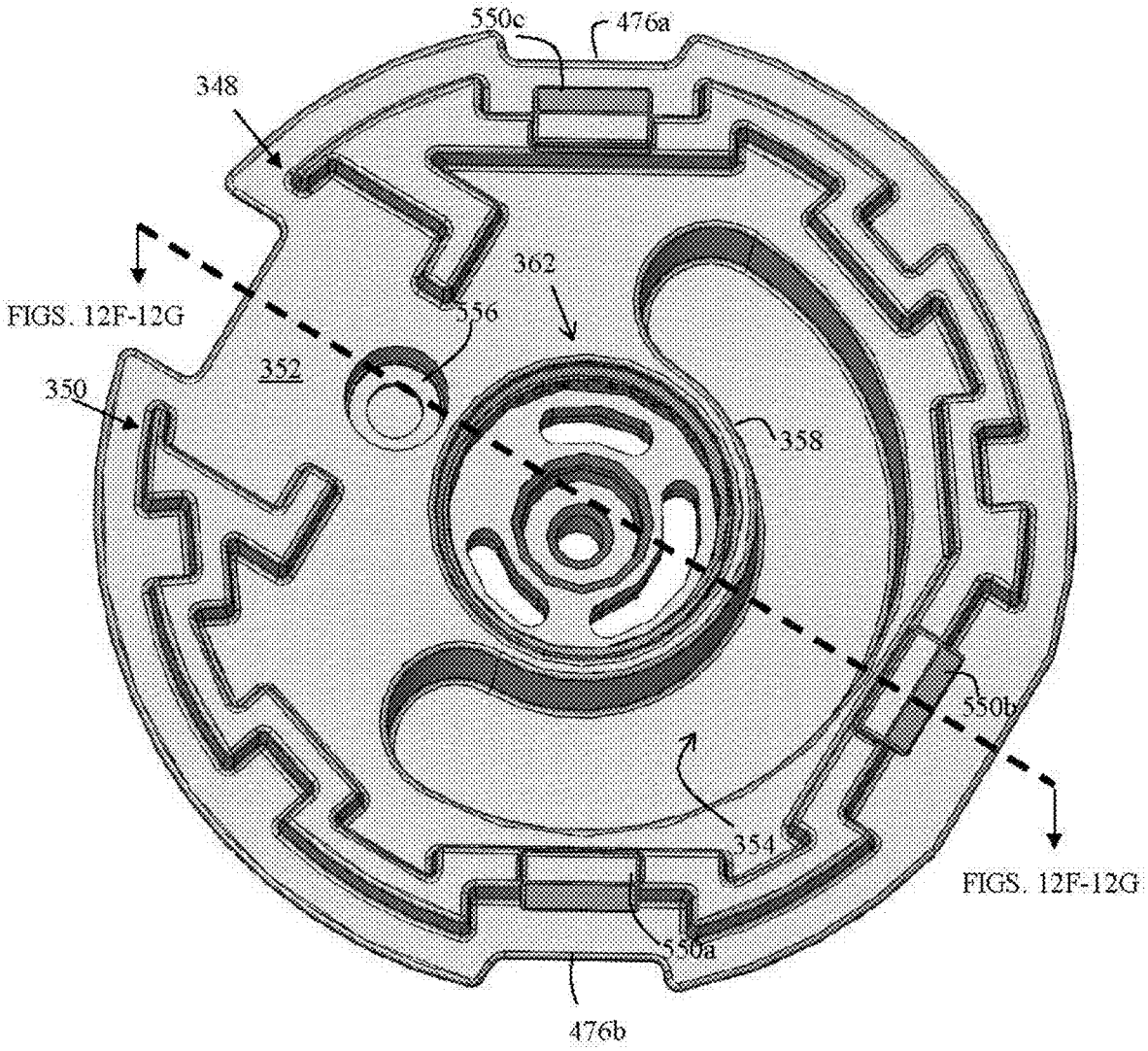
Figure 12D:
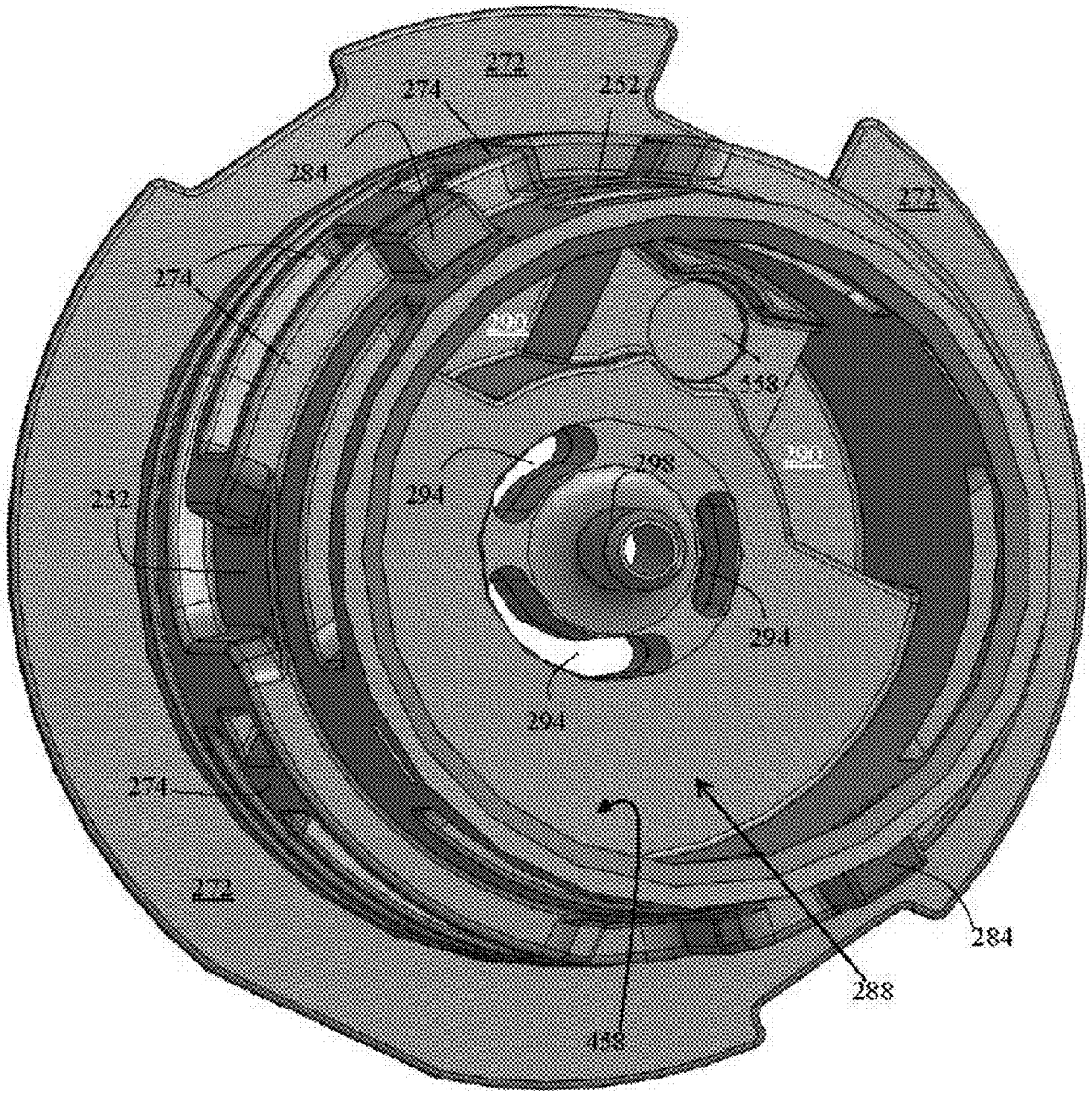
Figure 12E:
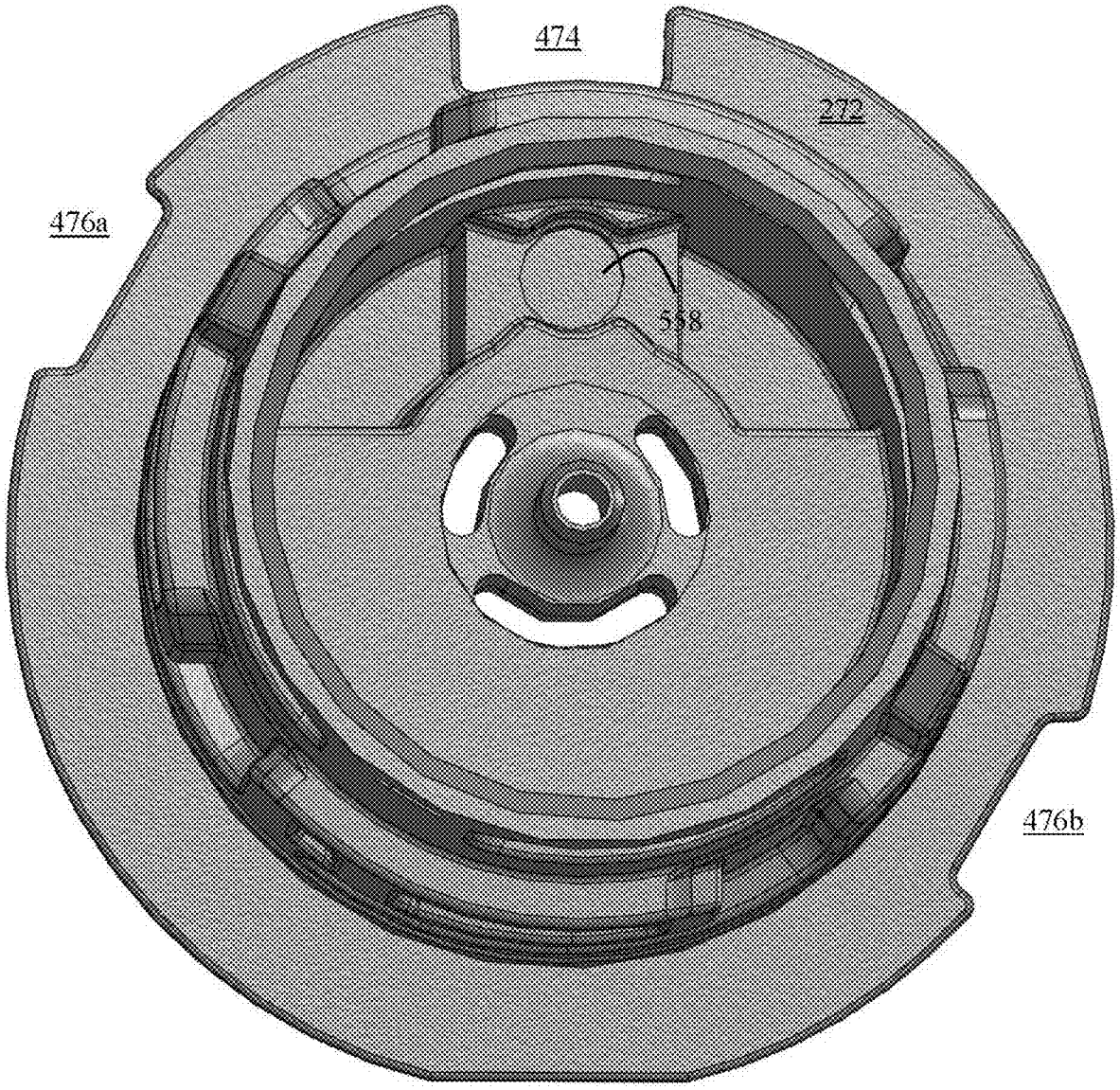
Figure 12F:
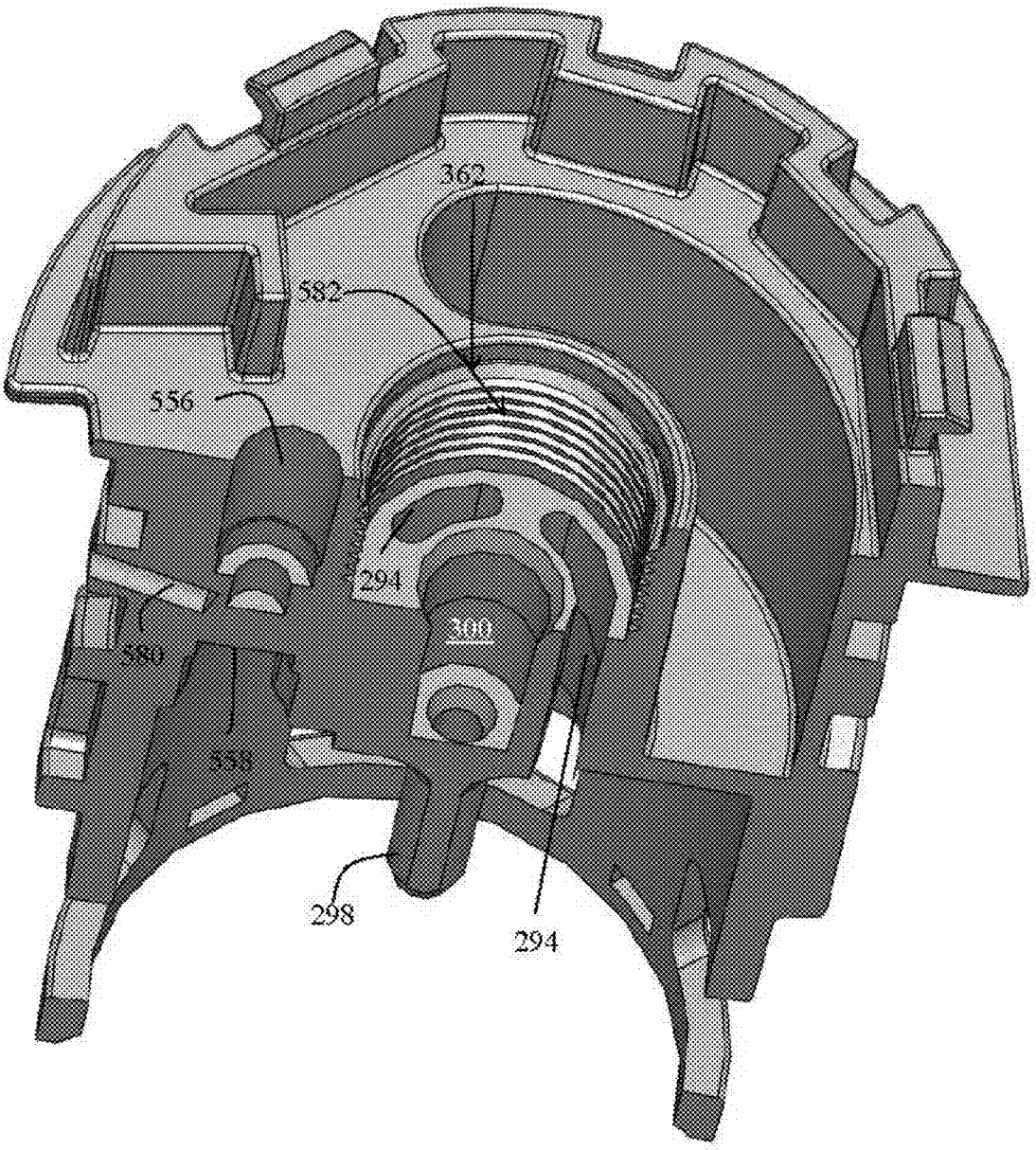
Figure 12G:
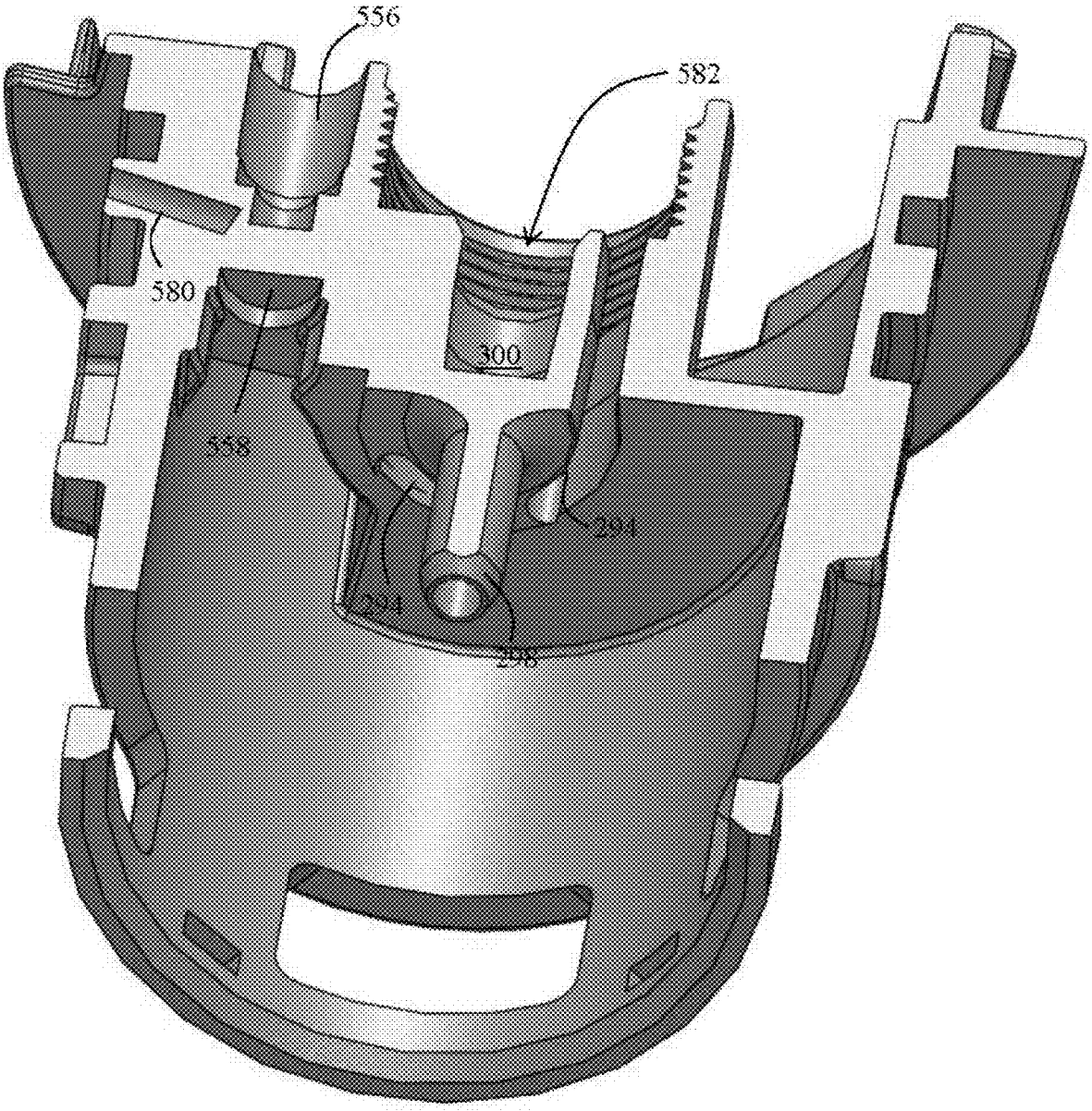
Figure 13A:
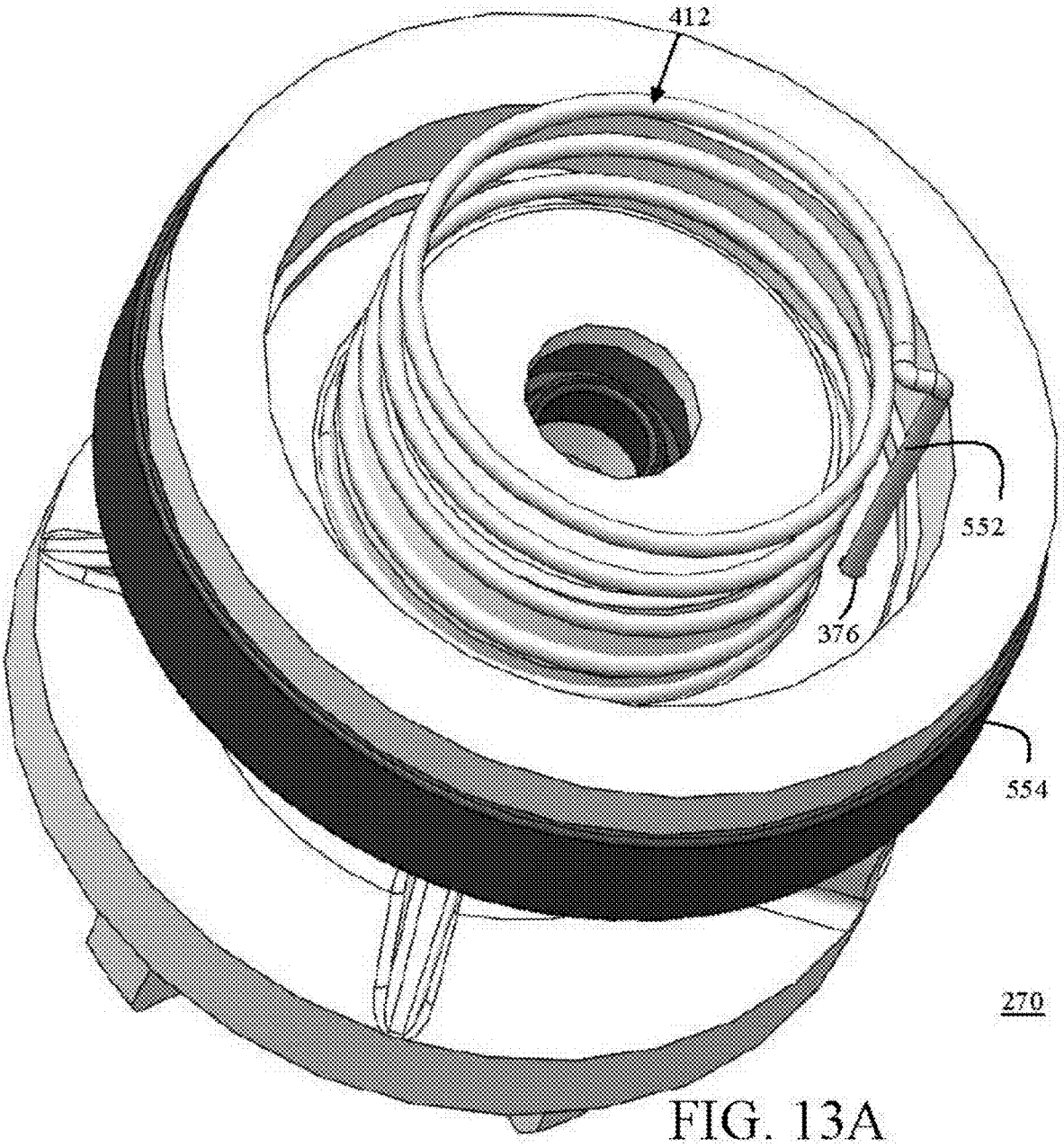
FIGS. 13A to 13F are non-limiting, exemplary illustrations of a piston of a flush valve cartridge of the flush valve assembly illustrated in FIGS. 1A to 12G in accordance with one or more embodiments of the present invention.
Figure 13B:
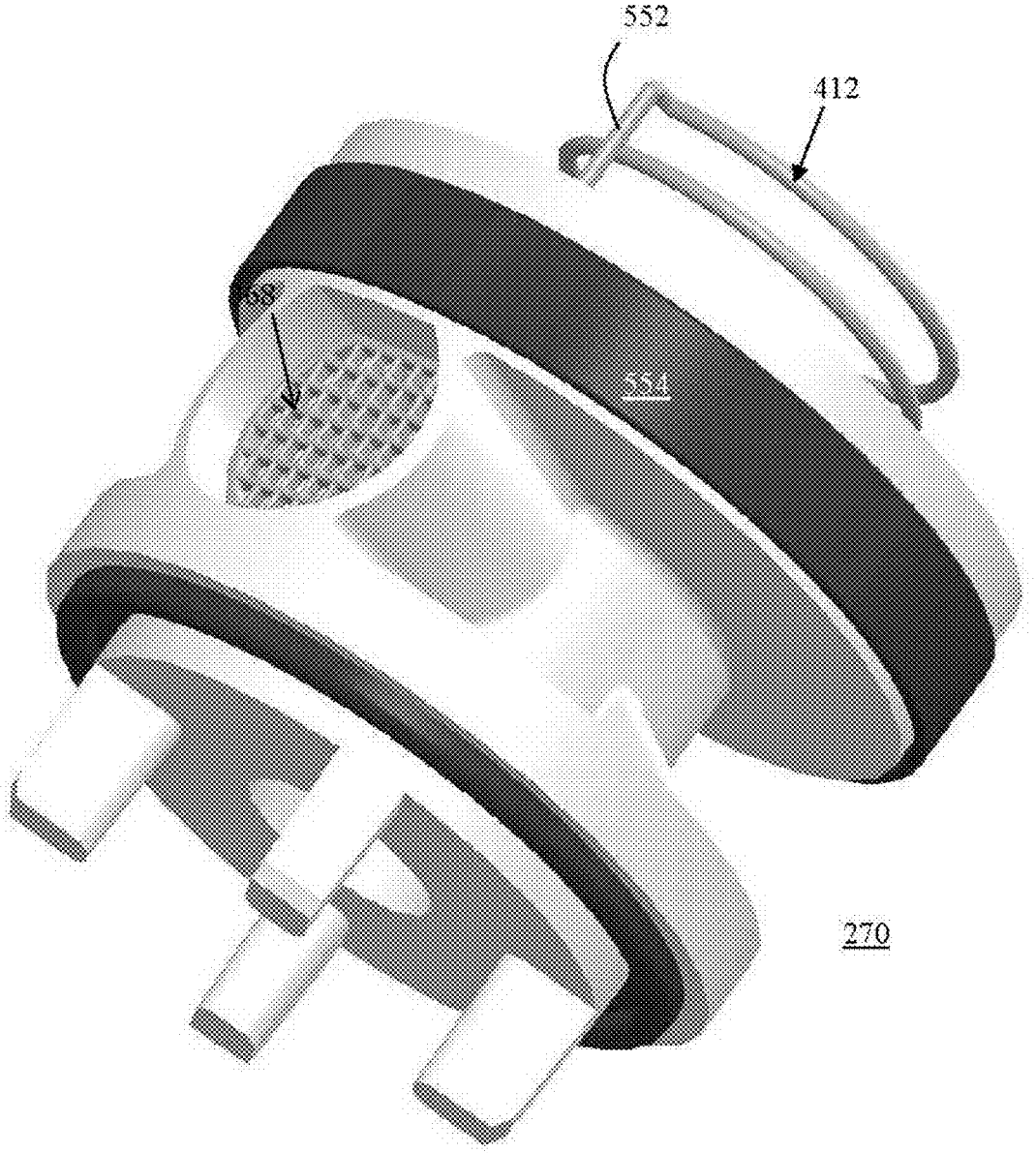
Figure 13C:
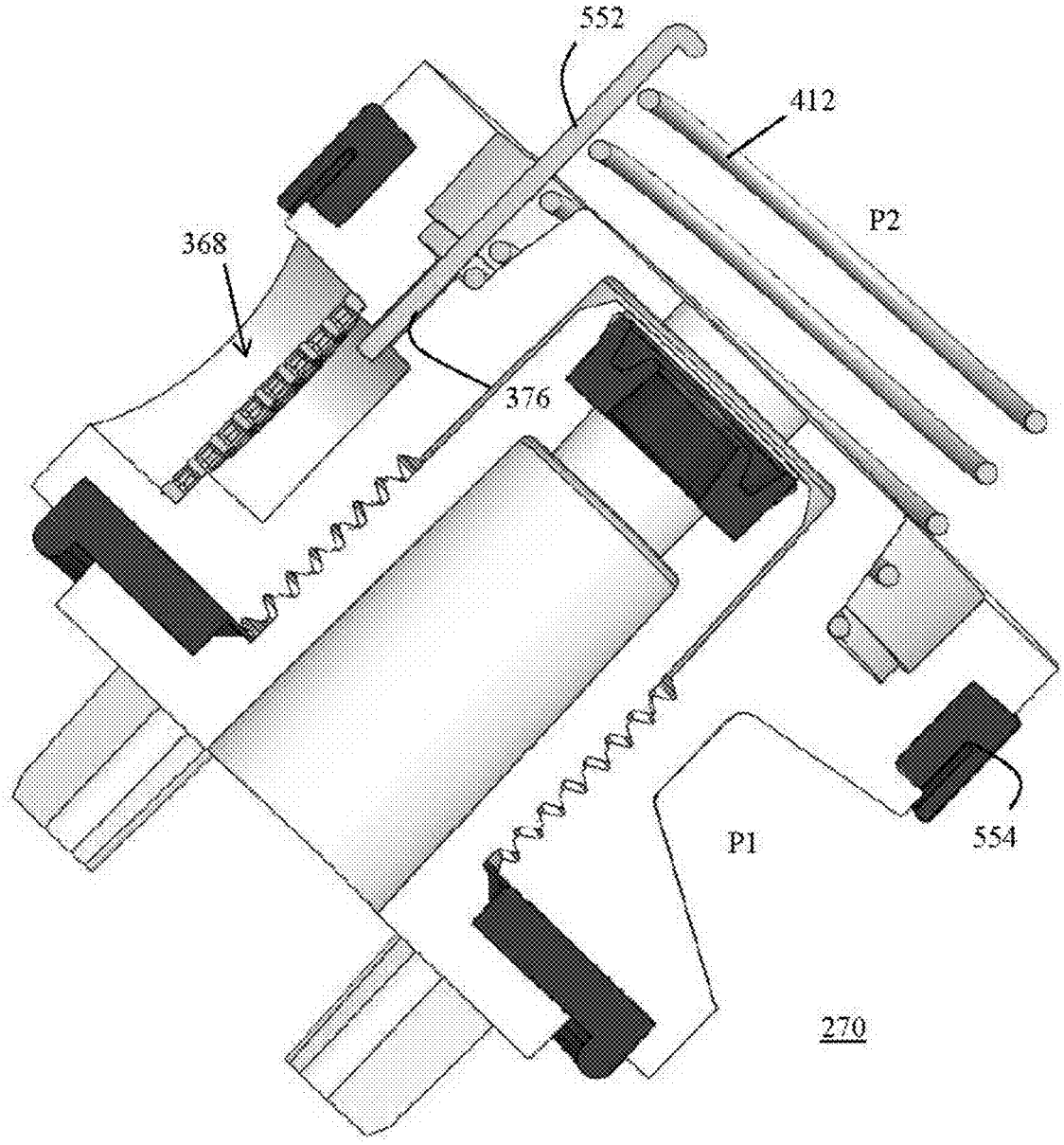
Figure 13D:
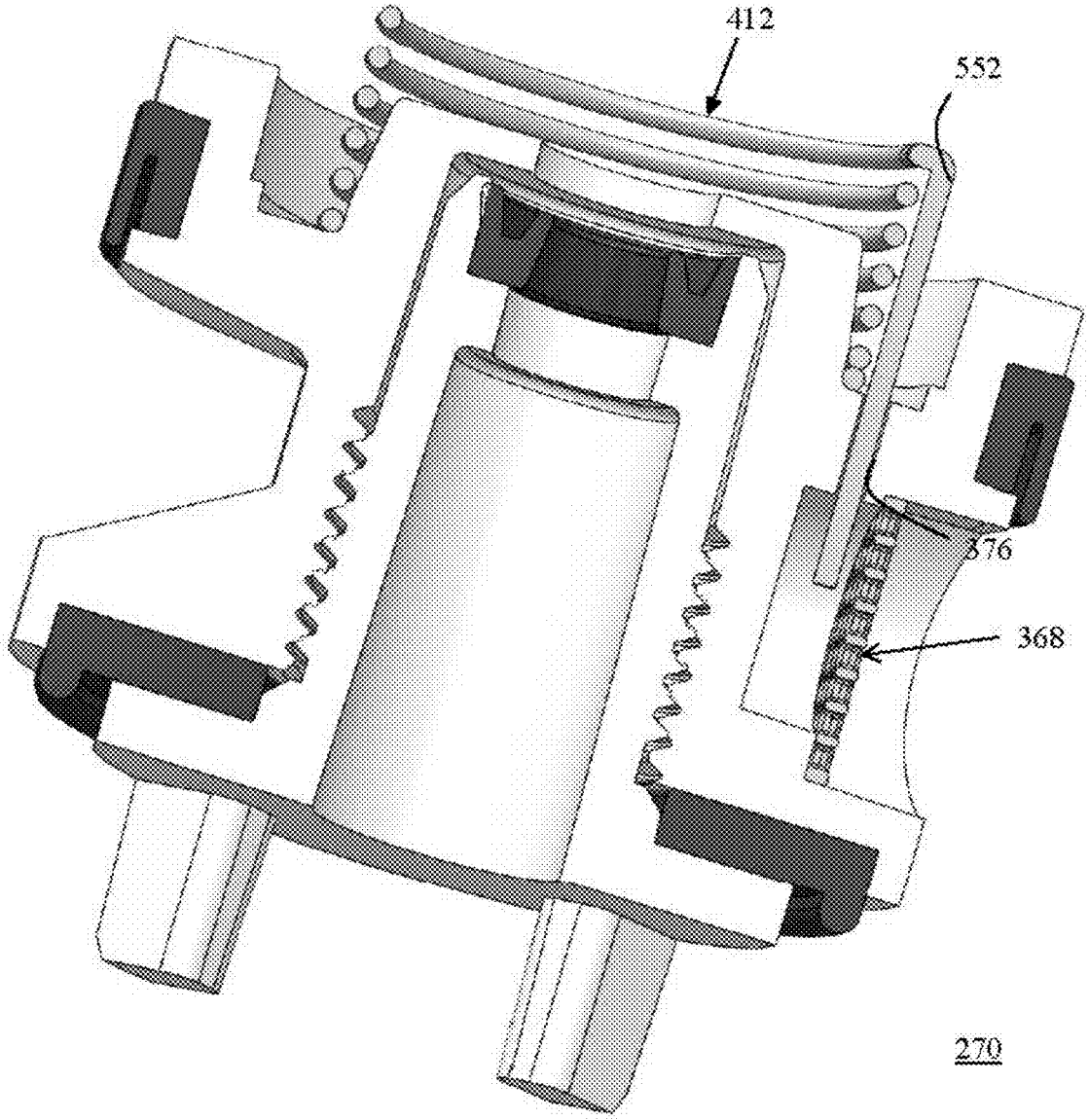
Figure 13E:
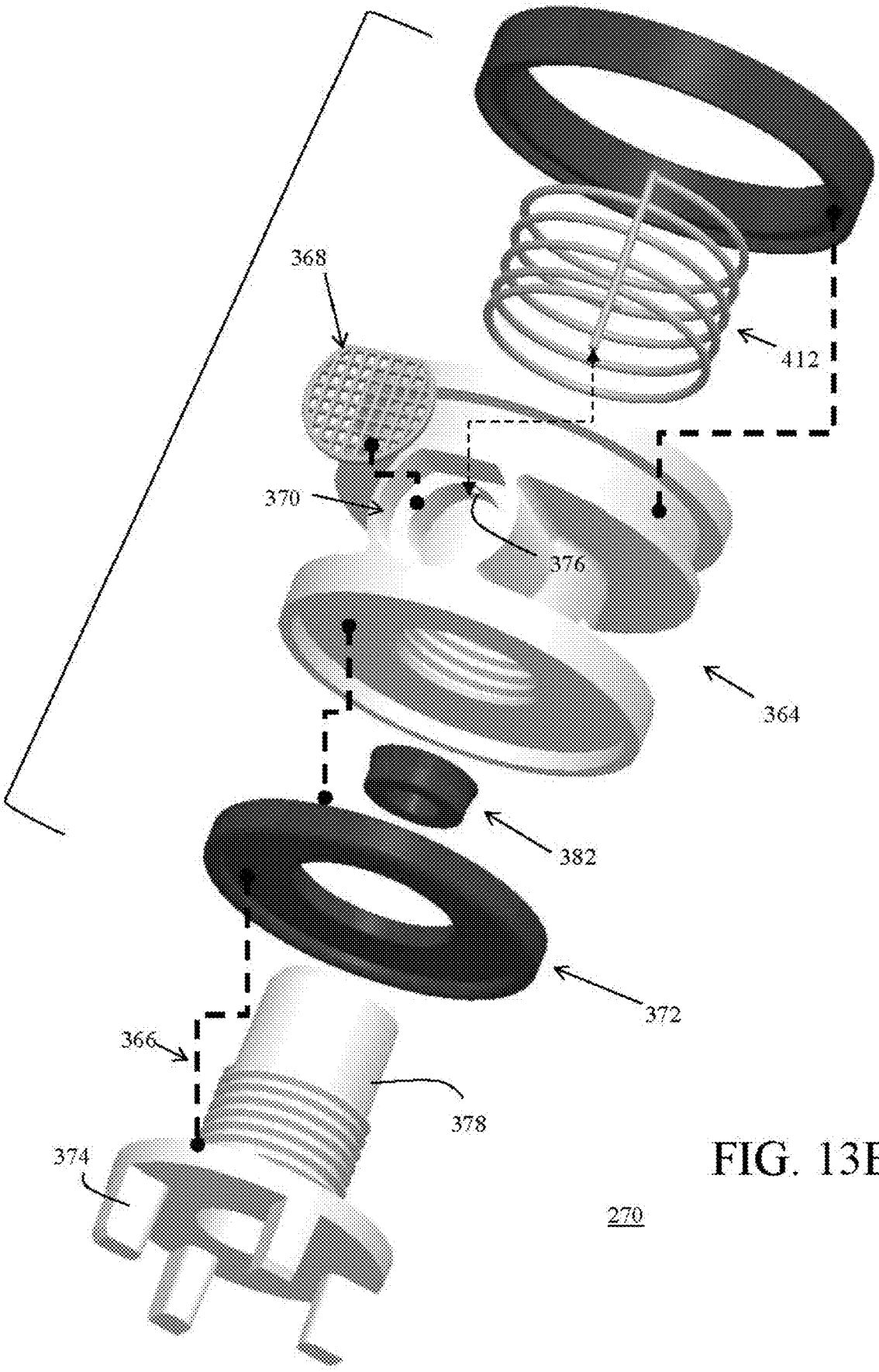
Figure 13F:
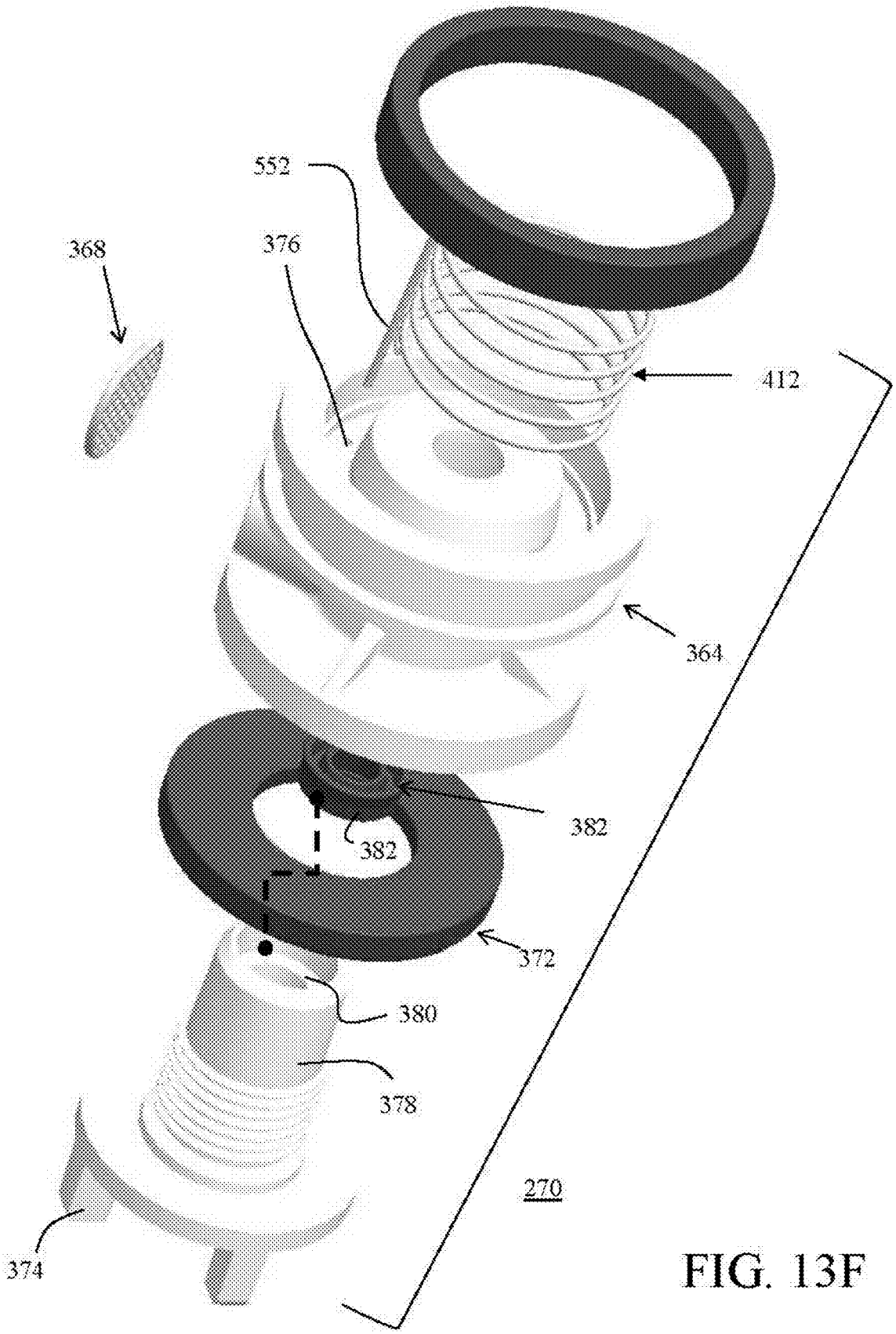

FIGS. 12A to 12C are non-limiting, exemplary illustrations of a top, dry-side of a cartridge body of the flush valve cartridge of the flush valve assembly illustrated in FIGS. 1A to 11C in accordance with one or more embodiments of the present invention. FIGS. 12D to 12E are non-limiting, exemplary illustrations of a bottom, wet-side of a cartridge body of the flush valve cartridge of the flush valve assembly illustrated in FIGS. 1A to 12C in accordance with one or more embodiments of the present invention. FIGS. 12F and 12G and top view and bottom cross-sectional views of the flush valve cartridge of the flush valve assembly illustrated in FIGS. 12A to 12E.

As detailed below, a single mold may be used to manufacture flush valve cartridge body 268. That is, flush valve cartridge body 268 is molded to include features for electronic (or auto flush) operations (including electronic manual operations where sensory module 108 is bypassed), and mechanical, manual operations that may include an actual mechanical plunger switch.

As illustrated, flush valve cartridge 112 is molded to include a flange extending transversally from the cartridge body 268, forming base-seat 272 of generally annular disc.

Base-seat 272 seats flush valve cartridge 112 within main body 118, separating dry-side 262 of the flush valve cartridge 112 from a wet-side 458 (generally shown in FIG. 10C). Dry-side 262 is the general space under cartridge cap 124 but above base-seat 272.

Cartridge body 268 has a base-seat 272 that includes notches 474, and 476*a* and 476*b*. Notch 474 accommodates a lower edge of sensor 108 while notches 476*a/b* are for indexing that match cover index grooves 326. Lower edge of sensor 108 is flush with bottom side of flange 272.

Further included is engagement wall 346 that extends from base-seat 272 of flush valve cartridge 112. Engagement wall 346 includes a set of exterior facing recesses 344*a* for engaging with a set of stiffener ribs 342 of an, interior 340 of lateral side 324 of cartridge cap 124.

It should be noted that the irregular configuration of engagement wall 346 with exterior/interior facing recesses 344*a*/344*b* further enhances the structural integrity of engagement wall 346 with respect to its overall strength. Engagement wall 346 includes distal end, structures 348 and 350 that form a support housing 352 for securing sensor 108.

Engagement wall 346 further includes hook-like couplers 550*a,b,c* that interlock with respective set of recesses or notches 548*a,b,c* (behind three exterior sections 326) of cartridge cap 124 to further secure cartridge cap 124 onto cartridge body 268, in addition to use of adhesives or sonic welding, etc, of cap 124 onto body 268.

Engagement wall 346 further provides protection against leakage of water into the dry-side 262 of base-seat 272. Dry-side 262 of cartridge body 268 includes a generally crescent shaped cavity 354 with inner wall 358 for housing a set of batteries 356.

It should be noted that in the non-limiting, exemplary instances for all of the embodiments disclosed, batteries 356 are non-rechargeable and generally last about a couple of years. When batteries 356 are drained of power and no longer operate, the entire flush valve cartridge 112 is simply replaced.

Replacing the entire flush valve cartridge 112 rather than just batteries 356 ensures that the flush valve assembly 100 will continue proper operations with an entirely new flush valve cartridge 112. It should further be noted that the circuit topography for batteries 356, solenoid 302, and sensor 108 for both the electrical and mechanical manually operated switching flush valves are very well known, including any required software schemes for proper flush operations such as timing of flush, duration of flush, etc.

As further illustrated, a solenoid valve seat 362 is provided on the dry-side 262 for securing solenoid valve 302. The structure of solenoid valve seat 362, including its offset surfaces, reliefs, various orifices, openings, etc. are well known. Accordingly, the operation of solenoid 302, and its control of flow of water to start and stop flush is well known and described below.

As further illustrated in FIGS. 12D to 12G (with all components removed from interior wet-side, generally indicated by reference 458 of flush valve cartridge 112 for clarity and discussion purposes), interior top end 288 is comprised of an offset surface 290. Further illustrated is the lower cavity (or blind-hole) 558 (detailed below).

Further included are three through-openings (elongated slits) 294 that lead to a solenoid housing 582. Additionally, included is an integral discharge tube or orifice 298 of cartridge body 268 that extends into an upper discharge chamber 300 in fluidic communication with solenoid chamber 296 (FIG. 16A) only when solenoid 302 is open. It should be noted that the manner and control of flow of water through these opening 294 and into solenoid chamber 296 and out the upper discharge chamber 300 and out of discharge tube 298 are well known and further detailed below. In this non-limiting, exemplary instance, the solenoid housing 582 has an inner threading to secure an external or outer threading of solenoid 302.

FIGS. 13A to 13F are non-limiting, exemplary illustrations of a piston of a flush valve cartridge of the flush valve assembly illustrated in FIGS. 1A to 12G in accordance with one or more embodiments of the present invention. As illustrated, piston 270 includes a first piece 364 and a second piece 366. First piece 364 is very similar to a conventional piston with the exception that the filter-mesh 368 and piston inlet 370 are smaller.

As illustrated, first piece 364 accommodates a single piece biasing mechanism 412 with an optional integral metering needle 552 that passes through a metering opening 376 for maintaining metering opening 376 unclogged and clean of debris. Further accommodated by first piece 364 is sealing member 554 that slides against inner surface of cartridge body 268 and as detailed below, separating control chamber 406 from hold chamber 408 to generate respective water pressures P1 and P2 within flush valve system (detailed below).

Second piece 366 functions to retain main seal 372 in position. This, is the seal that seals off hold chamber 408 from lower discharge chamber 410, detailed below. Second piece 366 includes centering projections 374 that center piston 270 as water flows through piston 270 (via metering opening 376) so that piston 270 does not wobble.

In this non-limiting, exemplary instance, second piece 366 includes a threaded cylindrical projection 378 for securing to first piece 364. Other manner of connectivity is contemplated such as for example, instead of a threaded connection, a simple adhesive such as a glue may be used.

An inner top surface 380 of cylindrical projection 378 retains a center opening seal 382 that seals around discharge tube 298. That is, piston 270 includes a center opening seal 382 in a form of a rod-seal that seals potential leakage between outer surface of discharge tube 298 and interior of piston 270. Main reason for preventing leakage is to prevent discharge through outlet 106 while flush valve assembly 100 is not in use (or in static operation).

Figure 14A:
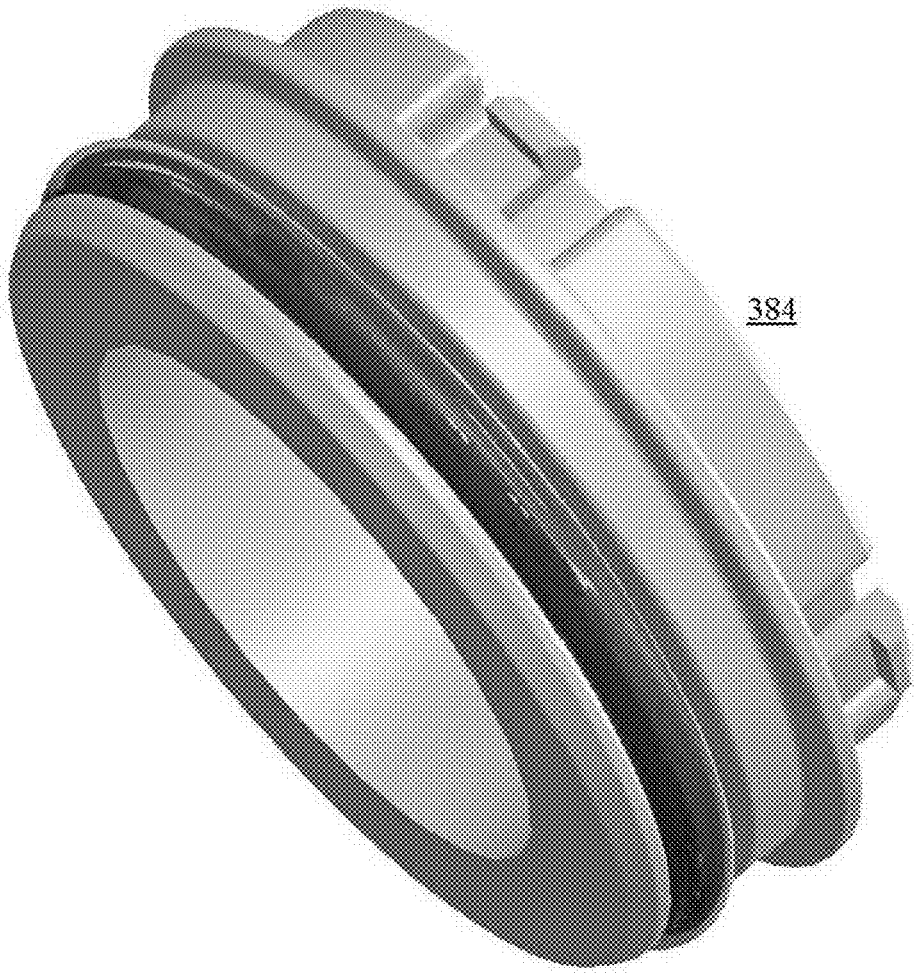
FIGS. 14A to 14D are non-limiting, exemplary illustrations of a main valve seat of a flush valve cartridge of the flush valve assembly illustrated in FIGS. 1A to 13F in accordance with one or more embodiments of the present invention.
Figure 14B:
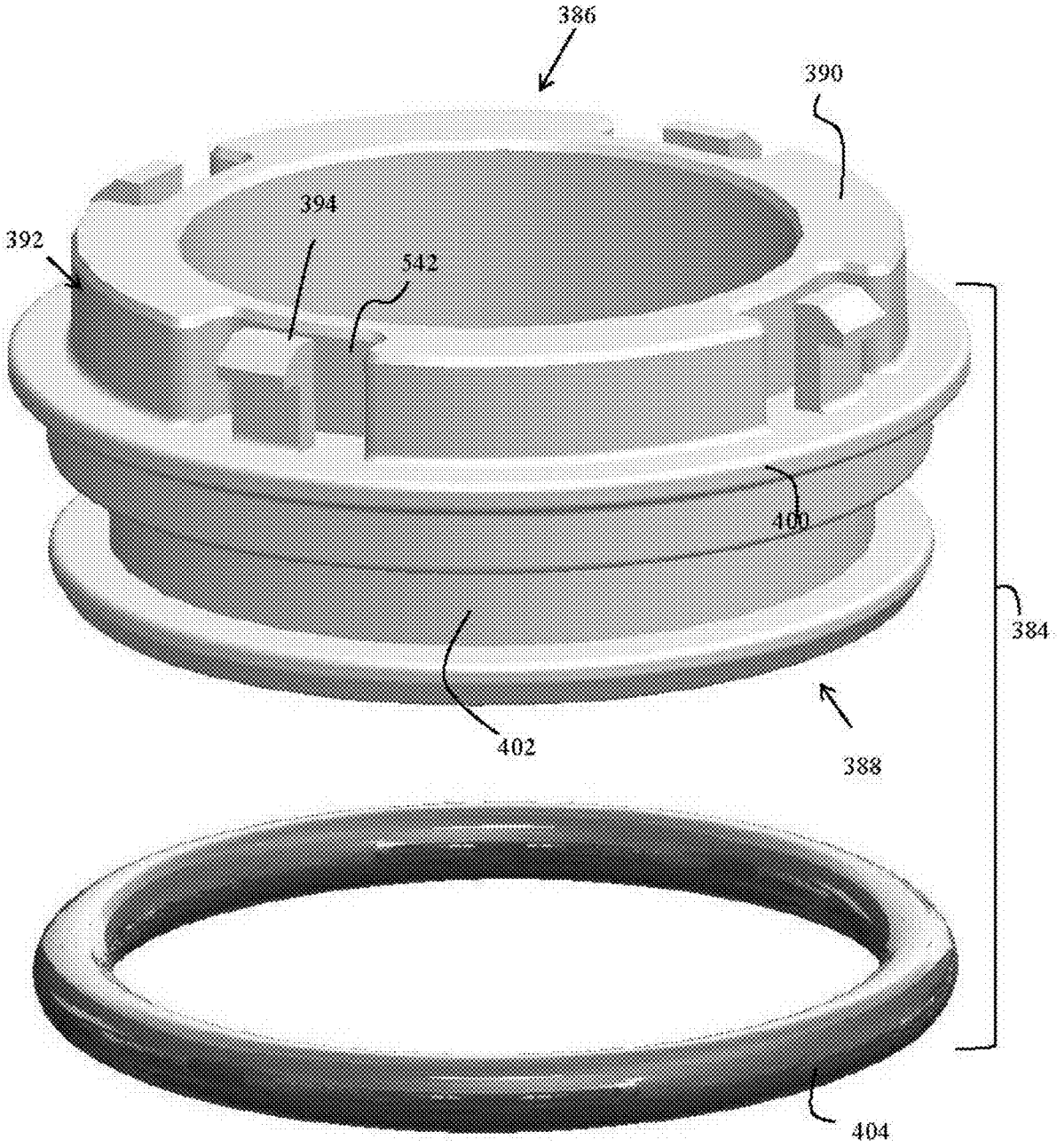
Figure 14C:
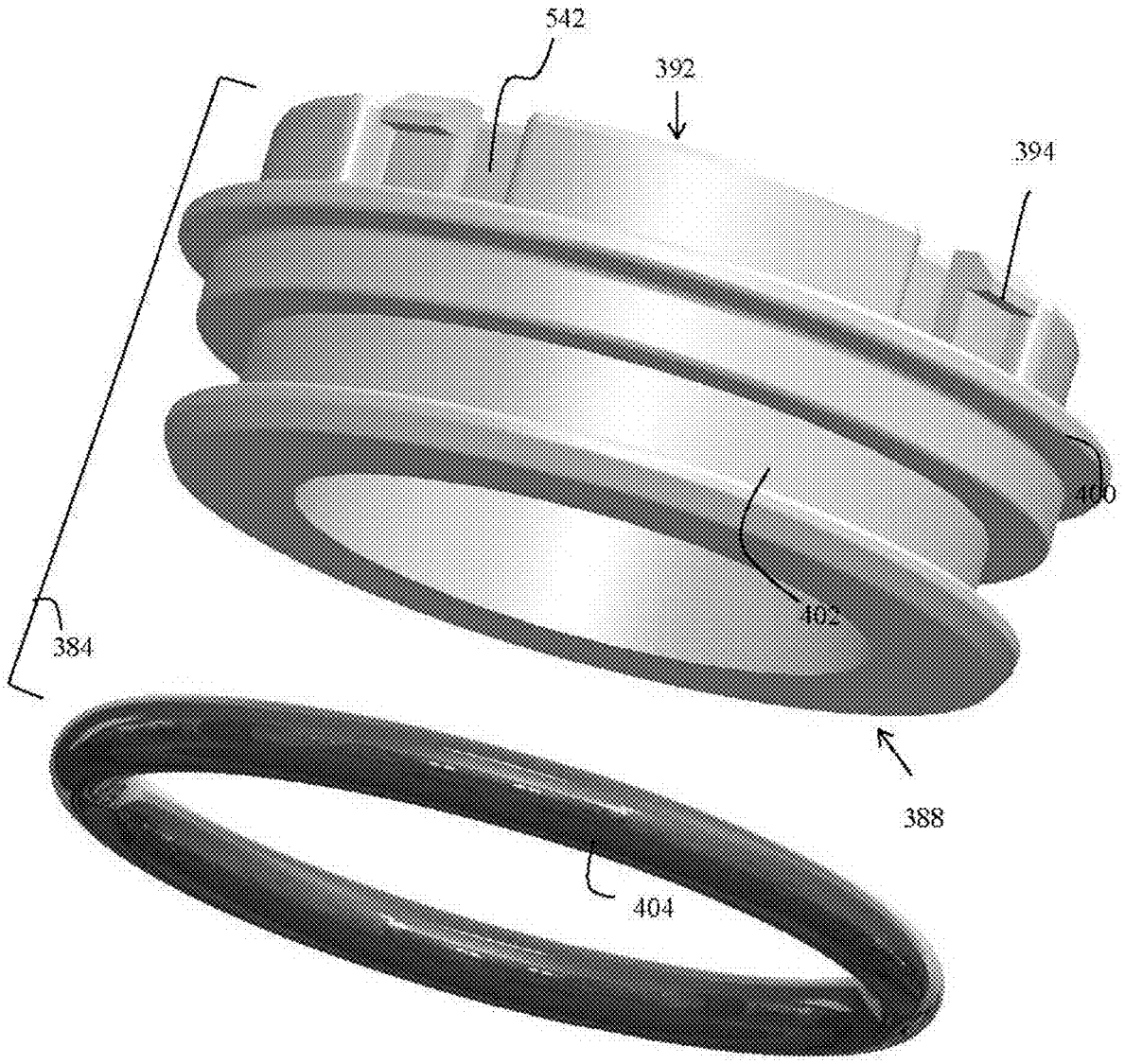

FIGS. 14A to 14C are non-limiting, exemplary illustrations of a main valve seat of a flush valve cartridge of the flush valve assembly illustrated in FIGS. 1A to 13F in accordance with one or more embodiments of the present invention. Conventional flush valves use a part of the valve body as the valve seat, which is sealed by a face seal associated with the conventional piston, all of which are prone to failure due to wear-and-tear that may cause leakage.

In particular, face seals are general used in static applications and should not be associated with a moving part such as a piston to seal-off a stationary or static part such as the conventional valve seat. Further, face seals require clean surfaces to provide appropriate sealing. If the conventional valve seat has corrosion, then it is very likely that the face seal may fail to provide an appropriate seal, causing leakage.

Accordingly, flush valve cartridge 112 of the present invention includes a stationary (or static) main valve seat 384 as an integral part of cartridge 112. This way, if main valve seat 384 is the cause of any leakage, the entire flush valve cartridge 112 may be quickly replaced without having to diagnose the case for the cause of the leak.

Main valve seat 384 is comprised of an annular structure having an inlet side 386 and, an outlet side 388. A top surface 390 of inlet side 386 of main valve seat 384 forms a seal with main seal 372 of flush valve piston 270. Accordingly, no part of piston 270 contacts with the main body 118 and further, no need or requirement for use of face seal with main body 118.

Figure 14D:
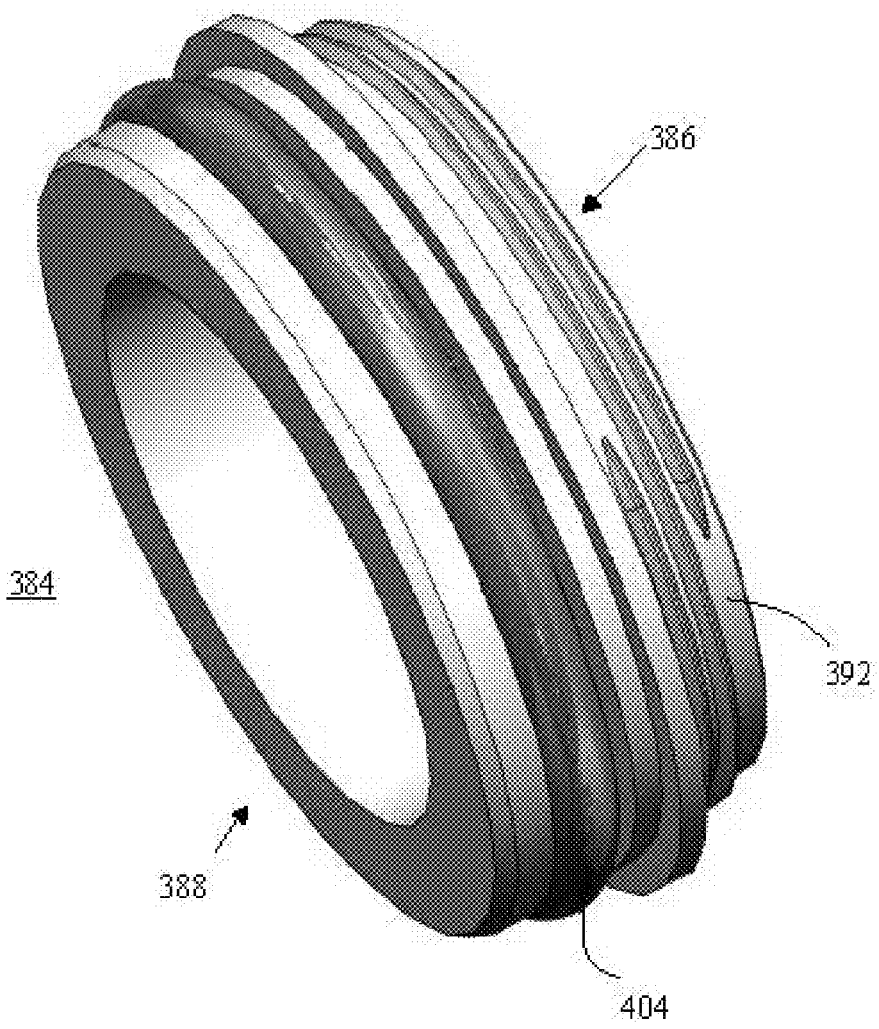

Inlet side 386 of main valve seat 384 secures to a lower distal end portion 398 of flush valve cartridge 112. Inlet side 386 includes a vertically extending annular wall 392 with recesses 542 that accommodate hook-like couplers 394 that couple with openings 396 of lower distal end wall 398 of flush valve cartridge 112. It should be noted that there are many other methods of securing main valve seat 384 to flush valve cartridge 112 and hence, the disclosure of use of hook-like couplers 394 should not be limiting. For example, as illustrated in FIG. 14D, vertically extending annular wall 392 may be threaded that may thread onto an inner threading of lower part 544 of flush valve cartridge 112 instead. Other methods may include sonic welding, use of adhesives, etc.

As indicated above, flush valve cartridge 112 may be made serviceable or none serviceable. Adhesion methods to fix main valve seat 384 to flush valve cartridge body 268 may be used not only for structural purposes, but also to deny access for service and maintenance to prevent replacing, worn and leaky seals, or particle strainer cleaning, etc. This way, by using adhesion methods, the entire flush valve cartridge 112 becomes none-serviceable and therefore, it may simply be replaced if main valve seat 384 needs to be replaced.

Outlet side 388 includes a circumferentially extending flange 400, an outlet side of which rests on a valve seat support 286 of main body 118. Outlet side 388 further includes a circumferential groove 402 within which resides a sealing member 404, a non-limiting, example of which may be in a form of an O-ring that circumferentially seals and isolates hold chamber 408 from flush lower discharge chamber 410.

The above scheme avoids use of non-stationary face seal and hence, minor corrosions with respect to main body 118 (the valve seat support 286) will generally not affect the proper operation of flush valve cartridge 112. It should be noted that the arrangement disclosed uses an O-ring as a static seal and hence, unlike the conventional non-statically used face seal, O-ring 404 does not move and is stationary (static) and therefore, will last longer and have a longer life.

Operations-Electronic

FIGS. 15A to 15H are non-limiting, exemplary illustrations of a cross-sectional views of the fully assembled flush valve (including all parts) illustrated in FIGS. 1A to 14D, progressively illustrating a non-limiting, exemplary operations thereof from static (or closed valve) to non-static (or dynamic or open valve) and back to static (or closed valve) positions in accordance with one or more embodiments of the present invention. FIGS. 15A to 15H illustrate a flush valve assembly with IR sensor 108 and an electrical manual operated electro-mechanical plunger switch 318.

As further detailed below, combination of main body 118 and flush valve cartridge 112 define various chambers including a control chamber 406, hold chamber 408, solenoid chamber 296, upper discharge chamber 300, a lower discharge chamber 410, and outlet 106. Control and hold chambers 406 and 408 vary in size during, operation of flush valve assembly 100 as detailed below.

Discharge chambers 300 and 410 are for discharge of water through outlet 106. Lower discharge chamber 410 is delimited at a top by lower slanted annular flange of cartridge body 286, which is valve seat support 286, and at a bottom by outlet 106. Outlet 106 includes a threaded outer diameter to connect with a downstream fixture 486 (FIG. 1A).

Figure 15A:
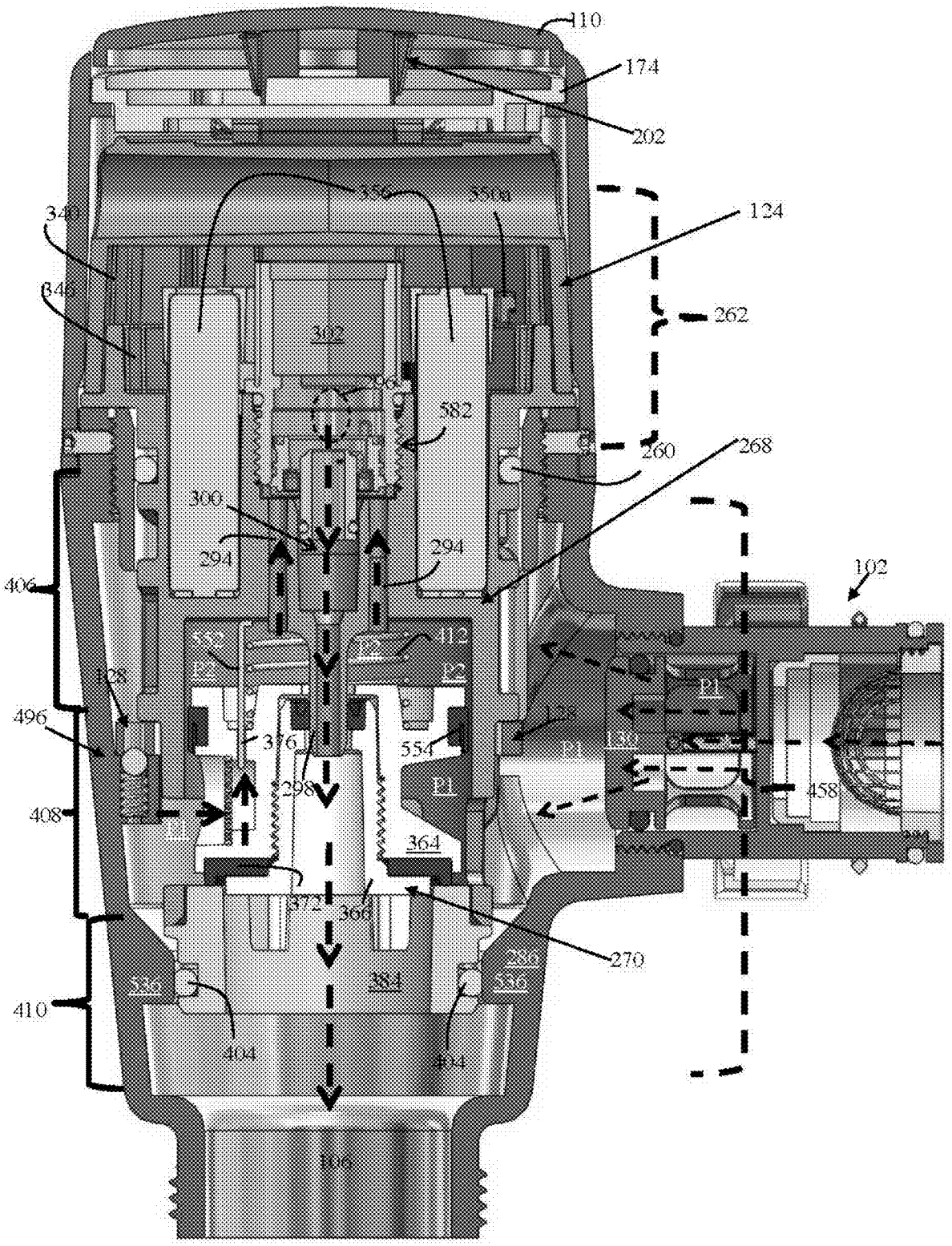
FIGS. 15A to 15H are non-limiting, exemplary illustrations of a cross-sectional views of the fully assembled flush valve (including all parts) illustrated in FIGS. 1A to 14D, progressively illustrating a non-limiting, exemplary operations thereof from static (or closed valve) to non-static (or dynamic or open valve) and back to static (or closed valve) positions in accordance with one or more embodiments of the present, invention.

In FIG. 15A, it is assumed that flush valve assembly 100 is under static, equilibrium water pressure. At this stage gate 130 is closed. That is, water pressure P1 at inlet pipe 102 and at hold chamber 408 is equal to water pressure P2 at control chamber 406, with solenoid chamber 296, upper discharge chamber 300 and lower discharge chambers 410 being at normal atmospheric pressures.

IR sensor 108 initiated flush would simply activate to open solenoid 302 to allow discharge of water (shown by broken arrows in FIG. 15A) from control chamber 406 via openings 294 into solenoid chamber 296 and out to upper discharge chamber 300, which would simply run-off through discharge tube 298 and into lower discharge chamber 410 and out through outlet 106 and into downstream fixture 486 (generally a toilet or urinal).

As water is moved and drained from control chamber 406 and finally into upper discharge chamber 300, pressure P2 at control chamber 406 continues to drop, while the water pressure P1 at hold chamber 408 continues unabated due to water flows from upstream fixtures 484 (e.g., the water main) via inlet pipe 102 and into flush valve cartridge 112. This greater pressure P1 is sufficient to open gate 130 (overcome spring 514 pulling force).

Pressure P2 is comprised of a combination of force from piston biasing mechanism 412 and continuously accumulating water pressure at control chamber 406. Water flows into control chamber 406 via metering hole 376 of piston 270 so long as P1>P2. Further, pressure P2 is continually reduced in force as water continues to drain from control chamber 406 via openings 294 and into solenoid chamber 296 and out to upper discharge chamber 300, and finally out through outlet 106 and into downstream fixture 486.

Figure 15B:
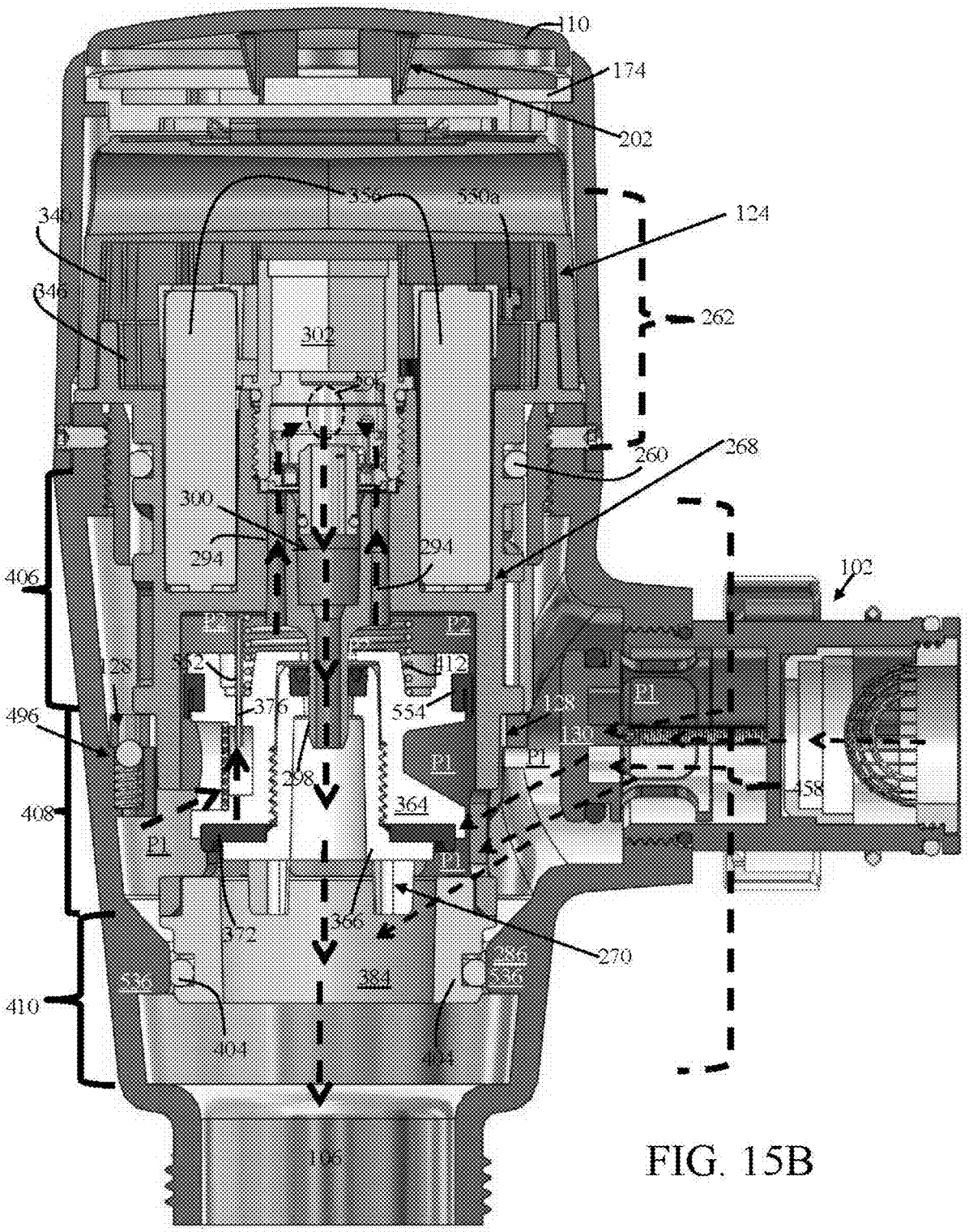

As pressure P2 at control chamber 406 is reduced, the now greater water pressure P1 pushes gate 130 to a fully, open position as shown in FIG. 15B, which further increases the pressure P1 at hold chamber 408 to be even greater than pressure P2 at control chamber 406.

As pressure P2 at control chamber 406 is further reduced, the now greater water pressure P1 at hold chamber 408 pushes and lifts piston 270 from main valve seat 384 (FIG. 15B), against the biasing force of biasing mechanism 412 of piston 270.

Lifting of piston 270 from main valve seat 384 enables water (again shown by arrows) within hold chamber 408 to directly discharge into lower discharge chamber 410 and out through outlet 106 into downstream fixture 486.

Figure 15C:
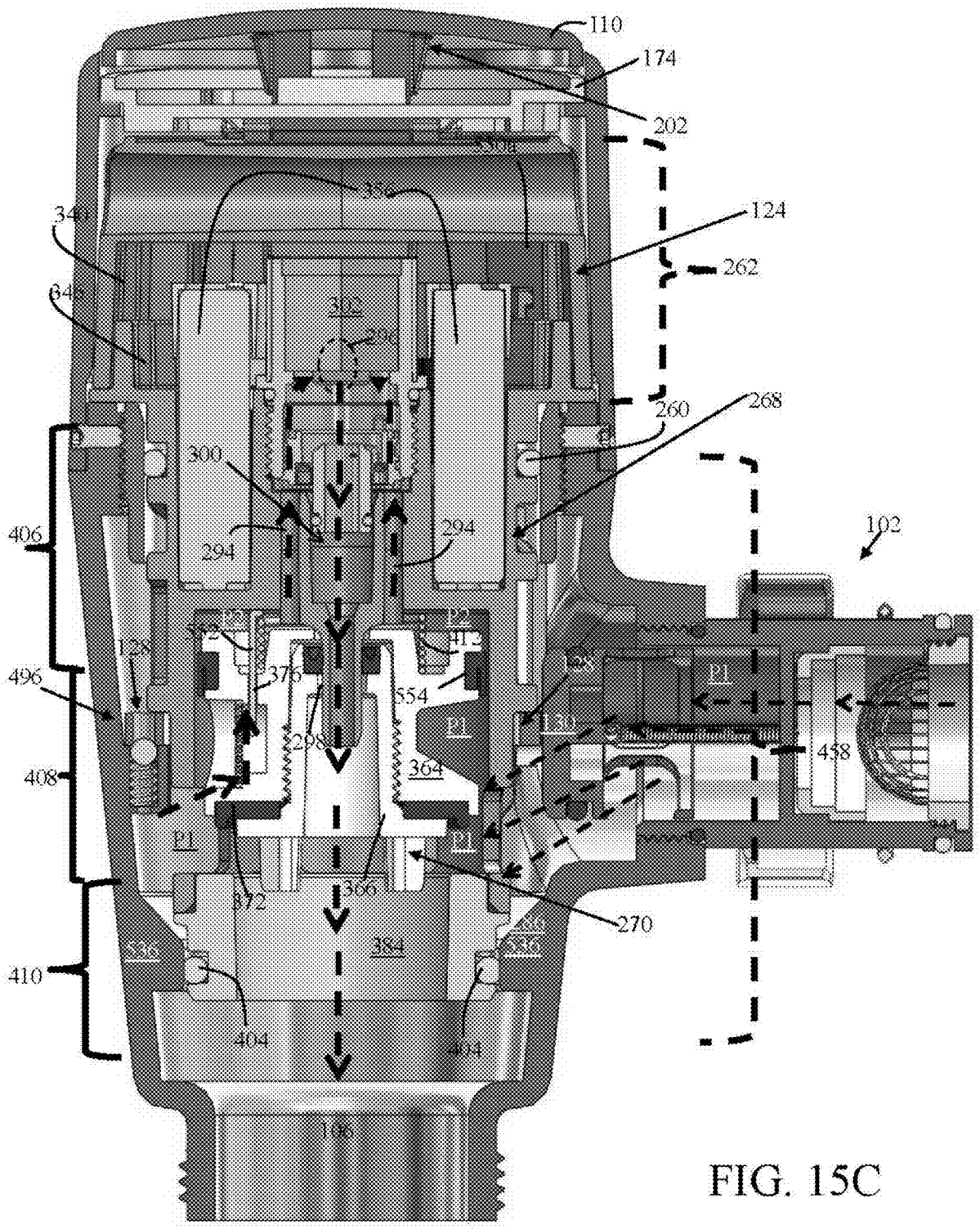
Figure 15D:
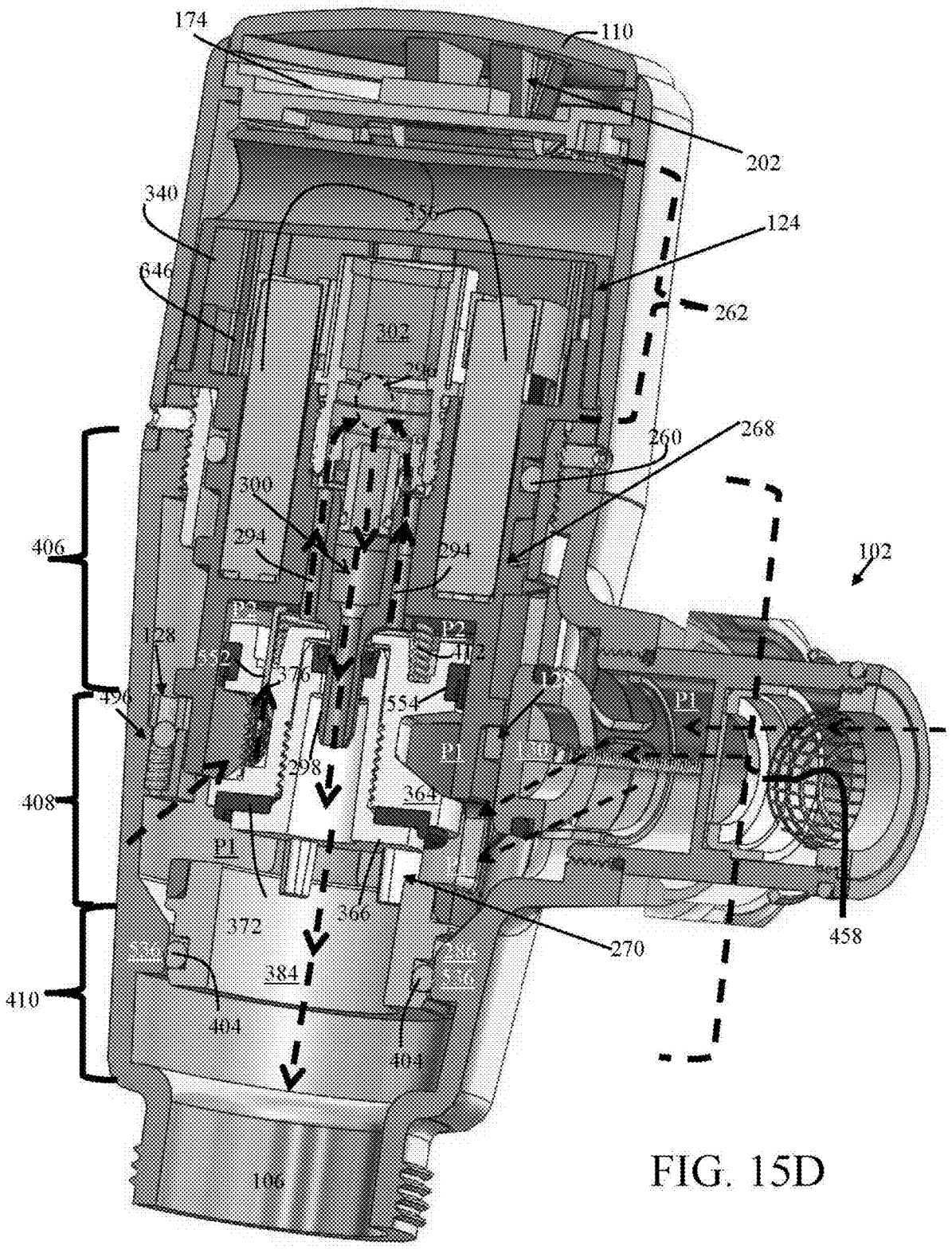
Figure 15E:
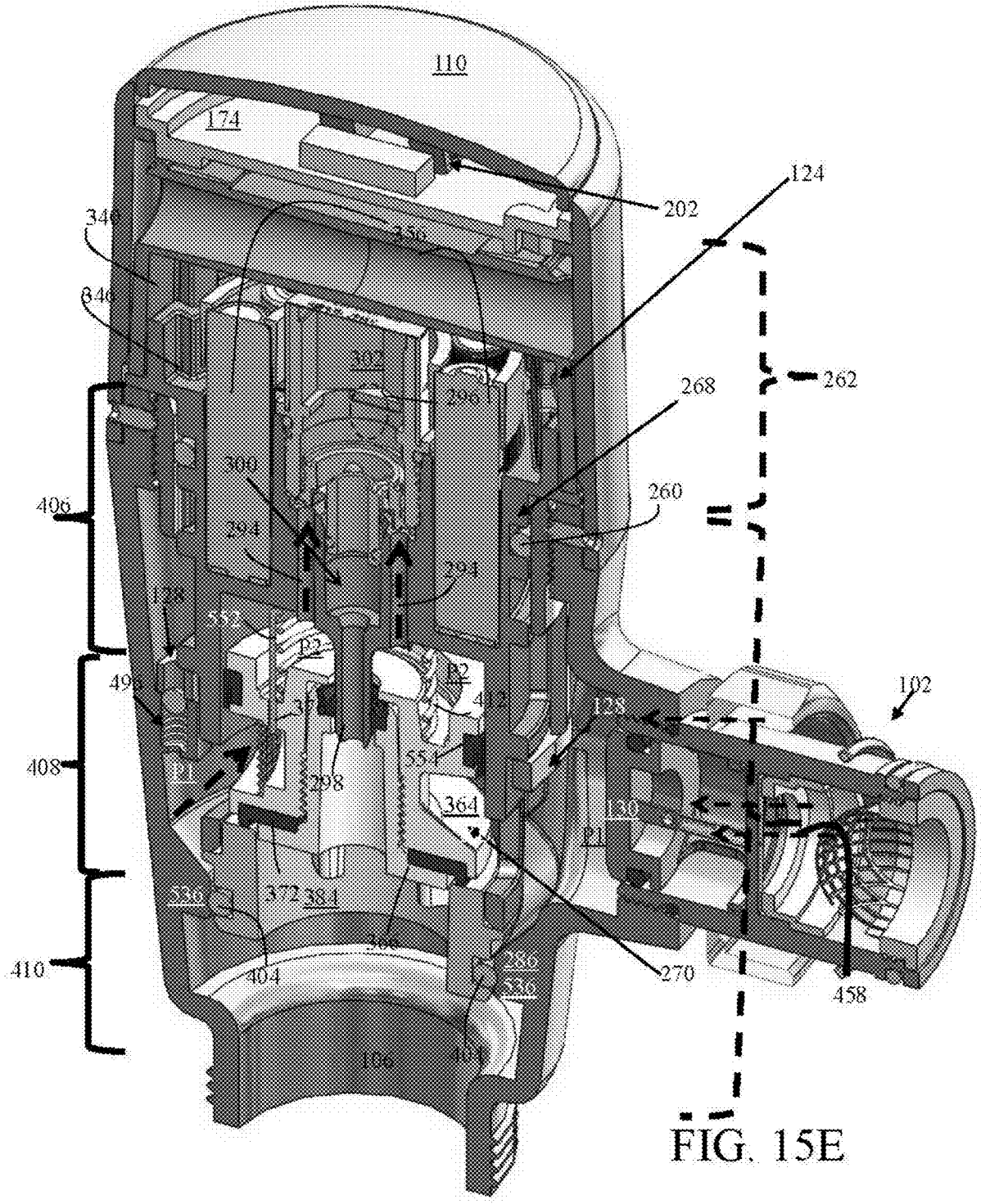
Figure 15F:
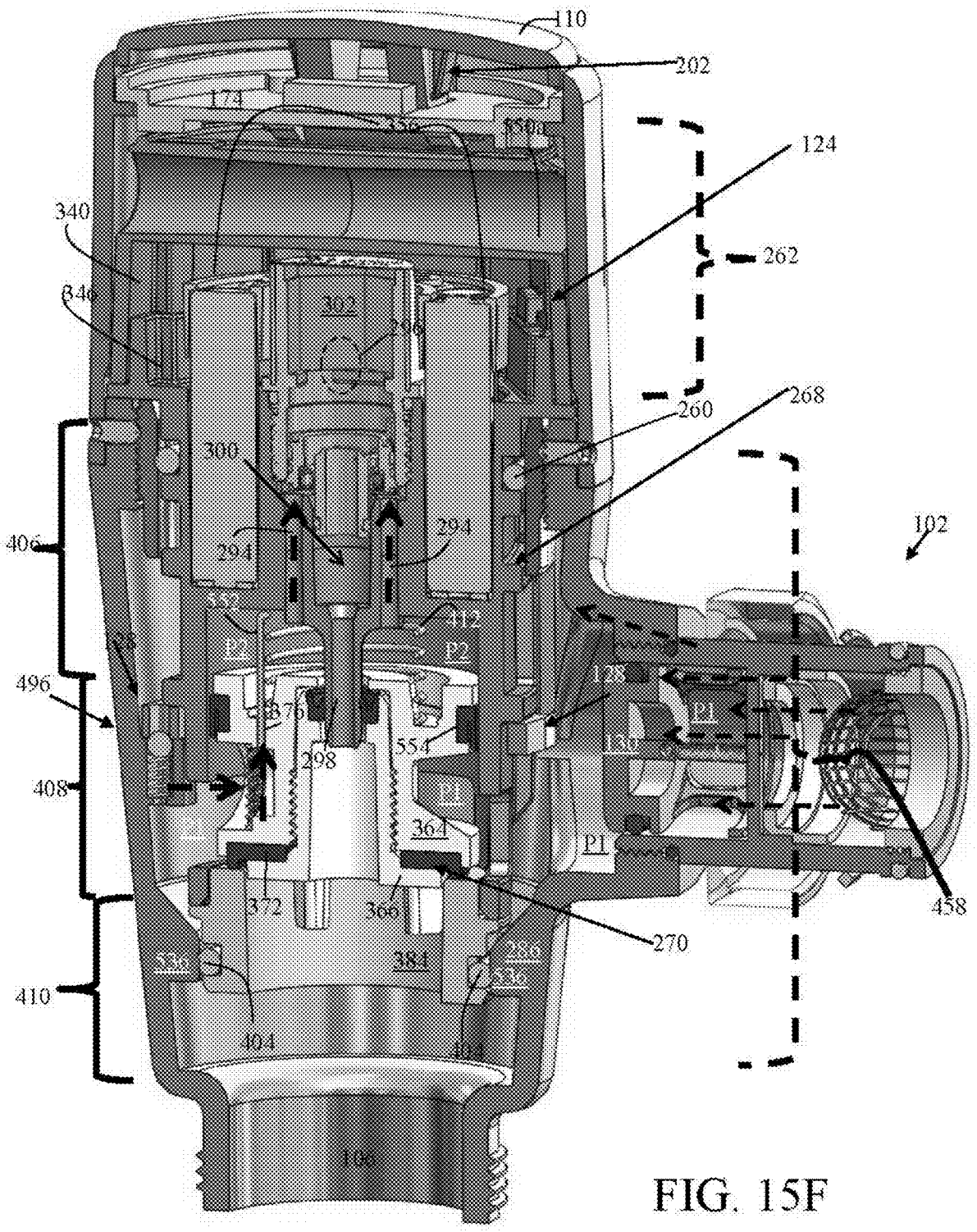
Figure 15G:
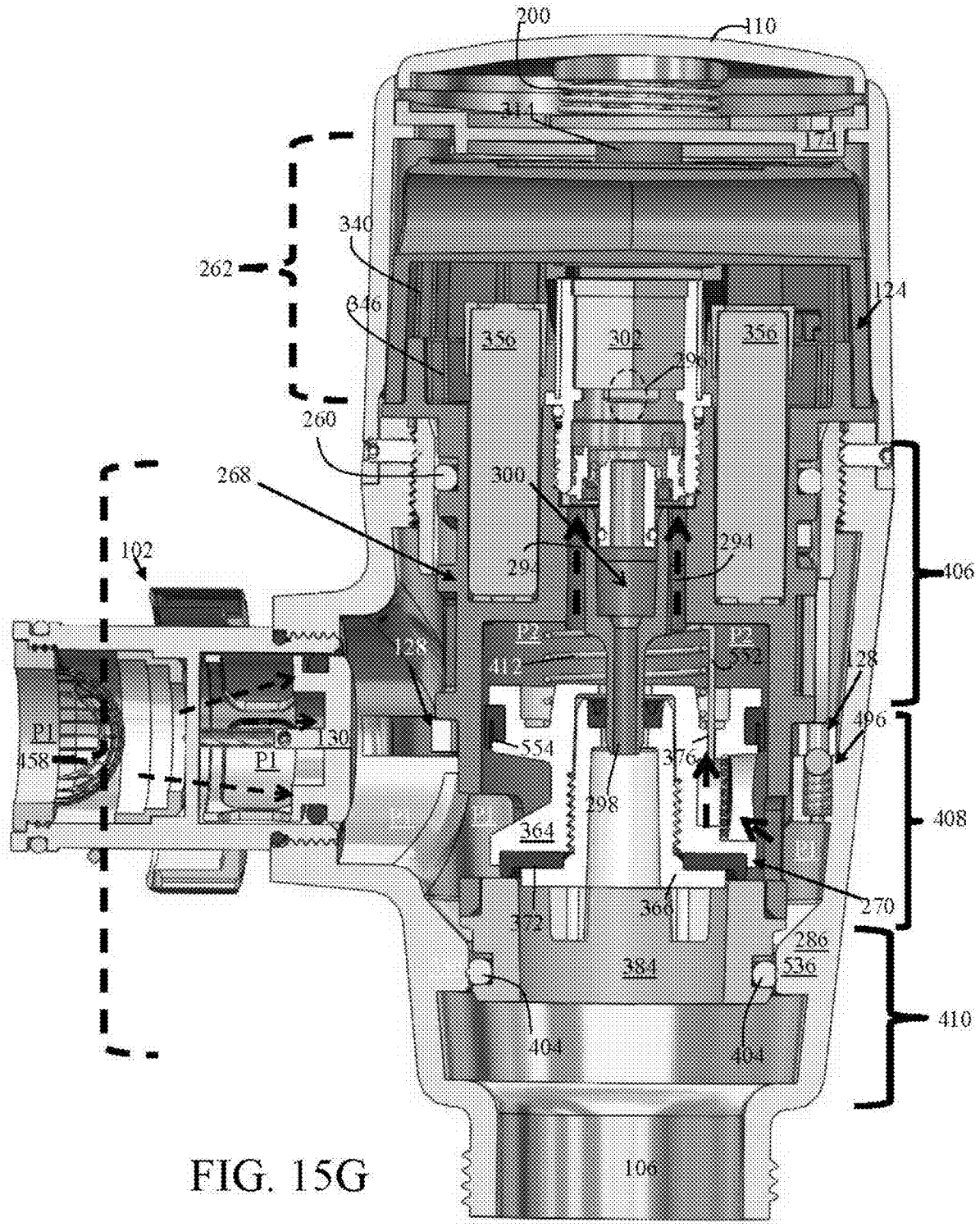
Figure 15H:
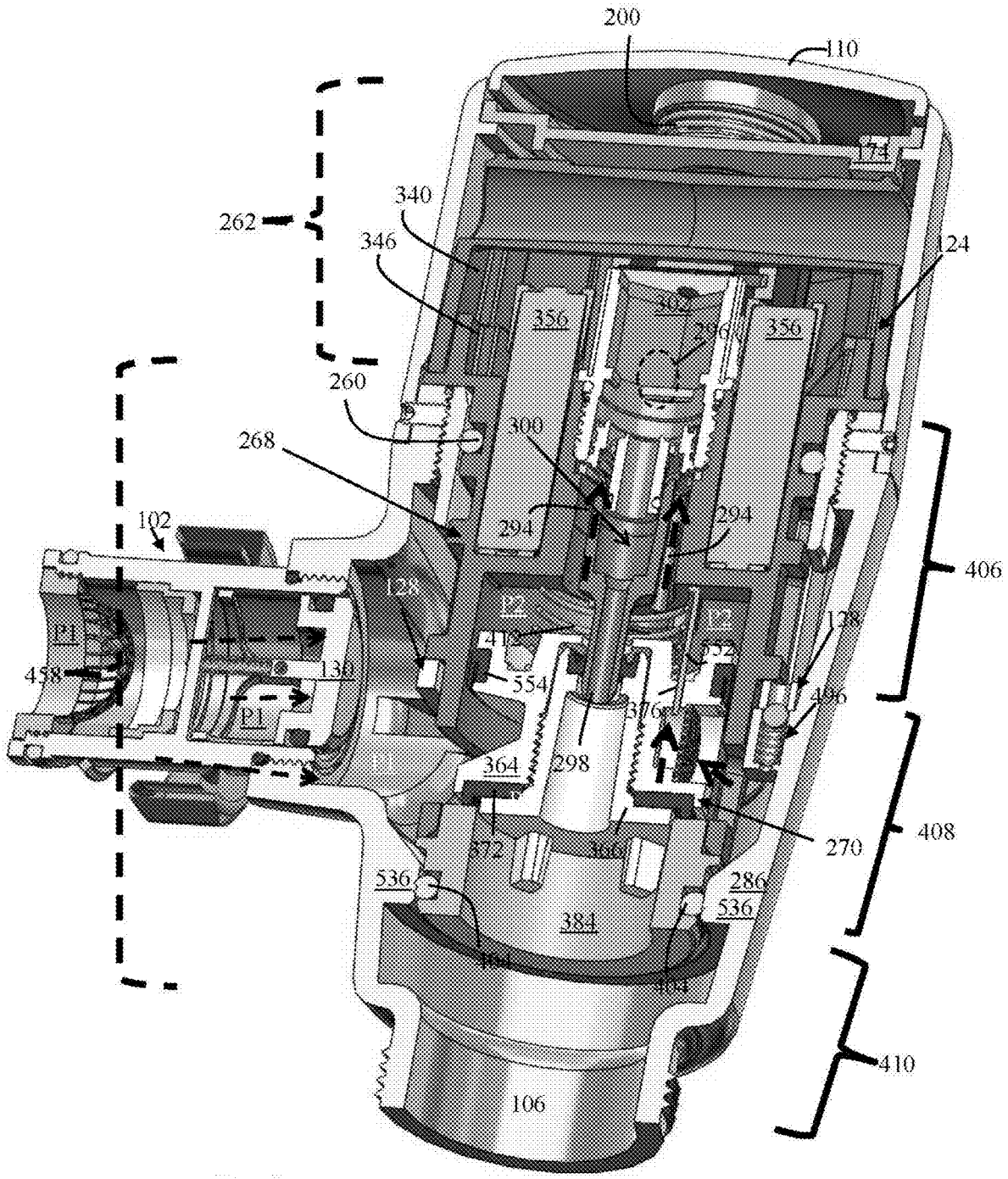

As illustrated in FIGS. 15B to 15D, as pressure P2 at control chamber 406 continues to decrease, piston 270 is moved to its final open position (fully compressing biasing mechanism 412), with upstream water from main (via inlet pipe 102) directly discharging through lower discharge chamber 410 at full force.

It should be noted that at this point, piston 270 would tend to remain at open position due to impingement of water to its upper portion having a larger surface area than its lower portion. In other words, the force from water pressure P1 at hold chamber 408 is greater than force exerted by biasing mechanism 412.

Based on a well-known, conventional timing scheme, IR sensor 108 eventually sends a closed signal to solenoid 302 to close off water flow to within solenoid chamber 296 and hence, in effect, close-off water flow via chamber 296 to upper discharger chamber 300. This way, water is no longer moved from control chamber 406 to the upper discharge chamber 300.

At the same time, as water continues to move into flush valve cartridge 112 from inlet pipe 102 and into hold chamber 408 and finally discharged, water also flows to within piston 270 via piston inlet 370, where it is eventually directed to the control chamber 406 via a small metering through-opening 376 in piston 270, which is continuously cleaned and unclogged by a free end of piston biasing mechanism 412.

As water accumulates within control chamber 406 via metering opening 376, combination of continually built water pressure P2 at control chamber 406 (due to water accumulation) and piston biasing mechanism 412 push piston 270 back towards main valve seat 384 against the force of continued flow of water into flush valve cartridge 112 via inlet pipe 102. Eventually, piston 270 comes to rest on and seal main valve seat 384 when pressure P2 at control chamber 406 (pressure from biasing mechanism 412 plus water pressure) is equal to or greater than pressure P1 at hold chamber 408, returning flush valve assembly 100 to equilibrium (or static) phase (FIG. 15A, 15E to 15H). At this stage, gate 130 is also pulled back to its closed position by the biasing mechanism 514, which overcomes the force from pressure P1, preventing potential backflows.

The same exact operations take place with a manual (electro-mechanical) operation. That is, when primary actuator 110 is pressed, it presses a secondary actuator 208, which, in turn, presses an electro-mechanical plunger switch 318 that closes to power solenoid 302. Activation of solenoid 302 opens access to solenoid chamber 296. In this non-limiting, exemplary embodiment, the electrical electro-mechanical plunger switch 318 is comprised of an electro-mechanical switch with a plunger switch and is positioned adjacent sensor 108. The remaining operational cycle is identical to the above description once the solenoid is powered and solenoid chamber 296 is opened. Solenoid is simply deactivated (due to sensor 108 firmware) after a predetermined period of time has passed even if user continues to depress switch 110.

Flush Valve System—Mechanical

As indicated above, a single flush valve cartridge body 268 may be used for both electronically and mechanically operated flush valve systems. A single mold is used to manufacture flush valve cartridge body 268, which may be used for both electronically and mechanically operated flush valve systems after minor modifications, which are detailed below.

Figure 16A:
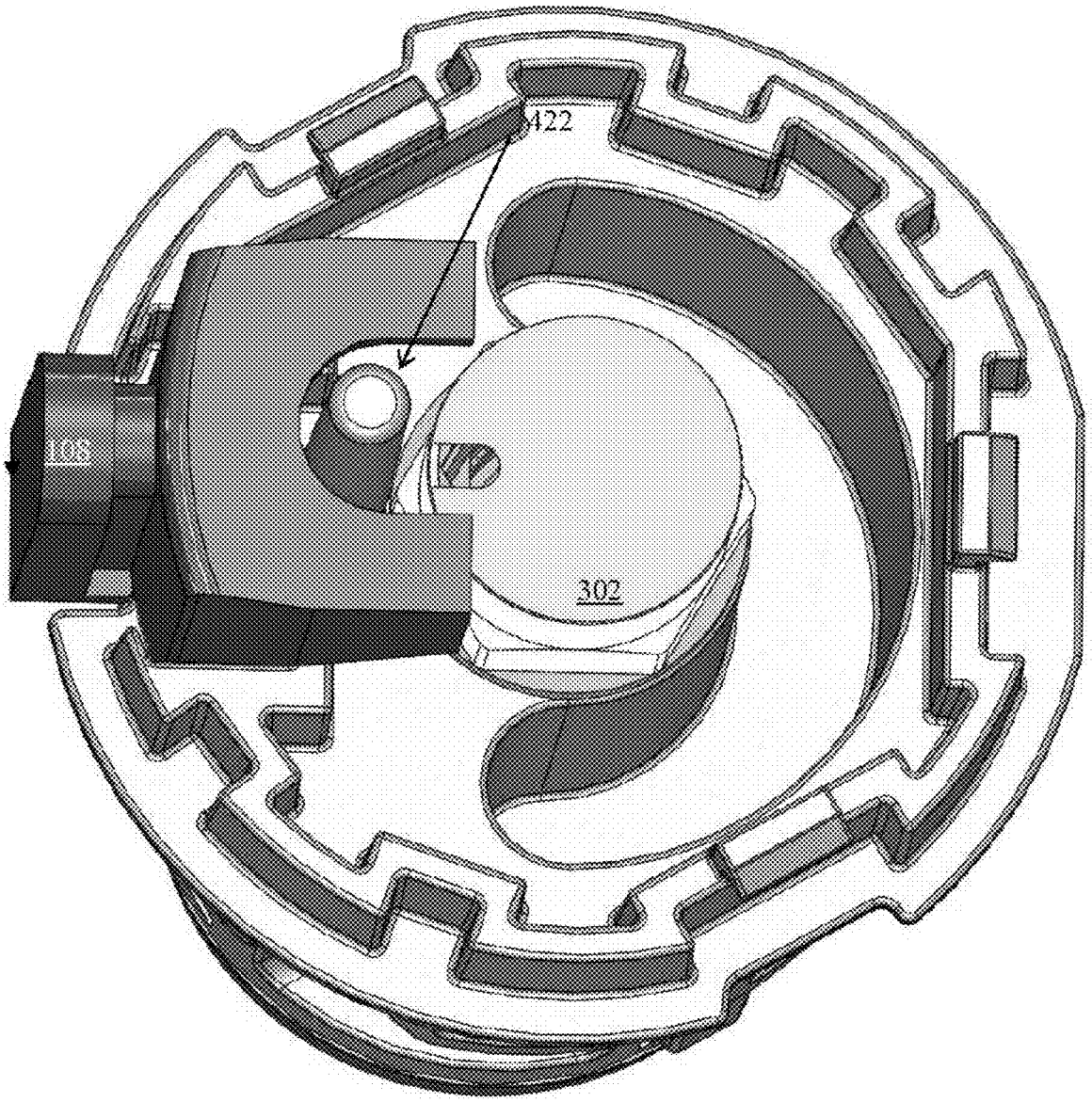
FIGS. 16A to 17F are non-limiting, exemplary illustrations of a flush valve system with a mechanical manual operated switch in accordance with another embodiment of the present invention.

Flush valve cartridge body 268 is molded to include features for electronic (or auto flush) operations (including electronic manual operations where sensory module 108 is bypassed), all of which are detailed above. Additionally, the same flush valve cartridge body 268 also includes features for mechanical manual operations that may accommodate an actual mechanical plunger 422 (FIG. 16A).

As further detailed below, the electronic and the mechanical versions of flush valve cartridge both include sensor 108 and solenoid 302. In the electronic version (FIGS. 1A to 15H), solenoid 302 may be powered by sensor 108 and or electro-mechanical plunger switch 318, as described above.

In the mechanical version (FIGS. 16A to 17F), solenoid 302 may be powered by sensor 108 only (as described above). The mechanical version provides an additional separate set of passageways (detailed below) that accommodate a mechanical plunger 422 that may be operated independent of sensor 108, solenoid 302, and solenoid chamber 296 to actuate a flush. In other words, in the mechanical version (as further detailed below), when mechanical plunger 422 is actuated to start a flush, solenoid 302 remains powered down and is not powered, this maintains solenoid chamber 296 closed-off.

The benefit of a mechanical version is that if battery power is drained or if there is an electrical malfunctions for some reason, sensor 108 and solenoid 302 will not operate but the flush valve system (the mechanical version) would still operate the fixtures with a flush action if flush valve system is mechanically actuated by a user as detailed below.

Accordingly, both mechanical and electronic versions operate using sensor 108 and solenoid 302. That is, in both versions sensor 108 may activate solenoid 302. With the electronic version however, sensor 108 may be bypassed using electro-mechanical switch 318 to actuate solenoid 302. The mechanical version on the other hand, provides a purely mechanical operation independent of sensor 108 and solenoid 302, completely bypassing sensor 108 and bypassing activation of solenoid 302 (detailed below).

FIGS. 16A to 17F are non-limiting, exemplary illustrations of a flush valve system with a mechanical manual operated switch in accordance with another embodiment of the present invention. The flush valve system illustrated in FIGS. 16A to 17F includes similar corresponding or equivalent components, interconnections, functional, operational, and or cooperative relationships as the flush valve system that is shown in FIGS. 1A to 15H, and described above. Therefore, for the sake of brevity, clarity, convenience, and to avoid duplication, the general description of FIGS. 16A to 17F will not repeat every corresponding or equivalent component, interconnections, functional, operational, and or cooperative relationships that has already been described above in relation to flush valve system that is shown in FIGS. 1A to 15H but instead, are incorporated by reference herein.

In this non-limiting, exemplary instance, instead of using an electro-mechanical plunger switch 318 (best shown in FIG. 12A) that activates solenoid 302, an independent mechanical plunger 422 (FIG. 16A) is used instead.

It should be noted that valve housing 114 (cover 116 and main body 118), including inlet pipe 102 illustrated in FIGS. 1A to 15H does not change since as detailed below, flush valve cartridge body 268 does not change (at least externally) and hence, valve housing 114 and inlet pipe 102 can and do accommodate flush valve cartridges 112—electronic (FIGS. 1A to 15H) and mechanical (FIGS. 16A to 17F). For example, once one type of cartridge is installed, the user may request and switch to using another type with no modifications to inlet pipe 102 or valve housing 114. The same primary actuator 110 positioned on top of cover 116 of flush valve housing 114 of flush valve assembly 100 will operate with both electronic and mechanical manual operating switches without any modification to flush valve housing 114.

Figure 16B:
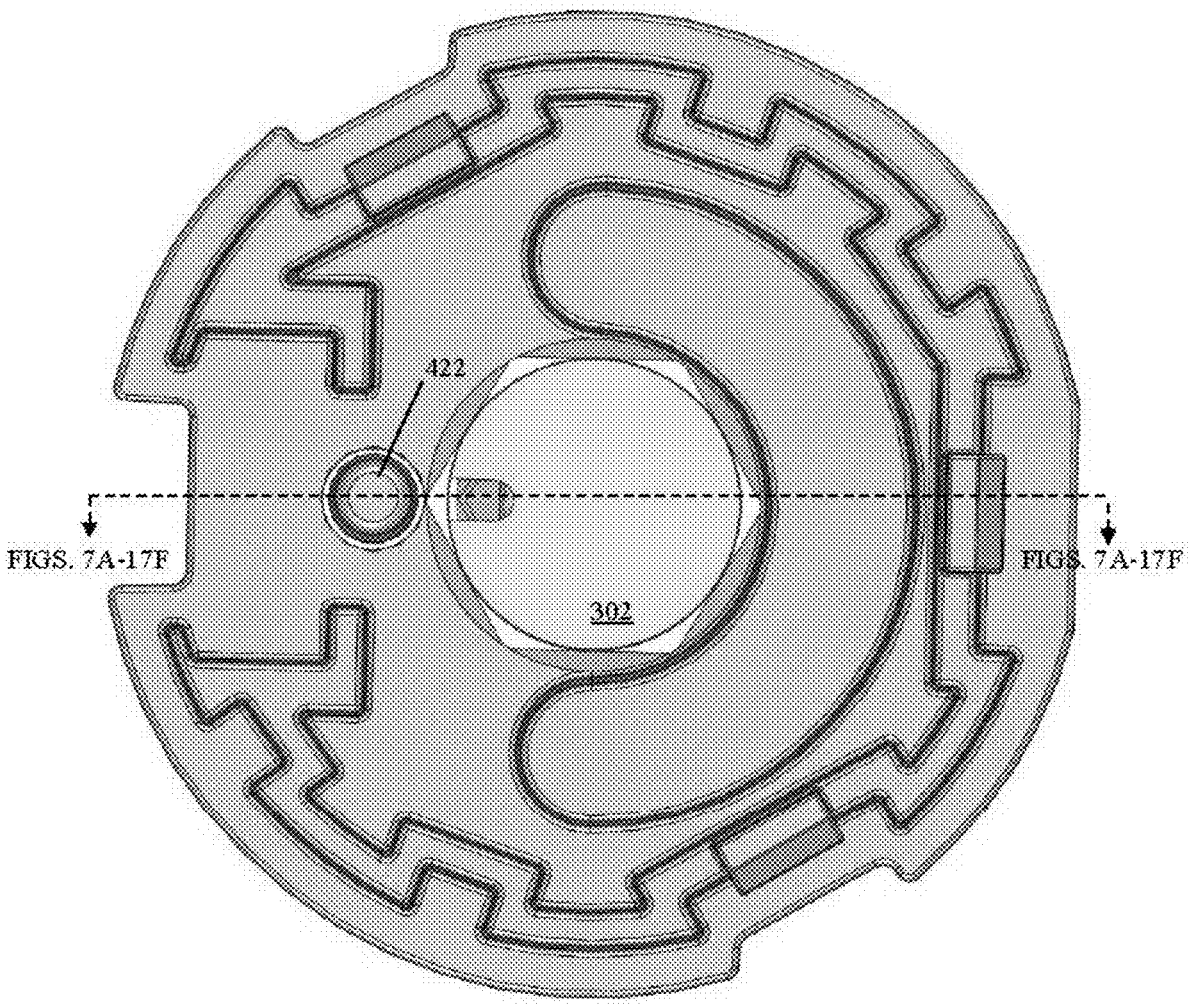
Figure 16C:
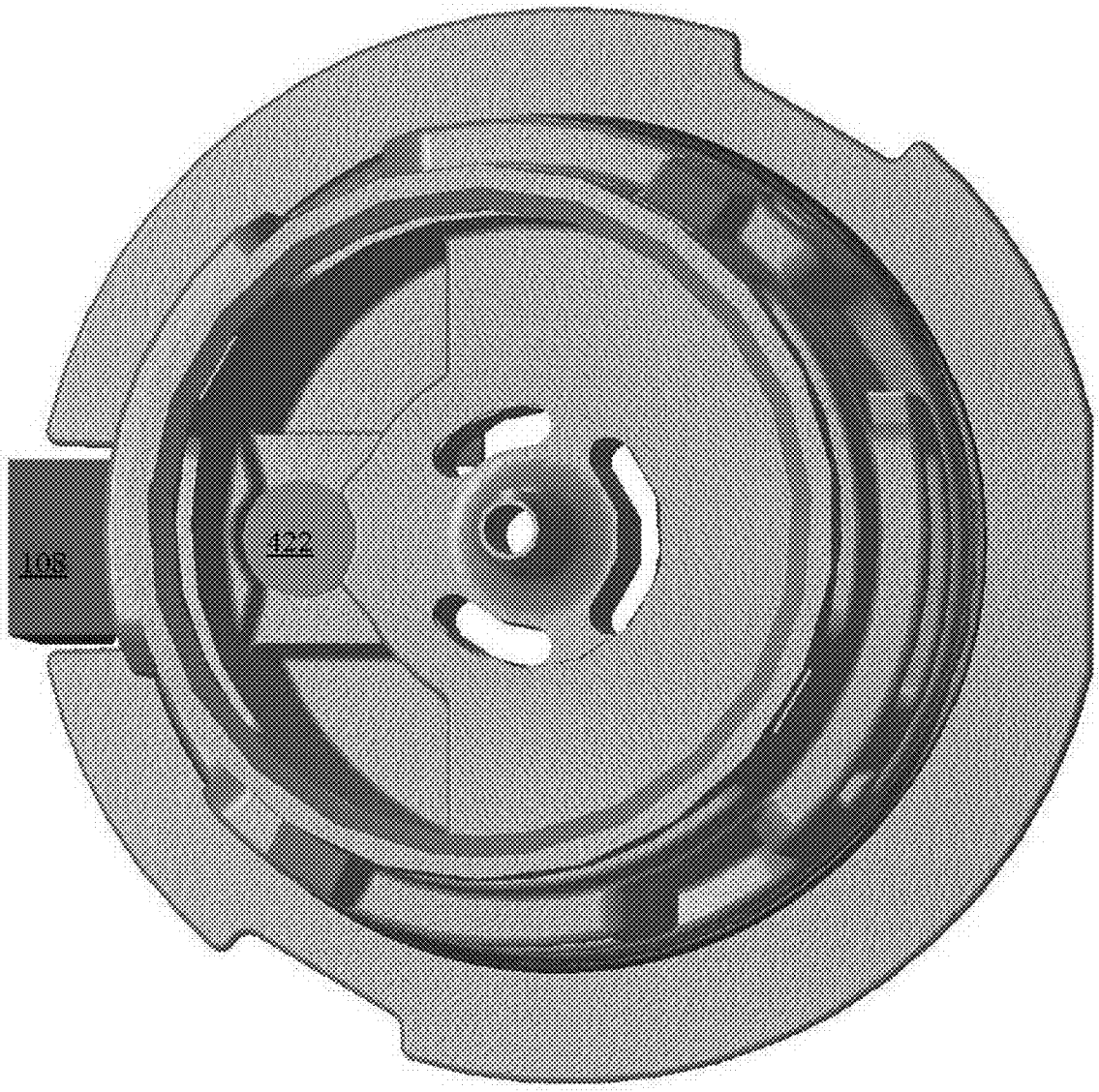

Referring back to FIGS. 12A to 12G and in particular, FIGS. 12F and 12G, as illustrated, cartridge body 268 includes an upper cavity (or blind-hole) 556 and a lower cavity (or blind-hole) 558, that may be opened to become a single through-opening or through-hole 426 to house mechanical plunger 422 (shown in FIGS. 16A to 16C). Accordingly, one minor modification required to be made to cartridge body 268 to use it as a mechanically operating flush valve system is to simply drill open upper- and lower-blind holes 556 and 558 into a single mechanical plunger opening 426 (best illustrated in FIGS. 17A to 17F). As detailed below, a second minor modification is to drill open blind hole 580 (FIGS. 12F and 12G) and convert it to a through-opening or inner channel 454 (FIG. 17A), which provides a passageway or fluidic communications from control chamber 406 to discharge chamber 300. A third minor modification is to simply add the illustrated plug 586 to plug-off opening 460 to prevent access to channel 454.

Mechanical plunger 422 is actuated by the same engagement end 206 of projection 204 of primary actuator assembly 176 of cover 116 (best shown in FIG. 8A) when primary actuator 110 is pressed by a user to commence manual flushing operation. It should be noted that the position of mechanical plunger 422 or the above-discussed electro-mechanical switch 318 may be, varied.

As best illustrated in FIGS. 16A to 17F, mechanical plunger opening 426 is an orifice with a longitudinal axis that is parallel that of longitudinal axis 428 of flush valve cartridge 112. Mechanical plunger orifice 426 is defined by an upper opening 560 to receive and house an engagement end 430 of mechanical plunger 422. Mechanical plunger opening is further defined by a second opening 562 that leads to control chamber 406, with second opening housing a gating end 432 of mechanical plunger 422.

It should be noted that in the illustrated figures of 17A to 17F, an inner channel 454 is provided that extends from upper discharge chamber 300 and across mechanical plunger opening 426, leading to a lateral opening 460 of cartridge body 268. Inner channel 454 is drilled to provide fluidic communication between control chamber 406 and upper discharge chamber 300 (detailed below). The opening 460 is for drilling inner channel 454 after which, it is simply plugged 586 closed.

As illustrated, mechanical plunger 422 is comprised of an elongated piece 444 with an upper portion 434, middle portion 436, and lower portion 438. Upper portion 434 includes engagement end 430 that extends to dry-side 262, which ultimately engages primary actuator 110 (as described above) and is biased to a closed position (FIGS. 17A and 17F) by a biasing mechanism 440 comprised of a resilient member in a form of a spring. Upper portion 434 further includes a seated onto an O-ring 446 that separates dry-side 262 from wet-side 458.

Middle portion 436 of mechanical plunger 422 includes an upper plug end 448, which closes-off fluid communication between control chamber 406 and inner channel 454, in closed position. Lower portion 438 of mechanical plunger 422 includes a gating end 432 that extends to the wet-side 458 and is comprised of a circumferential groove that includes a sealing member in a form of an O-ring 564 that prevents water flow from control chamber 406 into inner channel 454 when mechanical plunger 422 is in a closed position.

It is imperative to note that in the present, invention, mechanical plunger 422 is an integral part of flush valve cartridge 112. In conventional systems, if they do use conventional mechanical manual operated switch, the entire conventional system is part of the conventional flush valve housing itself. Conventional systems require creation of drill points within the body of the brass flush valve housing to facilitate proper operation of the conventional mechanical manual operated switch. This complicates the manufacture of the conventional flush valve housing.

As another improvement, any mechanical plunger is generally prone to quick wear-and-tear which may cause leakage. Accordingly, by integrating mechanical plunger 422 with flush valve cartridge 112, when flush valve cartridge 112 is replaced, the plunger 422 is also replaced and hence, the possibility of potential leakage is also eliminated.

Operations—Mechanical

Figure 17A:
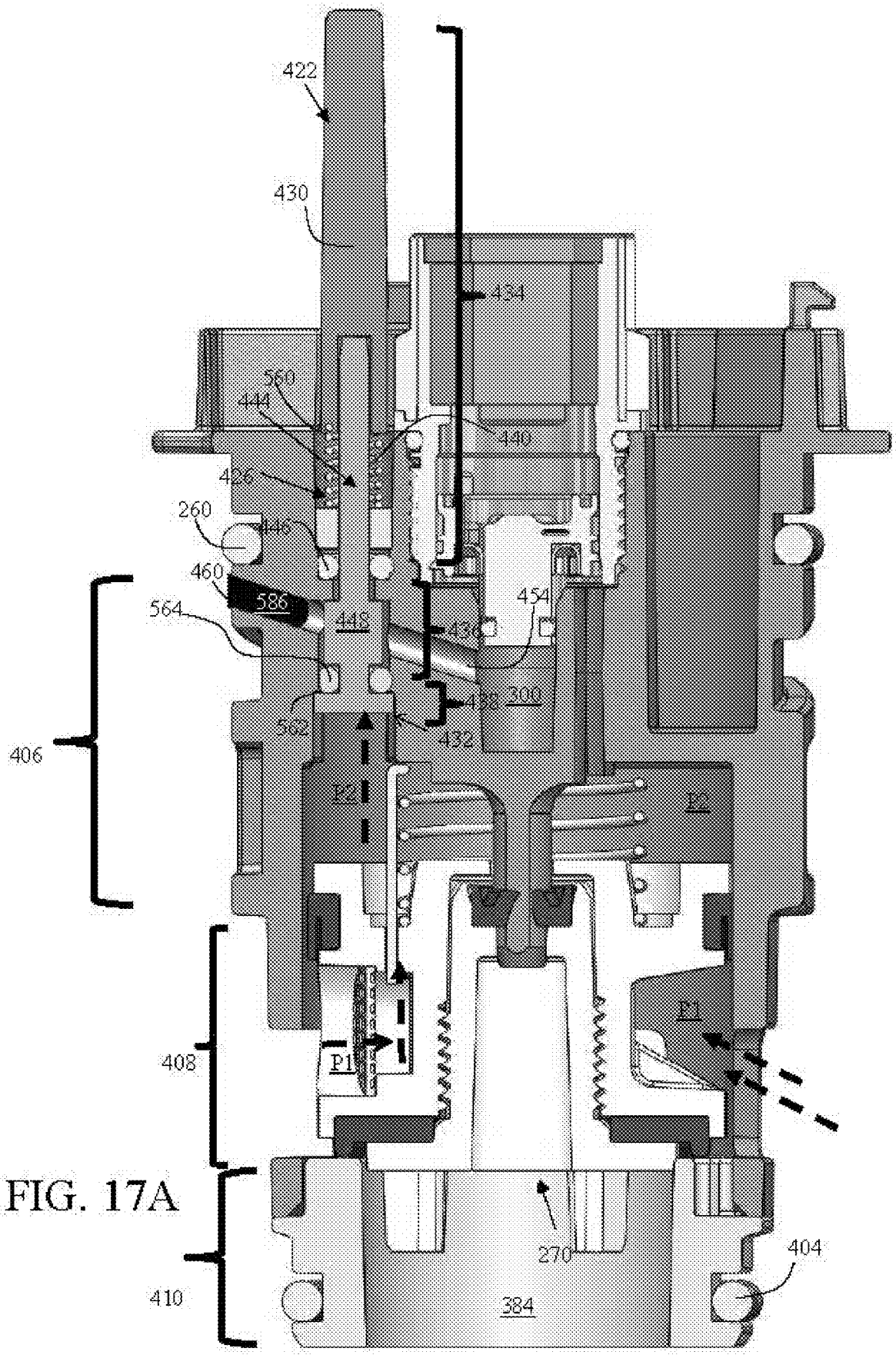
Figure 17B:
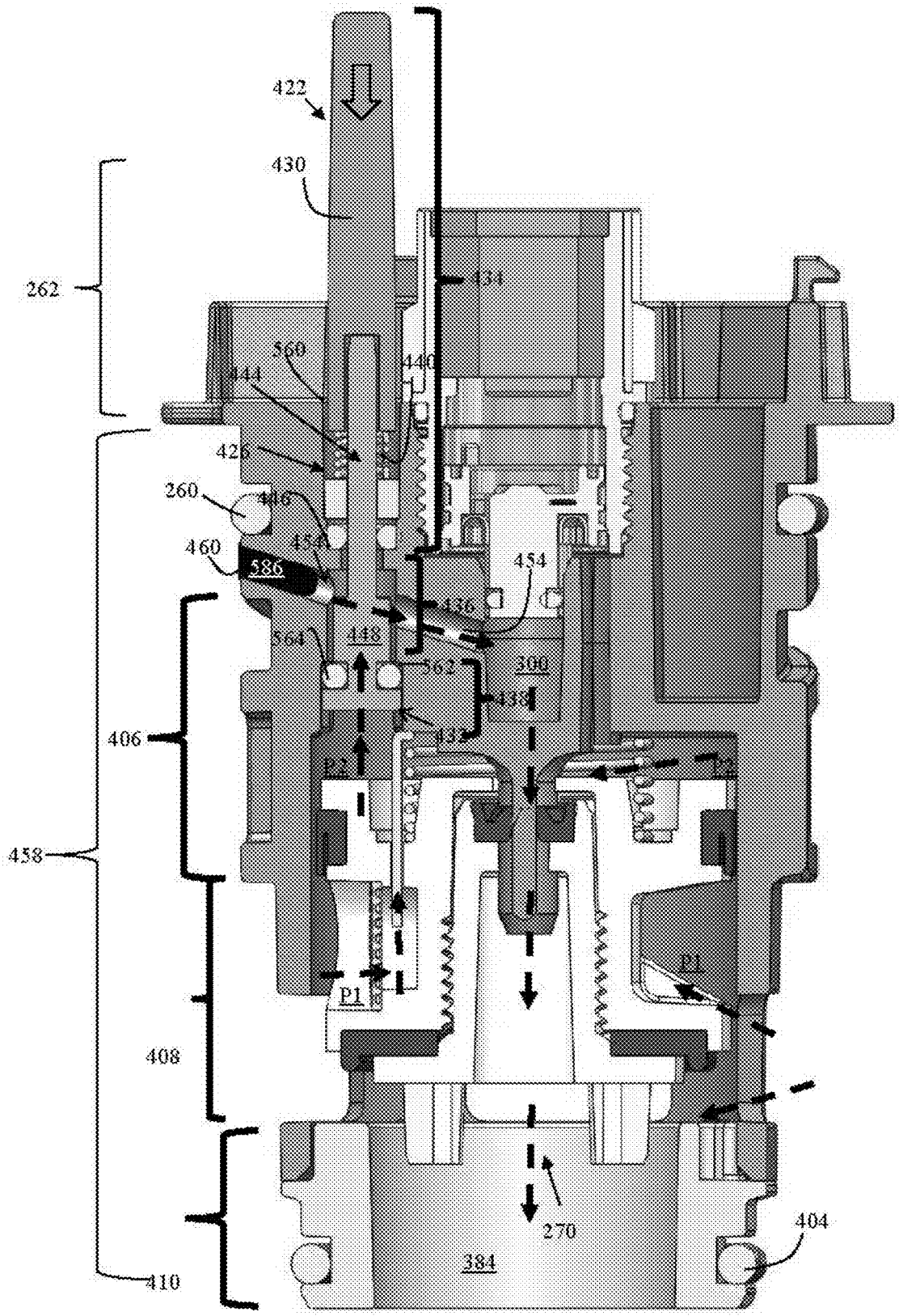
Figure 17C:
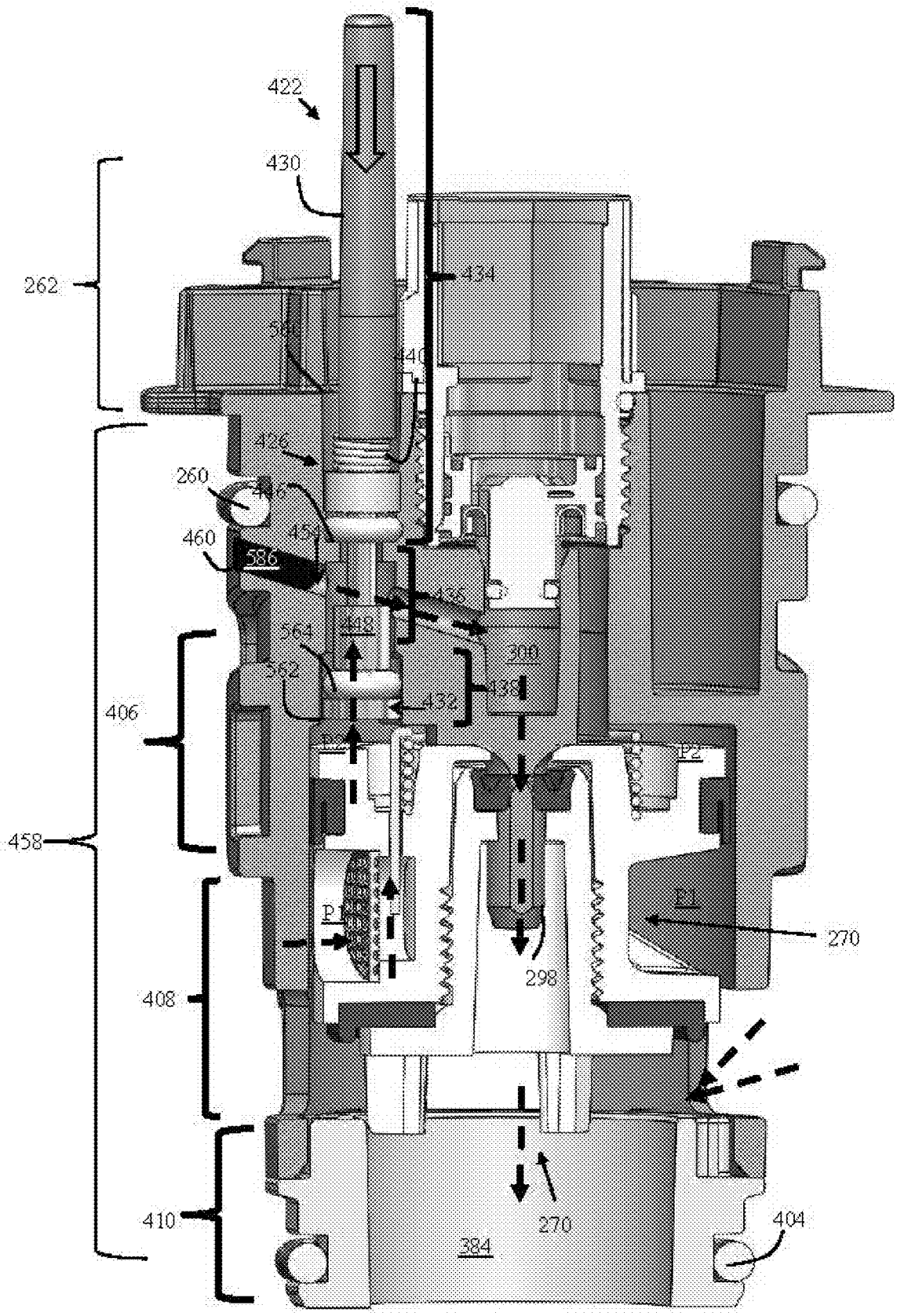
Figure 17D:
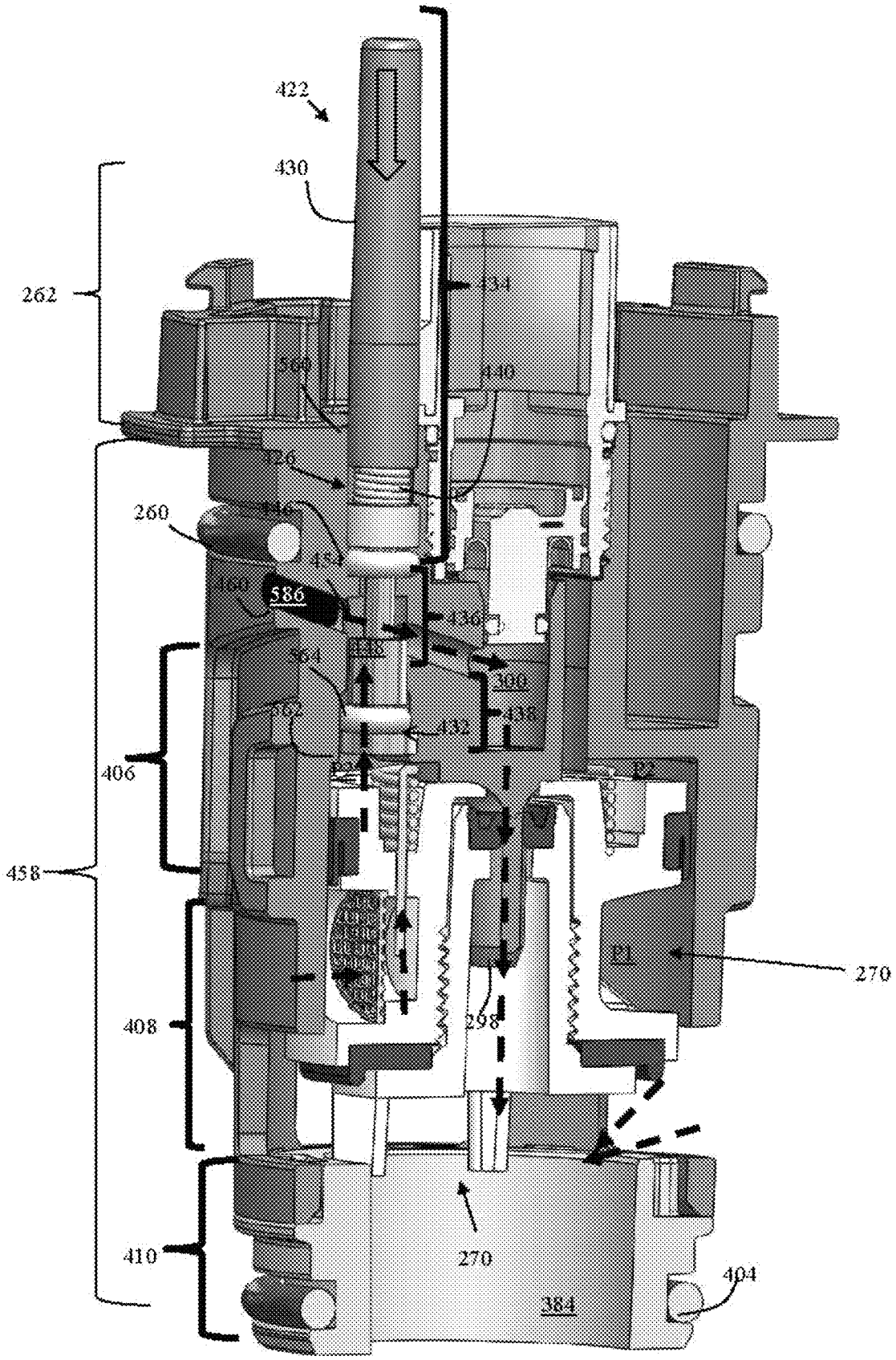
Figure 17E:
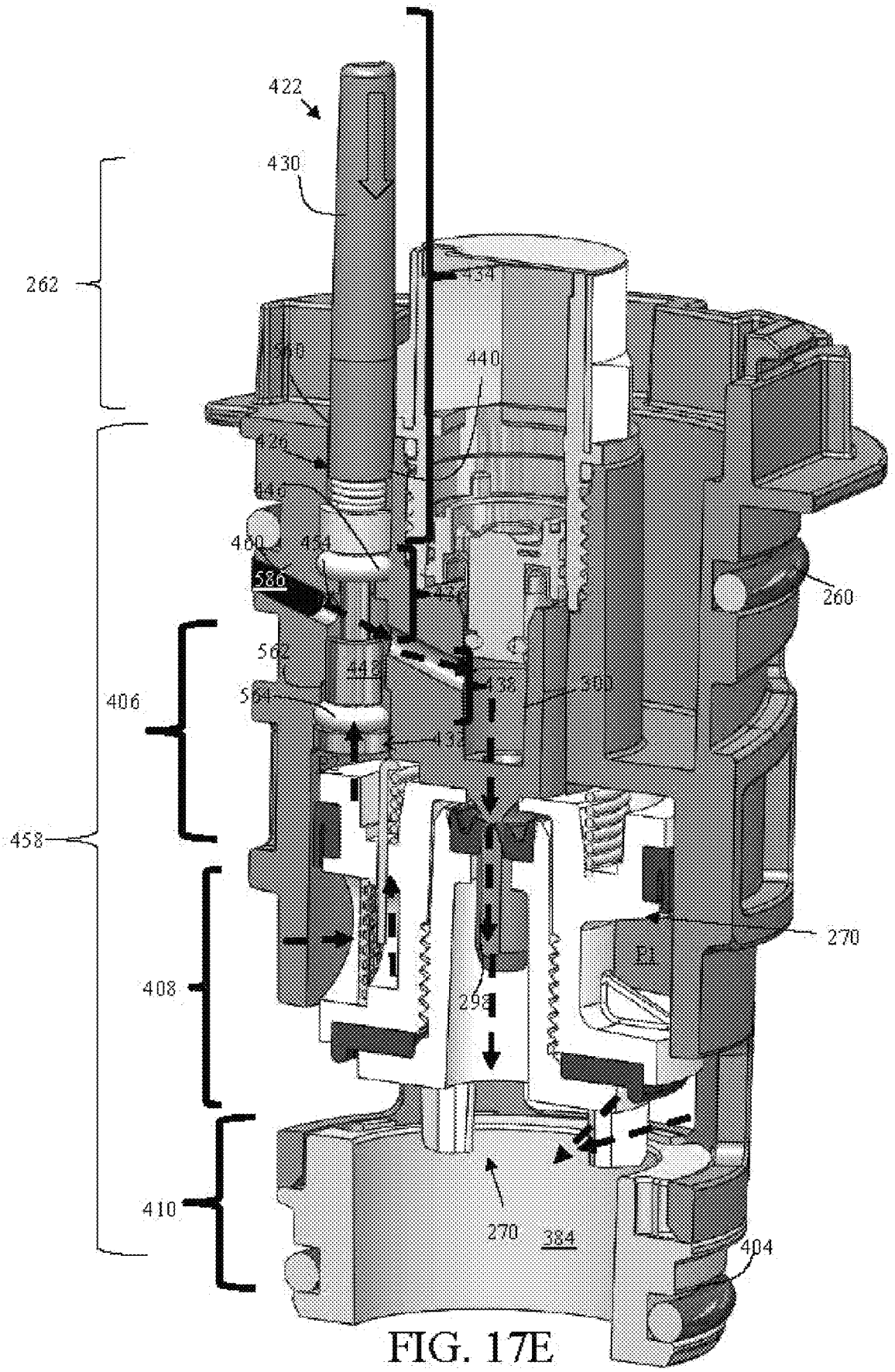
Figure 17F:
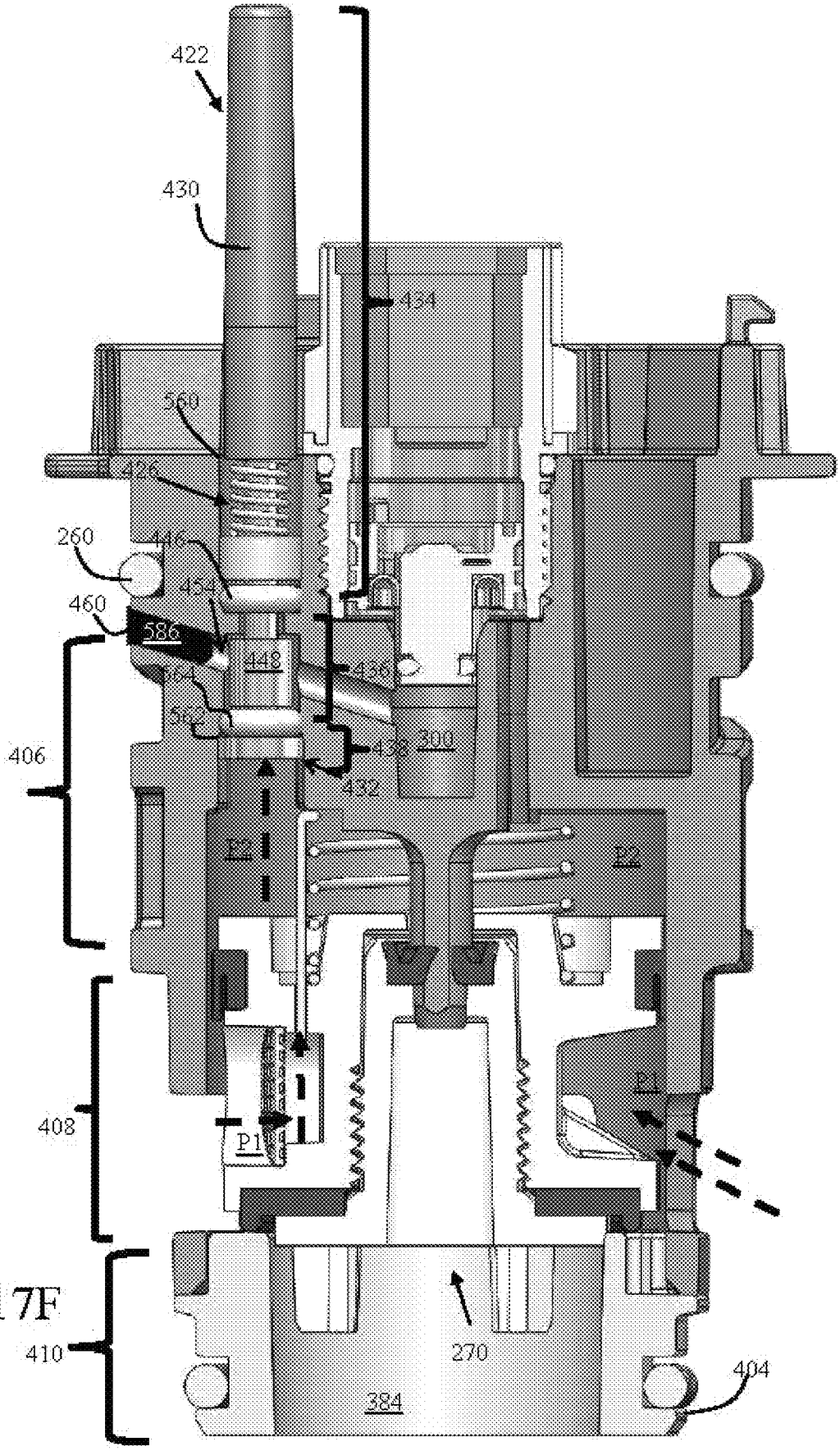

Mechanical plunger 422 in closed position (static state of flush valve) as shown in FIGS. 17A, 17F prevents flow of water from control chamber 406 and into upper discharge chamber 300 via the generally transversely oriented inner channel 454, with gating end 432 blocking a passage of water into inner channel 454.

Mechanical plunger 422 in open position (FIGS. 17B to 17E) when pressed by primary actuator 110 (non-static state of flush valve) allows flow of water from control chamber 406 and into upper discharge chamber 300 via the generally transversely oriented inner channel 454, with the gating end 432 opening access to inner channel 454. Accordingly, a user may press onto primary actuator 110, which in turn, compresses 206, which in turn, presses down mechanical plunger 422 to open position.

As mechanical plunger 422 is moved down to open position, it opens access to control chamber 406. Gating end 432 of mechanical plunger 422 moves within control chamber 406 to enable water at control chamber 406 (which is at pressure P2) to move to inner channel 454 and into upper discharge chamber 300 and out via discharge tube 298 and into lower discharge chamber 410 and to outlet 106. The remaining operation is identical to the above-discussed embodiment.

Once the primary actuator 110 is at rest (or is let go of by the user and is no longer being pressed), mechanical plunger 422 obviously moves to closed position with aid of biasing mechanism 440 (FIGS. 17A, 17F). Once mechanical plunger 422 closes, water from control chamber 406 (above piston 270) no longer moves to inner channel 454 and into upper discharge chamber 300. However, instead, water pressure above piston 270 is again restored as the above-discussed embodiment, where flush valve assembly 100 returns to static condition.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, the interlocking arrangements in relation to interlocking projections 250 of retainer-adapter 132 and interlocking guide tracks 252 of flush valve cartridge 112 may be reversed. That is, interlocking projections 250 may be positioned on flush valve cartridge 112, and interlocking guide tracks 252 positioned on retainer-adapter 132. Such variations and alternate embodiments are contemplated, and can be made without departing from the spirit and scope of the invention.

It should further be noted that throughout the entire disclosure, the labels such as left, right, front, back, top, inside, outside, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction, orientation, or position. Instead, they are used to reflect, relative locations/positions and/or directions/orientations between various portions of an object.

In addition, reference to "first." "second," "third," and etc. members throughout the disclosure (and in particular, claims) is not used to show a serial or numerical limitation but instead is used to distinguish or identify the various members of the group.

Further the terms "a" and "an" throughout the disclosure (and in particular, claims) do not denote a limitation of quantity, but rather denote the presence of at least one of the referenced item.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. An electronic flush valve system for tankless water fixtures, comprising:

a valve housing; and a replaceable flush valve module removably secured within the valve housing;

the flush valve module is comprised of an independent, self-contained flush valve configured as a replaceable flush valve cartridge;

an inlet member associated with the valve housing that has a gate that controls flow of upstream water into the flush valve cartridge;

an enclosure mechanism that moves from an open to closed position to engage with the gate to close-shut the gate to shut-off upstream water flow into the flush valve cartridge, and moves from the closed position to the open position to disengage from the gate to enable gate to open to allow upstream water flow into the flush valve cartridge;

the enclosure mechanism is moved from the open to the closed position as the flush valve cartridge is removed, and is moved from the closed to the open position as the flush valve cartridge is secured within the valve housing.

2. The electronic flush valve system for tankless water fixtures as set forth in claim 1, wherein:

an upper outer surface of valve housing includes a set, of indexing flanges that indicate the final, proper resting position of the flush valve cartridge inside the main body.

3. The electronic flush valve system for tankless water fixtures as set forth in claim 1, wherein:

the upper outer surface of valve housing, near receiver opening further includes lateral openings for fasteners to secure a cover onto main body of valve housing.

4. The electronic flush valve system for tankless water fixtures as set forth in claim 1, wherein:

an upper interior surface of valve housing, near receiver opening has an inner diameter that is threaded for securing a retainer-adapter.

5. The electronic flush valve system for tankless water fixtures as set forth in claim 1, wherein:

a plurality of distinct flanges with different lengths projecting from an interior wall of valve housing, generally perpendicular a central longitudinal axis of the valve housing, forming plurality of ledges that provide a seat for the closure mechanism.

6. The electronic flush valve system for tankless water fixtures as set forth in claim 1, wherein:

integral with an interior of valve body is a latch housing for a latch mechanism.

7. The electronic flush valve system for tankless water fixtures as set forth in claim 6, wherein:

the latch mechanism latches the closure mechanism in both closed and open positions of the closure mechanism.

8. The electronic flush valve system for tankless water fixtures as set forth in claim 6, wherein:

the latch mechanism is comprised, of a biasing mechanism and an engagement member actuated by the biasing mechanism to engage closure mechanism at both closed and open positions of the closure mechanism.

9. The electronic flush valve system for tankless water fixtures as set forth in claim 1, wherein:

the combined main body and flush valve cartridge define a control chamber, a hold chamber, a solenoid chamber, an upper discharge chamber, a lower discharge chamber, and an outlet.

10. The electronic flush valve system for tankless water fixtures as set forth in claim 1, wherein:

the inlet member has an egress opening that includes the gate that is biased closed, but opens when a force of upstream water flowing into inlet member is greater than a biasing force that maintains, the gate closed.

11. The electronic flush valve system for tankless water fixtures as set forth in claim 1, wherein:

the closure mechanism is comprised of:

an engagement portion that engages the gate, maintaining the gate at the biased closed position to thereby maintain closed the egress opening.

12. The electronic flush valve system for tankless water fixtures as set forth in claim 11, wherein the engagement portion of the closure mechanism disengages the gate when the removable flush valve cartridge is fully inserted into valve housing, with upstream water pressure pushing gate from closed to open position.

13. The electronic flush valve system for tankless water fixtures as set forth in claim 12, wherein the closure mechanism further includes a first relief-opening for engagement with the latch mechanism to maintain the closure mechanism at an open position, and a second relief-opening for engagement with the latch mechanism to maintain the closure mechanism at a closed position.

* * * * *